US012064673B2

(12) United States Patent
Girard et al.

(10) Patent No.: US 12,064,673 B2
(45) Date of Patent: Aug. 20, 2024

(54) GOLF CLUB SET PROVIDING IMPROVED DISTANCE GAPPING ADJUSTABILITY

(71) Applicant: Taylor Made Golf Company, Inc., Carlsbad, CA (US)

(72) Inventors: Justin M. Girard, Dallas, TX (US); Michael Scott Burnett, McKinney, TX (US); Jason Sulak, Waco, TX (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 736 days.

(21) Appl. No.: 17/181,923

(22) Filed: Feb. 22, 2021

(65) Prior Publication Data

US 2021/0170248 A1 Jun. 10, 2021

Related U.S. Application Data

(63) Continuation of application No. 16/215,722, filed on Dec. 11, 2018, now abandoned, which is a continuation of application No. 15/141,893, filed on Apr. 29, 2016, now Pat. No. 10,155,145, which is a continuation of application No. 14/227,008, filed on Mar. 27, 2014, now Pat. No. 9,333,400, which is a continuation-in-part of application No. 13/750,127, filed on Jan. 25, 2013, now Pat. No. 8,696,488, which is a continuation of application No. 12/961,652, filed on Dec. 7, 2010, now Pat. No. 8,382,607.

(51) Int. Cl.

| | |
|---|---|
| ***A63B 60/42*** | (2015.01) |
| ***A63B 53/02*** | (2015.01) |
| ***A63B 53/04*** | (2015.01) |
| *A63B 53/00* | (2015.01) |
| *A63B 102/18* | (2015.01) |

(52) U.S. Cl.

CPC ..... *A63B 60/42* (2015.10); *A63B 53/02* (2013.01); *A63B 53/0466* (2013.01); *A63B 53/047* (2013.01); *A63B 53/005* (2020.08); *A63B 53/026* (2020.08); *A63B 2102/18* (2015.10)

(58) Field of Classification Search

CPC ... A63B 53/023; A63B 53/025; A63B 53/026; A63B 53/06; A63B 53/02

See application file for complete search history.

(56) References Cited

U.S. PATENT DOCUMENTS

| | | | |
|---|---|---|---|
| 1,133,129 | A | 3/1915 | Govan |
| 3,984,103 | A | 10/1976 | Nix |
| 4,420,156 | A | 12/1983 | Campau |
| 4,840,380 | A | 6/1989 | Kajita et al. |
| 4,887,815 | A | 12/1989 | Hughes et al. |
| 5,039,098 | A | 8/1991 | Pelz |

(Continued)

FOREIGN PATENT DOCUMENTS

| | | |
|---|---|---|
| EP | 2666523 | 11/2013 |
| JP | 2001198243 | 7/2001 |

OTHER PUBLICATIONS

International Search Report and Written Opinion of the International Searching Authority for International Application No. PCT/2011/057966, mailed Mar. 8, 2012, 8 pages.

*Primary Examiner* — Joshua T Kennedy

(74) *Attorney, Agent, or Firm* — Dawsey Co., LPA; David J. Dawsey

(57) ABSTRACT

A set of golf clubs having a degree of loft and lie adjustability to provide improved distance gapping.

20 Claims, 30 Drawing Sheets

| Cheb | Type | first curved face design lie angle | first curved face upright lie angle | first flat face flat lie angle | first flat face design lie angle |
|---|---|---|---|---|---|
| 4 | curved face adjustable lie hybrid golf club | 59.25 | 59.75 | | |
| 5 | flat face adjustable lie golf club | | | 59.75 | 60.25 |

(56) References Cited

U.S. PATENT DOCUMENTS 5,184,823 A 2/1993 Desboilles et al.
5,513,844 A 5/1996 Ashcraft et al.
5,634,859 A 6/1997 Nesbitt
5,795,240 A 8/1998 Chappell
5,839,973 A 11/1998 Jackson
D404,098 S 1/1999 Ishikawa et al.
6,093,112 A 7/2000 Peters et al.
6,206,790 B1 3/2001 Kubica et al.
6,315,678 B1 * 11/2001 Teramoto ..... A63B 53/10 473/291
6,344,002 B1 2/2002 Kajita
6,769,996 B2 8/2004 Tseng
6,830,519 B2 12/2004 Reed et al.
6,964,620 B2 11/2005 Gilbert et al.
7,083,529 B2 8/2006 Cackett et al.
7,137,903 B2 11/2006 Best et al.
7,153,219 B2 12/2006 Reed et al.
7,207,897 B2 4/2007 Burch et al.
7,335,113 B2 2/2008 Hocknell et al.
7,438,645 B2 * 10/2008 Hsu ..... A63B 53/06 473/307
7,476,160 B2 1/2009 Hocknell et al.
7,530,900 B2 5/2009 Holt et al.
7,553,240 B2 6/2009 Burnett et al.
7,553,241 B2 6/2009 Park et al.
7,566,279 B2 7/2009 Nakashima
7,699,717 B2 4/2010 Morris et al.
7,887,431 B2 2/2011 Beach et al.
7,931,542 B2 4/2011 Kusumoto
7,938,736 B2 5/2011 Park et al.
7,997,997 B2 8/2011 Bennett et al.
8,142,302 B2 3/2012 Balardeta et al.
8,246,488 B2 8/2012 Stevens et al.
8,419,567 B2 4/2013 Jertson et al.
8,480,507 B2 * 7/2013 Finn ..... A63B 53/047 473/291
8,533,060 B1 9/2013 Arluna et al.
8,535,173 B2 9/2013 Golden et al.
8,632,416 B2 * 1/2014 Finn ..... A63B 60/02 473/291
8,696,487 B2 4/2014 Beach et al.
8,926,447 B2 1/2015 Jertson et al.
9,022,878 B2 5/2015 Solhaug
9,033,815 B2 5/2015 Sander et al.
9,409,068 B2 8/2016 Arluna et al.
9,517,391 B2 12/2016 Sander et al.
2003/0181259 A1 9/2003 Shimazaki
2004/0214655 A1 * 10/2004 Reed ..... A63B 53/047 473/290
2008/0280694 A1 11/2008 Hocknell
2009/0062029 A1 3/2009 Stites et al.
2009/0286611 A1 11/2009 Beach et al.
2009/0286619 A1 11/2009 Beach et al.
2010/0197424 A1 8/2010 Beach et al.
2010/0234123 A1 9/2010 Sato et al.
2012/0142445 A1 6/2012 Burnett et al.
2012/0270676 A1 * 10/2012 Burnett ..... A63B 53/0466 473/346
2013/0225311 A1 * 8/2013 Clausen ..... A63B 53/06 473/409
2013/0252754 A1 9/2013 Bazzel et al.
2014/0206469 A1 * 7/2014 Girard ..... A63B 53/0466 473/287
2014/0221115 A1 8/2014 Swartz et al.
2014/0228143 A1 8/2014 Roach et al.
2015/0018114 A1 1/2015 Stokke et al.
2015/0087434 A1 3/2015 Hayashi

* cited by examiner

*Fig. 38*
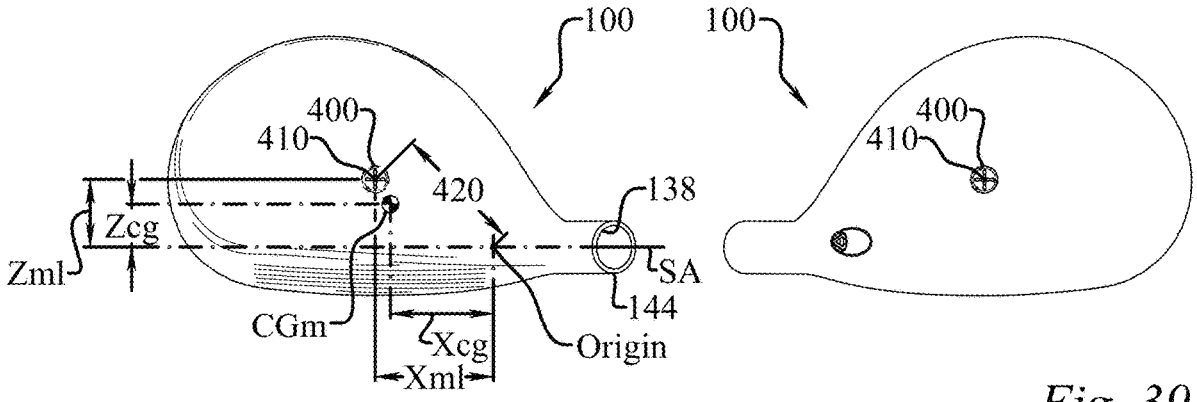
*Fig. 39*
*Fig. 40*
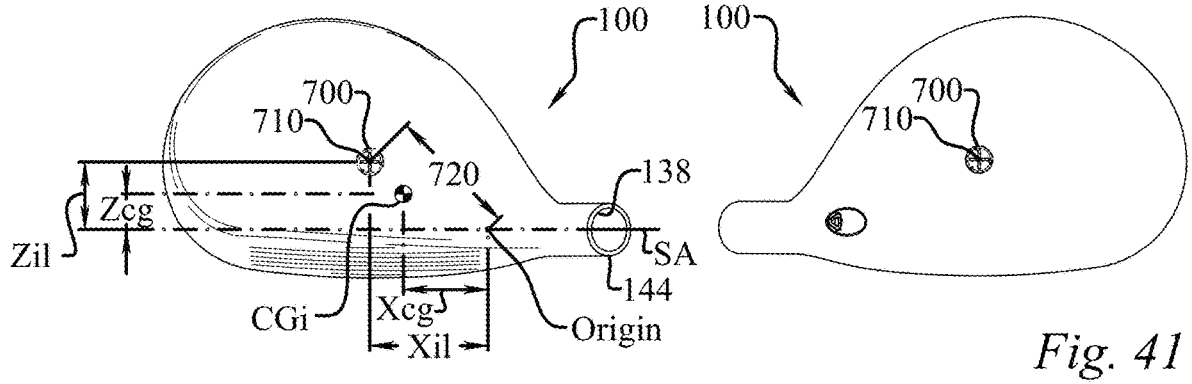
*Fig. 41*
*Fig. 42*
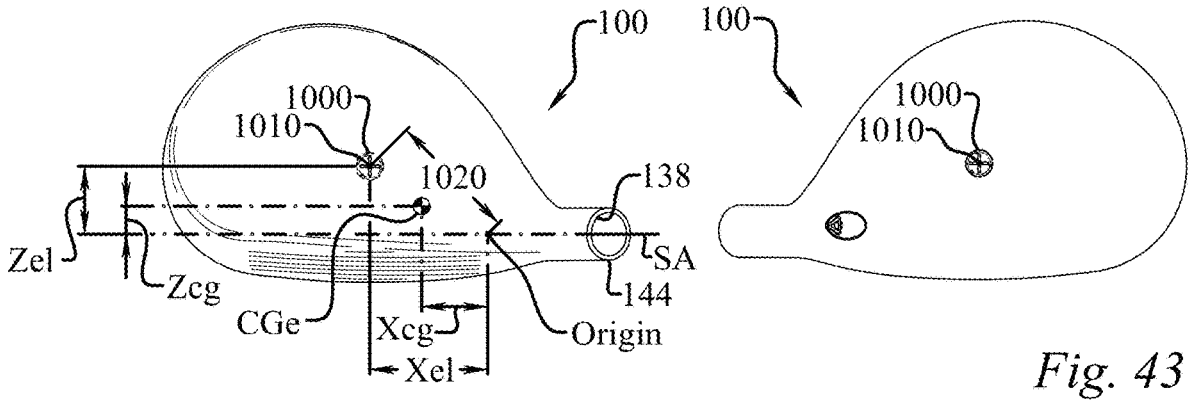
*Fig. 43*

| Club | Type | Loft | Weak Loft |
|---|---|---|---|
| 4 | curved face adjustable loft hybrid golf club | 22 | 24 |
| 5 | flat face non-adjustable loft golf club | 24 | |

*Fig. 56*

| Club | Type | Loft | Weak Loft |
|---|---|---|---|
| 3 | curved face adjustable loft hybrid golf club | 19 | 22 |
| 4 | flat face non-adjustable loft golf club | 22 | |

*Fig. 57*

| Club | Type | Loft | Adjusted Loft |
|---|---|---|---|
| 4 | curved face adjustable loft hybrid golf club | 22 | 23.5 |
| 5 | flat face adjustable loft golf club | 25 | 23.5 |

*Fig. 58*

| Club | Type | Loft | Adjusted Loft |
|---|---|---|---|
| 4 | curved face adjustable loft hybrid golf club | 22 | 24 |
| 5 | flat face adjustable loft golf club | 25 | 23 |

*Fig. 59*

| Club | Type | first curved face minor club length | first curved face intermediate length | first flat face club length |
|---|---|---|---|---|
| 4 | curved face adjustable length hybrid golf club | 39.5 | 39.75 | |
| 5 | flat face non-adjustable length golf club | | | 39 |

*Fig. 60*

| Club | Type | first curved face minor club length | first curved face intermediate length | first flat face club length |
|---|---|---|---|---|
| 4 | curved face adjustable length hybrid golf club | 39.25 | 39.75 | |
| 5 | flat face non-adjustable length golf club | | | 39 |

*Fig. 61*

| Club | Type | first curved face minor club length | first curved face intermediate length | first flat face club length |
|---|---|---|---|---|
| 4 | curved face adjustable length hybrid golf club | 39 | 39.5 | |
| 5 | flat face non-adjustable length golf club | | | 39 |

*Fig. 62*

| Club | Type | first curved face minor club length | first curved face intermediate length | first flat face intermediate club length | first flat face minor club length |
|---|---|---|---|---|---|
| 4 | curved face adjustable length hybrid golf club | 39.5 | 39.75 | | |
| 5 | flat face adjustable length golf club | | | 39 | 38.75 |

*Fig. 63*

| Club | Type | first curved face minor club length | first curved face intermediate length | first flat face intermediate club length | first flat face minor club length |
|---|---|---|---|---|---|
| 4 | curved face adjustable length hybrid golf club | 39.25 | 39.75 | | |
| 5 | flat face adjustable length golf club | | | 39 | 38.5 |

*Fig. 64*

| Club | Type | first curved face minor club length | first curved face intermediate length | first flat face intermediate club length | first flat face minor club length |
|---|---|---|---|---|---|
| 4 | curved face adjustable length hybrid golf club | 39 | 39.5 | | |
| 5 | flat face adjustable length golf club | | | 39 | 38.5 |

*Fig. 65*

| Club | Type | first curved face design lie angle | first curved face upright lie angle | first flat face design lie angle |
|---|---|---|---|---|
| 4 | curved face adjustable lie hybrid golf club | 59.25 | 60.25 | |
| 5 | flat face non-adjustable lie golf club | | | 60.25 |

*Fig. 66*

| Club | Type | first curved face design lie angle | first curved face upright lie angle | first flat face flat lie angle | first flat face design lie angle |
|---|---|---|---|---|---|
| 4 | curved face adjustable lie hybrid golf club | 59.25 | 59.75 | | |
| 5 | flat face adjustable lie golf club | | | 59.75 | 60.25 |

*Fig. 67*

| Club | Type | first curved face design lie angle | first curved face upright lie angle | first flat face flat lie angle | first flat face design lie angle |
|---|---|---|---|---|---|
| 4 | curved face adjustable lie hybrid golf club | 59.25 | 60.0 | | |
| 5 | flat face adjustable lie golf club | | | 59.5 | 60.25 |

*Fig. 68*

| Club | Type | Loft | Weak Loft | first curved face minor club length | first curved face interm length | first flat face club length | first curved face design lie angle | first curved face upright lie angle | first flat face design lie angle |
|---|---|---|---|---|---|---|---|---|---|
| 4 | curved face adjustable hybrid golf club | 22 | **24** | **39** | 39.5 | | 59.25 | **60.25** | |
| 5 | flat face non-adjustable golf club | **24** | | | | **39** | | | **60.25** |

*Fig. 69*

| # | Type | Loft | Adj Loft | first CF minor length | first CF interm length | first FF interm length | first FF minor length | first CF design lie angle | first CF UP angle | first FF flat lie angle | first FF design lie angle |
|---|---|---|---|---|---|---|---|---|---|---|---|
| 4 | curved face adj hybrid golf club | 22 | **23.5** | **39** | 39.5 | | | 59.25 | **59.75** | | |
| 5 | flat face adj golf club | 25 | **23.5** | | | **39** | 38.5 | | | **59.75** | 60.25 |

*Fig. 70*

GOLF CLUB SET PROVIDING IMPROVED DISTANCE GAPPING ADJUSTABILITY

CROSS-REFERENCE TO RELATED APPLICATIONS

This application is a continuation of U.S. nonprovisional application Ser. No. 16/215,722, filed on Dec. 11, 2018, which is a continuation of U.S. nonprovisional application Ser. No. 15/141,893, filed on Apr. 29, 2016, which is a continuation of U.S. nonprovisional application Ser. No. 14/227,008, filed on Mar. 27, 2014, which is a continuation-in-part of U.S. nonprovisional application Ser. No. 13/750,127, filed on Jan. 25, 2013, which is a continuation of U.S. nonprovisional application Ser. No. 12/961,652, filed on Dec. 7, 2010, and now U.S. Pat. No. 8,382,607, all of which is incorporated by reference as if completely written herein.

Other applications and patents concerning golf club heads and components such as U.S. Pat. Nos. 6,773,360, 7,166,040, 7,186,190, 7,407,447, 7,419,441, 6,997,820, 6,800,038, 6,824,475, 7,267,620 and U.S. patent application Ser. No. 11/025,469, Ser. No. 11/524,031, Ser. No. 11/870,913, Ser. No. 11/025,469, Ser. No. 12/006,060, Ser. No. 11/998,435, Ser. No. 11/642,310, Ser. No. 11/825,138, Ser. No. 11/823,638, Ser. No. 12/004,386, Ser. No. 12/004,387, Ser. No. 11/960,609, Ser. No. 11/960,610, Ser. No. 12/412,493, Ser. No. 13/956,046 and Ser. No. 14/060,948 are incorporated by reference in their entirety.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

TECHNICAL FIELD

The present disclosure relates to sports equipment, and more particularly, to a set of golf clubs having improved distance gapping adjustability.

BACKGROUND OF THE INVENTION

Today's golfers are constantly seeking means for improving their game. One avenue for improvement that golfers are turning to is the adjustable, or customizable, golf club. Previously, the United States Golf Association (USGA) rules permitted golf clubs to be adjustable only with respect to the weight of the golf club. However, since 2008, the USGA has allowed golf clubs to be designed with adjustable features other than weight, such as lie, face angle, and/or length. As a result, golfers now have a number of options for customizing a golf club to fit their particular preferences.

One particular aspect of the game where many golfers seek improvement is gapping, a term used to difference in distance obtained by one club to the next club in the set. In convention iron sets, such as traditional forged or cast cavity back irons, the gapping between clubs has traditionally been relatively uniform. However today with the introduction of hybrids and trans-hybrids, or hollow-irons, into traditional iron sets the gapping between clubs has become more of a concern. Particularly since such hybrids and trans-hybrids are incorporating new technologies that increase the distances associated with these clubs. Integrating such clubs into a set introduces new challenges in obtaining preferred gapping.

SUMMARY OF THE INVENTION

In its most general configuration, the presently disclosed invention includes set of golf clubs having a degree of adjustability to provide improved distance gapping. Numerous variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the invention as claimed below and referring now to the drawings and figures:

FIG. 38 is a top plan view of an embodiment of a curved face adjustable golf club head, not to scale;

FIG. 39 is a bottom plan view of an embodiment of a curved face adjustable golf club head, not to scale;

FIG. 40 is a top plan view of an embodiment of a curved face adjustable golf club head, not to scale;

FIG. 41 is a bottom plan view of an embodiment of a curved face adjustable golf club head, not to scale;

FIG. 42 is a top plan view of an embodiment of a curved face adjustable golf club head, not to scale;

FIG. 43 is a bottom plan view of an embodiment of a curved face adjustable golf club head, not to scale;

FIG. 56 is a table showing properties of an embodiment of a golf club set;

FIG. 57 is a table showing properties of an embodiment of a golf club set;

FIG. 58 is a table showing properties of an embodiment of a golf club set;

FIG. 59 is a table showing properties of an embodiment of a golf club set;

FIG. 60 is a table showing properties of an embodiment of a golf club set;

FIG. 61 is a table showing properties of an embodiment of a golf club set;

FIG. 62 is a table showing properties of an embodiment of a golf club set;

FIG. 63 is a table showing properties of an embodiment of a golf club set;

FIG. 64 is a table showing properties of an embodiment of a golf club set;

FIG. 65 is a table showing properties of an embodiment of a golf club set;

FIG. 66 is a table showing properties of an embodiment of a golf club set;

FIG. 67 is a table showing properties of an embodiment of a golf club set;

FIG. 68 is a table showing properties of an embodiment of a golf club set;

FIG. 69 is a table showing properties of an embodiment of a golf club set; and FIG. 70 is a table showing properties of an embodiment of a golf club set.

Figure 1:
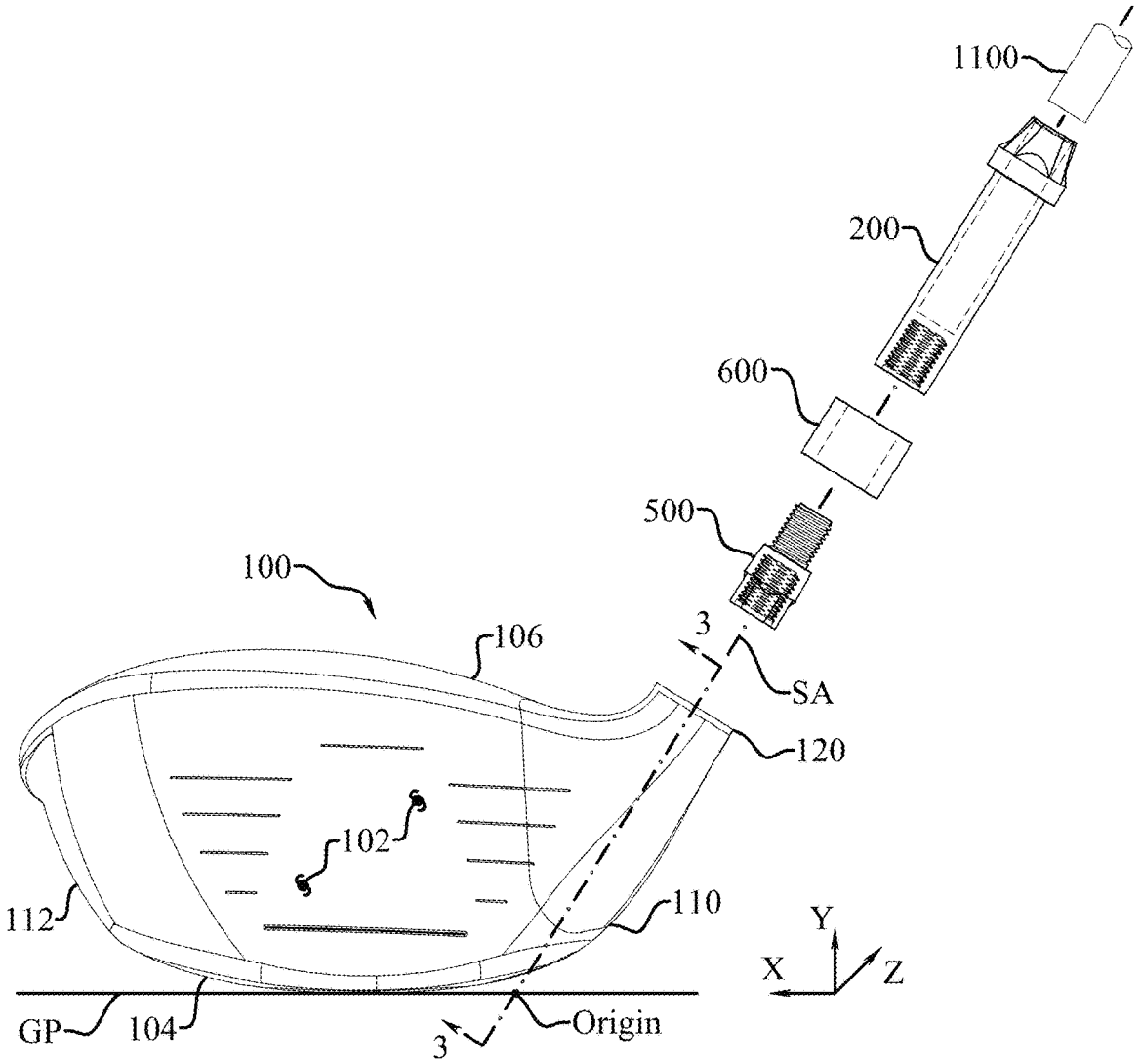
FIG. 1 is an exploded view of an embodiment of a length adjustment system for joining a golf club head to a shaft in an intermediate length configuration, not to scale.

These drawings are provided to assist in the understanding of the exemplary embodiments of the invention as described in more detail below and should not be construed as unduly limiting the system. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The presently disclosed set of golf clubs enables a significant advance in the state of the art. The preferred embodiments accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments, and is not intended to represent the only form in which the set may be constructed or utilized. The description sets forth the designs, functions, means, and methods of implementing the set of golf clubs in connection with the illustrated embodiments. It is to be understood, however, that the same or equivalent functions and features may be accomplished by different embodiments that are also intended to be encompassed within the spirit and scope.

Figure 2:
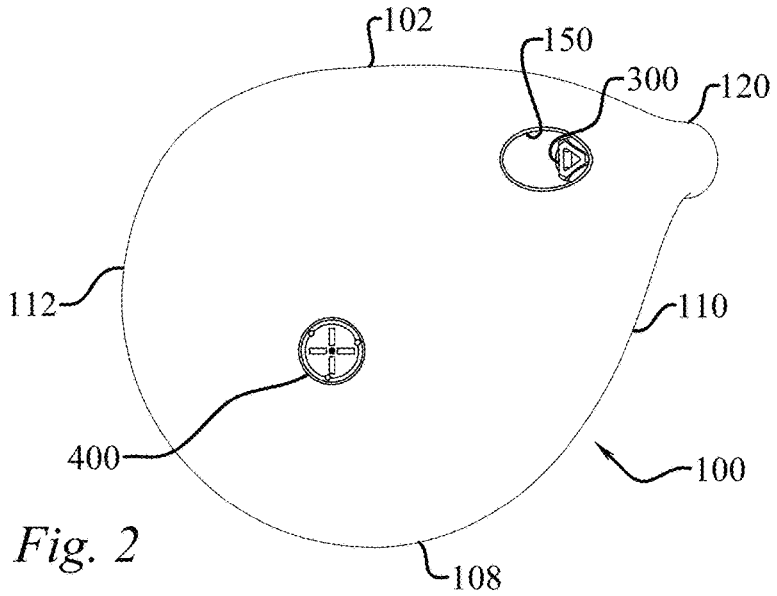
FIG. 2 is a bottom plan view of an embodiment of a golf club head, not to scale.

First, embodiments of a length adjustment system will be disclosed in detail, although such length adjustment capability is just one embodiment of the present set of golf clubs, as will be explained in more detail later. With reference now to FIGS. 1 and 2, an embodiment of a length adjustment system for joining a golf club head (100) to a shaft (1100) is illustrated. As seen in FIG. 1, the golf club head (100) generally includes a face (102) for striking a golf ball, a sole (104), a crown (106), a rear (108), a heel portion (110), and a toe portion (112), although the length adjustment system may also be applied to irons, as will be explained later in more detail. The golf club head (100) also includes a hosel (120) located near the heel portion (110). Those with skill in the art will understand that the term "hosel" generally refers to a bore located near the heel portion (110) of the golf club head (100) that is utilized to secure the golf club head (100) to a shaft (1100). However, it should be noted that this disclosure also applies to so-called "hosel-less" golf club heads, meaning that the golf club head does not have a discernible "neck" emanating from the crown.

As seen in FIG. 2, the golf club head (100) further includes an auxiliary hosel access (150) located on the sole (104) near the heel portion (110). In one embodiment the auxiliary hosel access (150) provides an opening on the sole (104) that is capable of receiving a retainer (300) to secure the golf club head (100) to the shaft (1100), which will be discussed in more detail below, however, the opening may not be in the sole (104) but rather through the side of the hosel (120) itself. The shaft (1100) is preferably formed of a graphite material, although it may be formed of a metallic material, other composite materials, and combinations thereof. Additionally, the shaft (1100) may comprise a hybrid of composite and metal materials.

In order to better understand the present disclosure, some common terms used herein should be defined. First, one of skill in the art will know the meaning of "center of gravity," referred to herein as CG, from an entry level course on the mechanics of solids. With respect to wood-type golf clubs, which are generally hollow and/or having non-uniform density, the CG is often thought of as the intersection of all the balance points of the golf club head. In other words, if you balance the golf club head on the face and then on the sole, the intersection of the two imaginary lines passing straight through the balance points would define the point referred to as the CG.

It is also helpful to establish a coordinate system to identify and discuss the location of the CG. In order to establish this coordinate system, one must first identify a ground plane (GP) and a shaft axis (SA). First, the ground plane (GP) is the horizontal plane upon which a golf club head rests, as seen best in a front elevation view of a golf club head (100) looking at the face (102) of the golf club head (100), as seen in FIG. 1. Secondly, the shaft axis (SA) is the axis of a bore in the golf club head (100) that is designed to receive a shaft (1100). Some golf club heads have an external hosel that contains a bore for receiving the shaft such that one skilled in the art can easily appreciate the shaft axis (SA), while other so-called "hosel-less" golf clubs have an internal bore that receives the shaft that nonetheless defines the shaft axis (SA). The shaft axis (SA) is fixed by the design of the golf club head (100) and is also illustrated in FIG. 1.

The intersection of the shaft axis (SA) with the ground plane (GP) fixes an origin point, labeled "origin" in FIG. 1, for the coordinate system. A three dimensional coordinate system may now be established from the origin with the Y-direction being the vertical direction from the origin; the X-direction being the horizontal direction perpendicular to the Y-direction and wherein the X-direction is parallel to the face (102) of the golf club head (100) in the natural resting position, also known as the design position; and the Z-direction is perpendicular to the X-direction wherein the Z-direction is the direction toward the rear (108) of the golf club head (100). The X, Y, and Z directions are noted on a coordinate system symbol in FIG. 1. It should be noted that this coordinate system is contrary to the traditional right-hand rule coordinate system; however, it is preferred so that the center of gravity may be referred to as having all positive coordinates.

Figure 10:
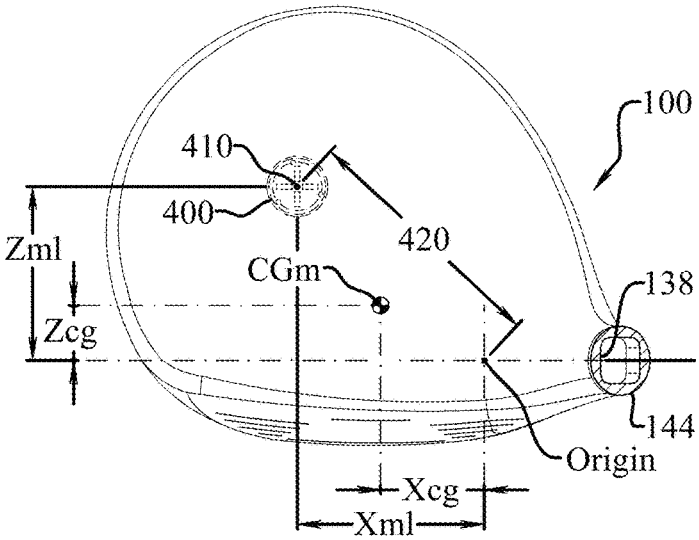
FIG. 10 is a top plan view of an embodiment of a golf club head, not to scale.

Now, with the origin and coordinate system defined, the terms that define the location of the CG may be explained. One skilled in the art will appreciate that the CG of a hollow golf club head such as the wood-type golf club head illustrated in FIG. 10 will be behind the face of the golf club head. The distance behind the origin that the CG is located is referred to as Zcg, as seen in FIG. 10. Similarly, the vertical distance above the origin that the CG is located is referred to as Ycg. Lastly, the horizontal distance from the origin that the CG is located is referred to as Xcg, as seen in FIG. 10. Therefore, the location of the CG may be easily identified by reference to Xcg, Ycg, and Zcg.

The moment of inertia of the golf club head (100) is a key ingredient in the playability of the club. Again, one skilled in the art will understand what is meant by moment of inertia with respect of golf club heads. As used herein, the term moment of inertia indicates MOIy, which is the moment of the inertia of the golf club head (100) around an axis through the CG, parallel to the Y-axis. MOIy is the moment of inertia of the golf club head (100) that resists opening and closing moments induced by ball strikes towards the heel portion (110) or the toe portion (112) of the golf club head (100).

The length adjustment system for joining a golf club head (100) to a shaft (1100) generally includes a number of components that may be utilized to create a number of golf club configurations. For example, in one embodiment, various components of the length adjustment system may be used to produce a minor length of a golf club and an intermediate length of a golf club. In another embodiment, the components of the length adjustment system may be used to produce a minor length, an intermediate length, and an extended length of a golf club. Each of the length configurations will be discussed in detail below. While the disclosure specifically notes three length configurations, those with skill in the art will appreciate that the length adjustment system may have as few as two length configurations, as well as more than three length configurations.

Figure 3:
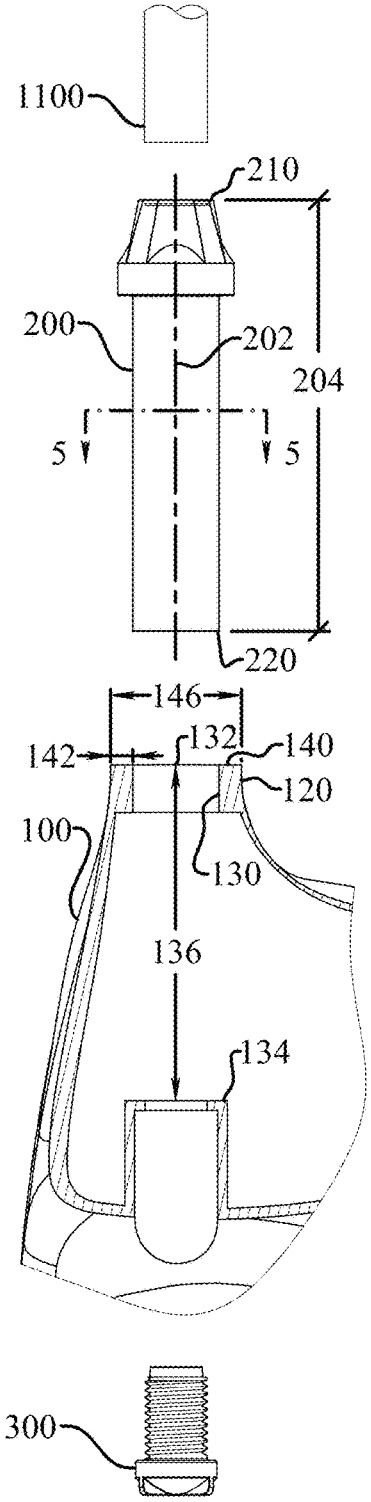
FIG. 3 is an exploded cross-sectional view of an embodiment of the length adjustment system for joining a golf club head to a shaft in a minor length configuration, not to scale.

Referring generally to FIGS. 3-10, embodiments of various components of the length adjustment system for joining a golf club head (100) to a shaft (1100) to produce a minor length configuration are shown. As seen in FIG. 3, the golf club head (100) includes a hosel (120) having a hosel bore (130) and a hosel ledge (140). The hosel bore (130) includes a hosel bore distal end (132) separated from a hosel bore proximal end (134) by a hosel bore length (136). The hosel bore (130) further includes a hosel bore cross-sectional perimeter (138), as seen in FIG. 10. Referring again to FIG. 3, the hosel ledge (140) has a hosel ledge width (142) and a hosel ledge diameter (146). The hosel ledge (140) also includes a hosel ledge surface area (144), as illustrated in FIG. 10. In an embodiment of a driver, the golf club head (100) will generally have a weight of no more than 200 grams, and more preferably weighs between 170 grams and 180 grams.

Figure 4:
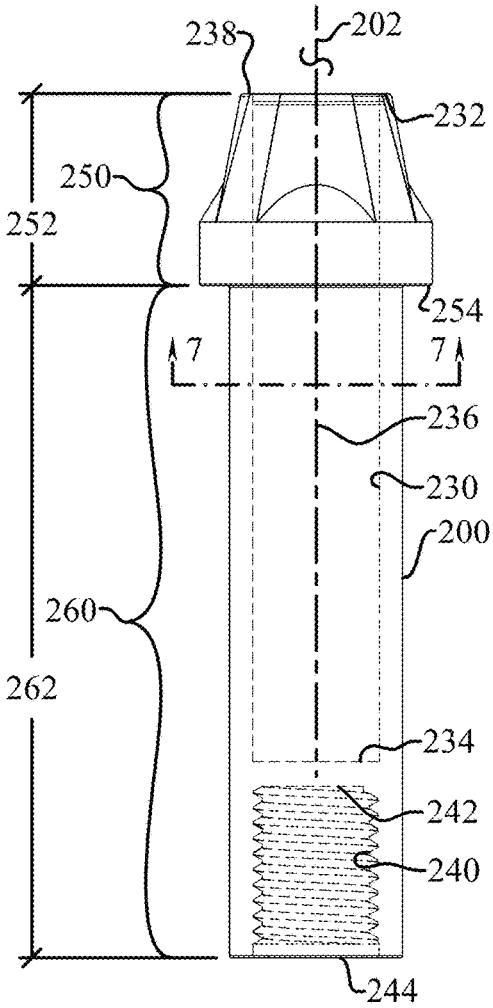
FIG. 4 is an elevation view of an embodiment of a shaft sleeve, not to scale.
Figure 7:
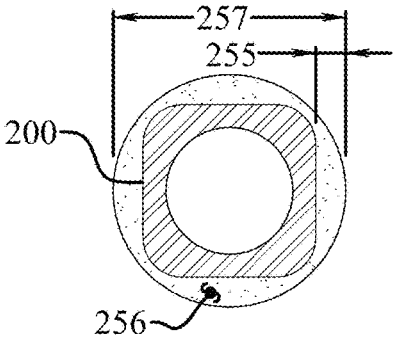
FIG. 7 is a cross-sectional view of an embodiment of a shaft sleeve taken along section line 7-7 in FIG. 4, not to scale.

With reference now to FIGS. 3 and 4, an embodiment of a shaft sleeve (200) of the length adjustment system is shown. The shaft sleeve (200) includes a shaft sleeve axis (202) and a shaft sleeve length (204) that separates a shaft sleeve distal end (210) from a shaft sleeve proximal end (220). As seen in FIG. 4, the shaft sleeve (200) includes a shaft sleeve receiving bore (230) having a receiving bore diameter (231), seen only in FIG. 5, a receiving bore distal end (232), a receiving bore proximal end (234), a receiving bore axis (236), and a receiving bore inlet edge (238). The shaft sleeve (200) further includes a shaft sleeve retainer (240) having a shaft sleeve retainer distal end (242) and a shaft sleeve retainer proximal end (244). As seen in FIGS. 4 and 7, the shaft sleeve (200) also has an exposed portion (250) including an exposed portion length (252) and a shaft sleeve ledge (254) having a ledge width (255), a ledge surface area (256), and a ledge diameter (257). Finally, the shaft sleeve (200) includes a head engagement portion (260) having an engagement portion length (262) and an engagement portion cross-sectional perimeter (264). By way of example only and not limitation, the shaft sleeve (200) may be formed of aluminum, steel, titanium, plastic, and combinations thereof, just to name a few materials. However, those with skill in the art will recognize that other materials may be used. The shaft sleeve (200) is configured to have a weight between 8 grams and 15 grams.

Figure 5:
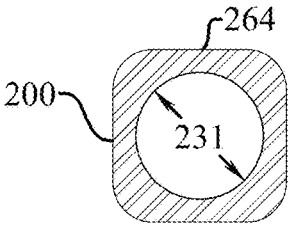
FIG. 5 is a cross-sectional view of an embodiment of a shaft sleeve taken along section line 5-5 in FIG. 3, not to scale.
Figure 8:
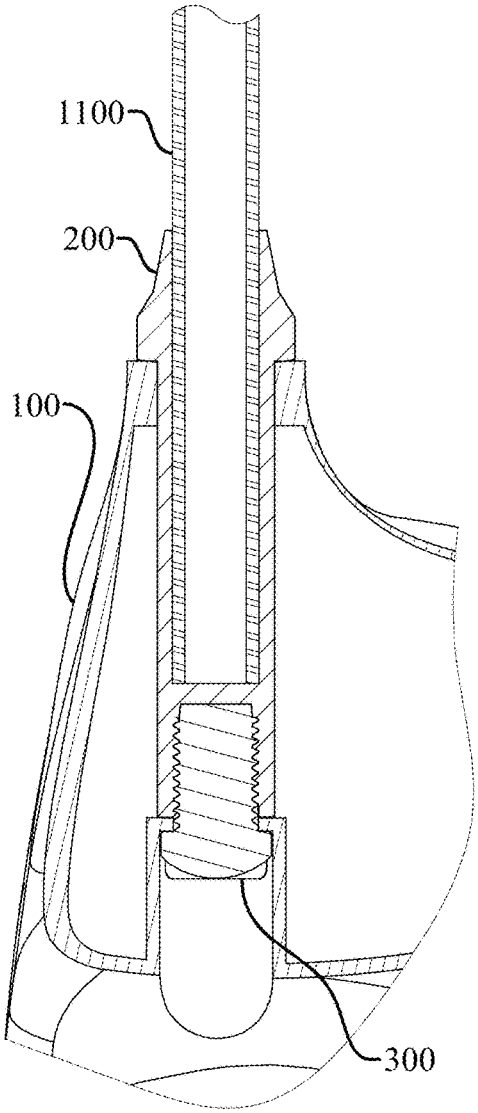
FIG. 8 is a cross-sectional view of an embodiment of a length adjustment system for joining a golf club head to a shaft in a minor length configuration, not to scale.

Referring now to FIG. 8, an assembled view of the components of the length adjustment system to produce a minor length configuration is shown. As seen in FIG. 8, the shaft sleeve (200) is attached to an end of the shaft (1100). The shaft sleeve (200) may be attached to the end of the shaft (1100) utilizing an adhesive, such as epoxy. After the shaft sleeve (200) is attached to the end of the shaft (1100), the shaft sleeve (200) is inserted into the hosel (120). As seen in FIG. 5, this particular embodiment of the shaft sleeve (200) has an engagement portion cross-sectional perimeter (264) that is square shaped with rounded corners. The hosel bore (130) is similarly configured with a hosel bore cross-sectional perimeter (138) that is square shaped with rounded corners, as seen in FIG. 10, such that the shaft sleeve (200) cooperates with the hosel (120) of the golf club head (100). The engagement portion cross-sectional perimeter (264) and the hosel bore cross-sectional perimeter (138) are designed to cooperate with one another and also impart a rotation prevention aspect to the connection, due to the non-circular cross-sections. Thus, one with skill in the art will appreciate that the engagement portion cross-sectional perimeter (264) and the hosel bore cross-sectional perimeter (138) may have configurations other than square shaped with rounded corners, such as triangular or hexagonal, just to name a couple.

Figure 33:
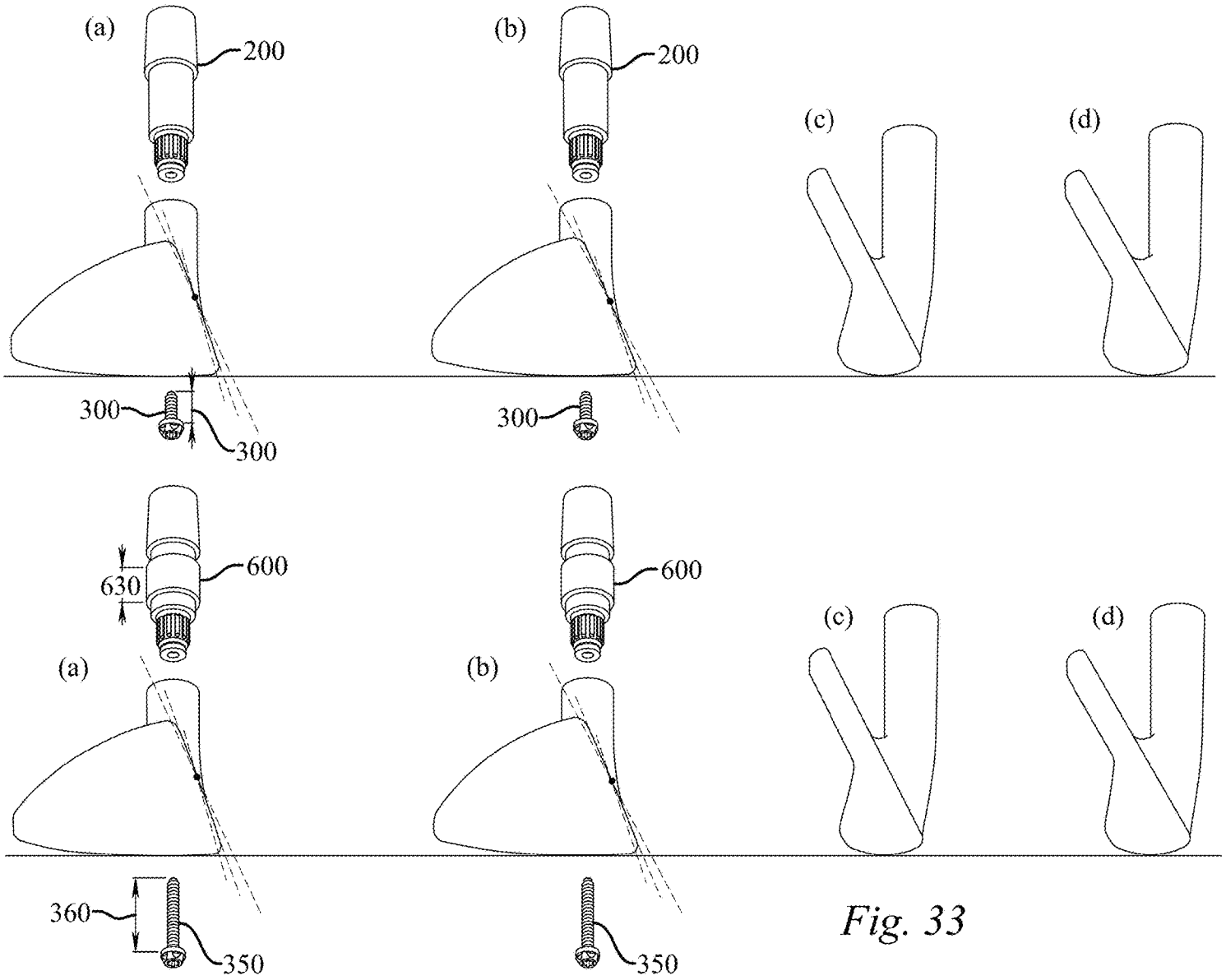
FIG. 33 is a side elevation view of an embodiment of a golf club set, not to scale.

When the shaft sleeve (200) and shaft (1100) are inserted into the hosel (120), a retainer (300) may be passed through the auxiliary hosel access (150) to cooperate with the shaft sleeve retainer (240) to releasably secure the shaft (1100) to the golf club head (100). As seen in FIGS. 3 and 4, the retainer (300) may be a bolt having external threads that are configured to cooperate with the internal threads of the shaft sleeve retainer (240) to provide a secure connection, or vice versa. Further, the retainer (300) may be a locking pin or locking key type of retainer. Preferably, the retainer (300) weighs between 2 grams and 5 grams, or between 4 grams and 7 grams when an extended length retainer (300) is used in the intermediate length configuration or the extended length configuration, as seen in FIG. 33(*a*). In the minor length configuration, as seen in FIG. 8, the shaft sleeve (200) is releasably secured to the golf club head (100) by the retainer (300) to produce a minor length of a golf club. In one embodiment, the minor length of the golf club may correspond to a standard length, or sometimes referred to as a design length, for that particular golf club (e.g., 45 inches for a driver). However, those with skill in the art will recognize that standard lengths often vary among the various golf equipment manufacturers and vary with the type of club (drivers, fairway woods, hybrids, trans-hybrids, long irons, mid-irons, short irons, wedges, putters).

Figure 9:
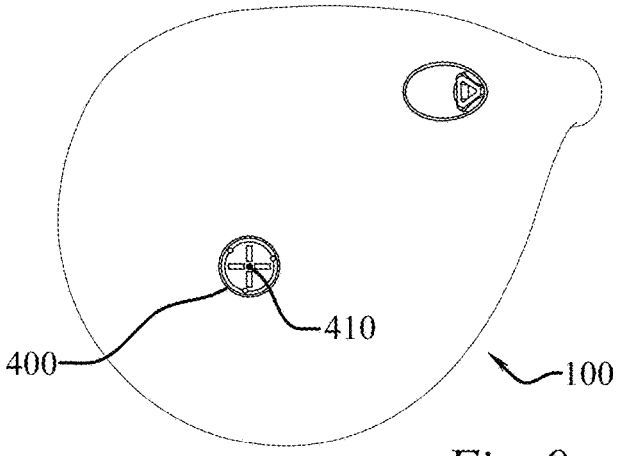
FIG. 9 is a bottom plan view of an embodiment of a golf club head, not to scale.

The length adjustment system in the minor length configuration also has a minor length weight. The minor length weight comprises the combined weight of the golf club head (100), the shaft sleeve (200), the retainer (300), and a minor length weight system (400), which is shown in FIGS. 9 and 10. In one embodiment the minor length weight system (400) may comprise a weight nut secured in a weight port on the sole (104) of the golf club head (100), however one skilled in the art will appreciated that numerous other possibilities exist, including, but not limited to, weights that are not nut based including threaded weights, snap-in weights, and locking weights, hosel weights, weighted badges, and weight ports located elsewhere on the club head, just to name a few. The minor length weight system (400) generally has a weight between 12 grams and 18 grams.

In one embodiment seen in FIGS. 9 and 10, the minor length weight system (400) has a minor length weight system center (410) and a minor length weight system offset distance (420). The location of the minor length weight system center (410) in an X-Z plane is a distance Xml and a distance Zml from the origin, as seen in FIGS. 10 and 38. The minor length weight system offset distance (420), seen in FIGS. 10 and 38, is the linear distance from the origin to the minor length weight system center (410) measured in the X-Z plane. When in the minor length configuration, the minor length weight produces a minor length center of gravity (CGm) and a minor length moment of inertia. As seen in FIG. 10, the minor length center of gravity (CGm) has an X coordinate, represented by the distance Xcg from the origin, and a Z coordinate, represented by the distance Zcg from the origin. Additionally, the minor length center of gravity (CGm) has a Y coordinate (not shown), which corresponds to the vertical distance above the origin that the minor length center of gravity (CGm) is located.

Referring generally to FIGS. 11-17, embodiments of various components of the length adjustment system for joining a golf club head (100) to a shaft (1100) to produce an intermediate length configuration are shown. Just as with the minor length configuration, the intermediate length configuration features the shaft sleeve (200) attached to the end of the shaft (1100). However, to produce the intermediate length configuration additional, or alternative, components of the length adjustment system are required.

Figure 11:
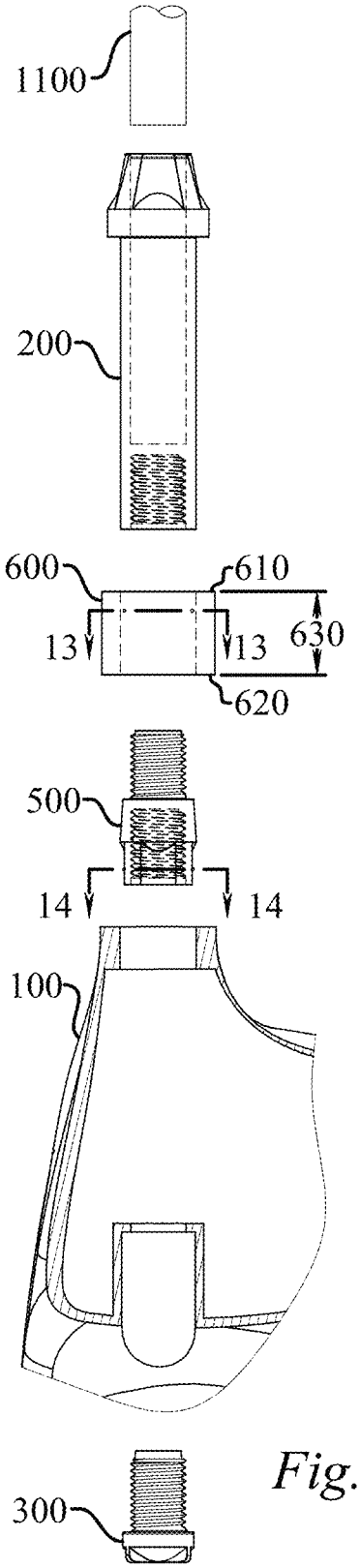
FIG. 11 is an exploded cross-sectional view of an embodiment of a length adjustment system for joining a golf club head to a shaft in an intermediate length configuration, not to scale.
Figure 12:
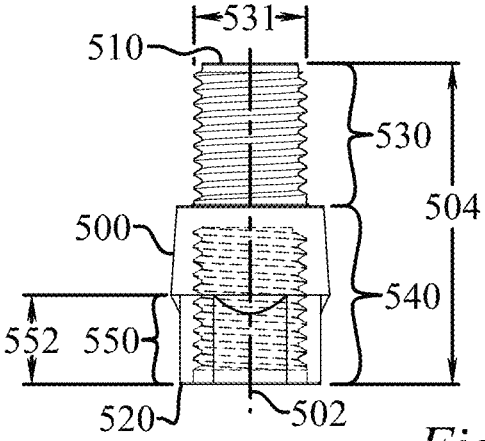
FIG. 12 is an elevation view of an embodiment of a first spacer, not to scale.

For example, in one embodiment the length adjustment system includes at least a first spacer (500) and at least a first hosel sleeve (600), as seen in FIG. 11; although one skilled in the art will appreciate that the spacer (500) may be eliminated substituting a longer retainer (300). In the spacer embodiments, the first spacer (500) includes a first spacer axis (502) and a first spacer length (504) that separates a first spacer distal end (510) from a first spacer proximal end (520), as seen in FIG. 12. Further, the first spacer (500) includes a first spacer-to-sleeve connection portion (530) having a first spacer-to-sleeve connector diameter (531), also seen in FIG. 12. The first spacer (500) further includes a first spacer retainer portion (540) and a first spacer gripping portion (550) having a first spacer gripping portion length (552) and a first spacer gripping portion perimeter (554), seen only in FIG. 14. The first spacer gripping portion (550) is a shape that is other than round so that it may be easily gripped by a tool to facilitate its engagement with the shaft sleeve (200). By way of example only and not limitation, the first spacer (500) may be formed of aluminum, steel, titanium, plastic, and combinations thereof, just to name a few materials. However, those with skill in the art will recognize that other materials may be used. The first spacer (500) generally has a weight between 1.5 grams and 3.5 grams.

Figure 13:
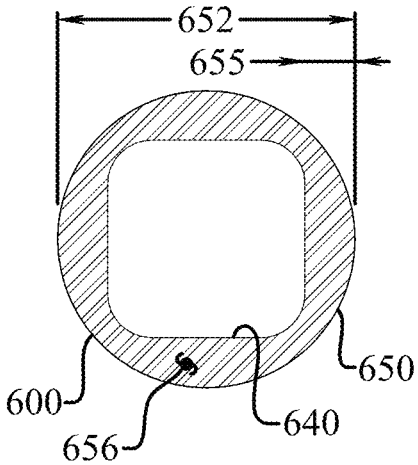
FIG. 13 is a cross-sectional view of an embodiment of a first hosel sleeve taken along section line 13-13 in FIG. 11, not to scale.
Figure 14:
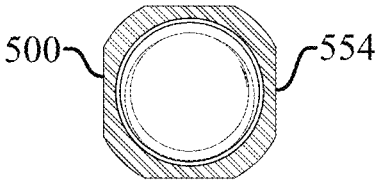
FIG. 14 is a cross-sectional view of an embodiment of a first spacer taken along section line 14-14 in FIG. 11, not to scale.

With reference now to FIGS. 11 and 13, an embodiment of the first hosel sleeve (600) is shown. The first hosel sleeve (600) includes a first hosel sleeve distal end (610) that is separated from a first hosel sleeve proximal end (620) by a first hosel sleeve length (630). As seen in FIG. 13, the first hosel sleeve (600) also includes a first hosel sleeve interior cross-sectional perimeter (640) and a first hosel sleeve exterior cross-sectional perimeter (650). Additionally, the first hosel sleeve (600) has a first hosel sleeve exterior diameter (652), a first hosel sleeve ledge width (655), and a first hosel sleeve ledge surface area (656). By way of example only and not limitation, the first hosel sleeve (600) may be formed of aluminum, steel, titanium, plastic, and combinations thereof, just to name a few materials. However, those with skill in the art will recognize that other suitable materials may be utilized. The first hosel sleeve (600) is configured to have a weight within a range of about 2 grams to about 5 grams. In addition to contributing to the length of the golf club, the fist hosel sleeve (600) helps stabilize the shaft sleeve (200) between the shaft sleeve ledge (254) and the hosel ledge (140) and prevents the shaft sleeve (200) from rocking, while providing a look consistent with the minor length configuration.

Figure 15:
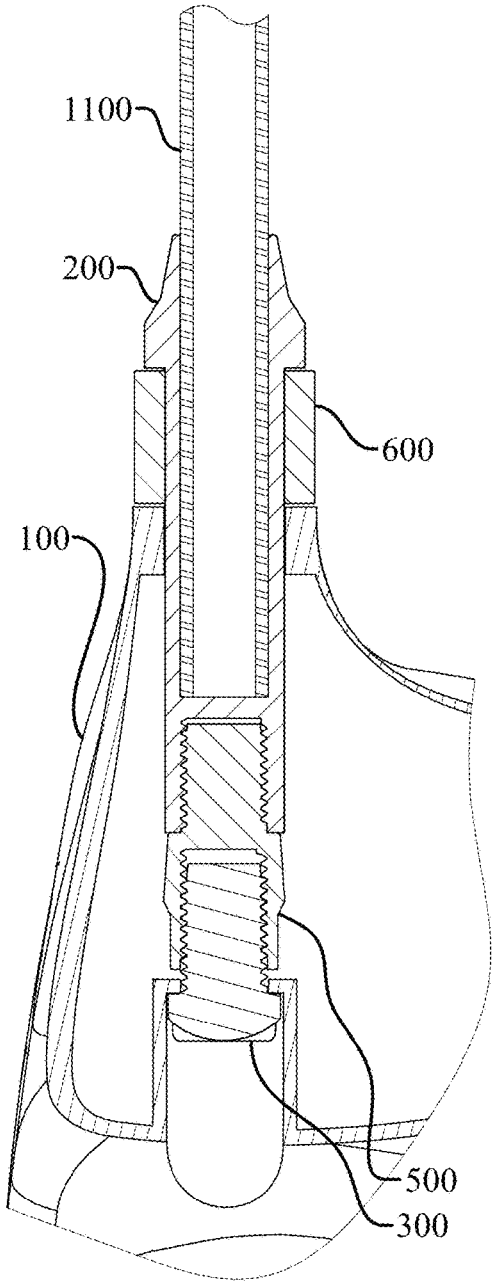
FIG. 15 is a cross-sectional view of an embodiment of a length adjustment system for joining a golf club head to a shaft in an intermediate length configuration, not to scale.

An assembled view of the components of a spacer embodiment of the length adjustment system to produce an intermediate length configuration is shown in FIG. 15. While the non-spacer embodiments of the intermediate length configuration are not independently illustrated, one skilled in the art will appreciate that spacer (500) of FIG. 11 is eliminated, while a longer retainer (350), seen in FIG. 33(*a*), is provided in the intermediate length configuration to account for the introduction of the first hosel sleeve (600) and the first hosel sleeve length (630), which keeps the shaft sleeve proximal end (220) separated from the hosel bore proximal end (134).

As previously mentioned, the intermediate length configuration includes the shaft sleeve (200) and shaft (1100) combination described with respect to the minor length configuration. Thus, the shaft sleeve (200) will remain capable of cooperating with the hosel (120) of the golf club head (100).

In assembling the components of the length adjustment system to produce an intermediate length configuration, the first step may include securing the first spacer (500) to the shaft sleeve (200). As seen in the spacer embodiment of FIG. 11, the first spacer (500) includes a first spacer-to-sleeve connector portion (530) that may comprise an externally threaded male connector that is configured to cooperate with the internal threads of the shaft sleeve retainer (240) to provide a secure connection, however other types of releasable locking connections may be utilized. Moreover, the first spacer (500) is configured for reception within the hosel (120) by having a first spacer gripping portion perimeter (554) that is capable of sliding within the hosel bore cross-sectional perimeter (138).

The next step in the assembly process of the spacer embodiment may include inserting the combined first spacer (500) and shaft sleeve (200) through the first hosel sleeve (600), while in the non-spacer embodiment just the shaft sleeve (200) is inserted through the first hosel sleeve (600). As seen in FIG. 13, the first hosel sleeve (600) has a first hosel sleeve interior cross-sectional perimeter (640) that is configured to receive the shaft sleeve (200) and first spacer (500), in embodiments having the first spacer (500). In such spacer embodiments, after the first spacer (500) and shaft sleeve (200) are inserted through the first hosel sleeve (600), the next step is to insert the first spacer (500) and shaft sleeve (200) into the hosel (120) so that the first hosel sleeve (600) is adjacent to the hosel (120), as seen in FIG. 15; while the non-spacer embodiments after the shaft sleeve (200) is inserted through the first hosel sleeve (600) it is inserted into the hosel so that the first hosel sleeve (600) is adjacent to the hosel (120) thereby keeping the shaft sleeve proximal end (220) separated from the hosel bore proximal end (134) by a distance equal to the first hosel sleeve length (630). The final step in the assembly process comprises passing the retainer (300) through the auxiliary hosel access (150) to cooperate with the first spacer retainer portion (540) to releasably secure the shaft (1100) to the golf club head (100), in spacer embodiments, while non-spacer embodiments pass an extended retainer (350), seen in FIG. 33(*a*), through the auxiliary hosel access (150) to cooperate with the shaft sleeve (200) to releasably secure the shaft (1100) to the golf club head (100). The extended retainer (350) has an extended retainer length (360) that provides the additional length necessary to cooperate with the shaft sleeve (200) in light of the hosel sleeve.

In one embodiment the retainer (300) is coaxial with the shaft sleeve (200) and the retainer (300) imparts a tensile load on the shaft sleeve (200), which imparts a compressive load on the first hosel sleeve (600) and forcing it to securely seat against the hosel ledge (140). As seen in FIGS. 12 and 15, in some embodiments the first spacer retainer portion (540) may include a bore having internal threads that are configured to cooperate with the external threads of the retainer (300) to provide a secure connection.

In the intermediate length configuration, as seen in FIG. 15, the various components are releasably secured to the golf club head (100) by the retainer (300) to produce an intermediate length of a golf club. In one embodiment, the intermediate length of the golf club is at least ¼ inch greater than the minor length of the golf club. This embodiment provides a slight increase in golf club length, which some golfers may prefer because the increased length would be less noticeable at address and when swinging the golf club. In another embodiment, the intermediate length of the golf club is at least ½ inch greater than the minor length of the golf club. Such an embodiment would provide a more noticeable increase in golf club length, and may be preferred by golfers who are seeking to maximize their distance or fine tune their gapping within a set of golf clubs.

Figure 16:
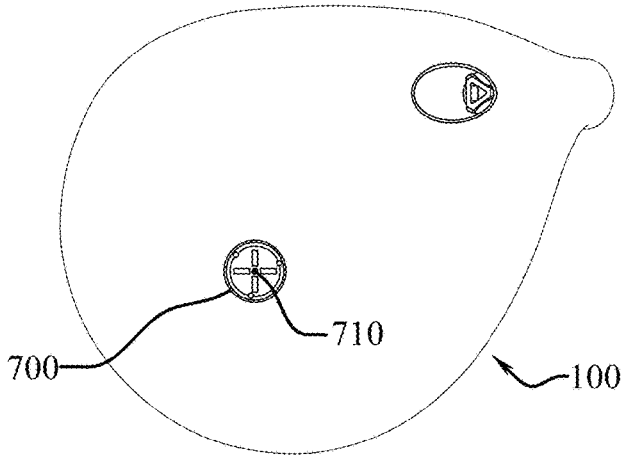
FIG. 16 is a bottom plan view of an embodiment of a golf club head, not to scale.
Figure 17:
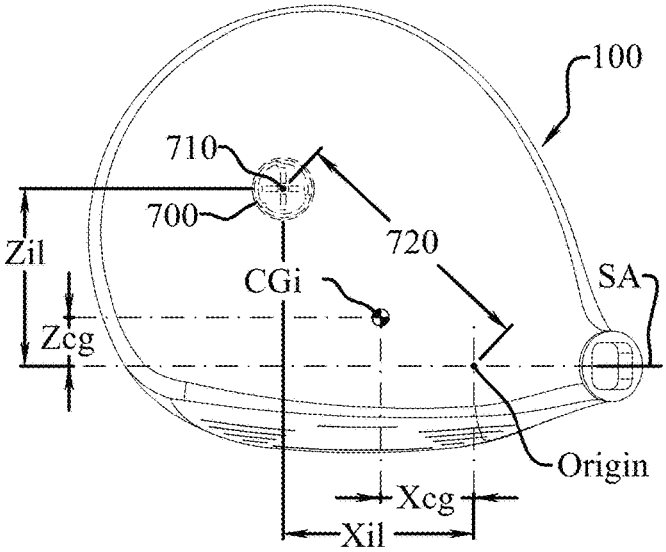
FIG. 17 is a top plan view of an embodiment of a golf club head, not to scale.

The length adjustment system in the intermediate length configuration also has an intermediate length weight. In the spacer based embodiment, the intermediate length weight comprises the combined weight of the golf club head (100), the shaft sleeve (200), the first spacer (500), the first hosel sleeve (600), the retainer (300), and an intermediate length weight system (700), which is shown in FIGS. 16 and 17. Whereas in the extended retainer based embodiment, the intermediate length weight comprises the combined weight of the golf club head (100), the shaft sleeve (200), the first hosel sleeve (600), the extended length retainer (300), and an intermediate length weight system (700). As with the minor length weight system (400), the intermediate length weight system (700) may comprise a weight configured to cooperate with a weight port on the sole (104) of the golf club head (100), as well as the other embodiments previously described with respect to the minor length weight system (400). The intermediate length weight system (700) may have a weight between 4 grams and 8 grams. As seen in FIGS. 16, 17, 40, and 41, the intermediate length weight system (700) has an intermediate length weight system center (710) and an intermediate length weight system offset distance (720). The location of the intermediate length weight system center (710) in an X-Z plane is a distance Xil and a distance Zil from the origin, as seen in FIG. 17. The intermediate length weight system offset distance (720), seen in FIG. 17, is the linear distance from the origin to the intermediate length weight system center (710) measured in the X-Z plane. When in the intermediate length configuration, the intermediate length weight produces an intermediate length center of gravity (CGi) and an intermediate length moment of inertia. As seen in FIG. 17, the intermediate length center of gravity (CGi) has an X coordinate, represented by the distance Xcg from the origin, and a Z coordinate, represented by the distance Zcg from the origin. Additionally, the intermediate length center of gravity (CGi) has a Y coordinate (not shown), which corresponds to the vertical distance above the origin that the intermediate length center of gravity (CGi) is located.

While this particular embodiment of the length adjustment system permits a golf club to be easily transitioned between a minor length configuration and an intermediate length configuration, it does so in such a way that the characteristics of the golf club do not substantially change between the minor length configuration and the intermediate length configuration. For example, in this embodiment, the intermediate length weight is within 5 percent of the minor length weight. Thus, assuming a minor length weight of 200 grams, the intermediate length weight may be within a range of 190 grams to 210 grams. Still further, the intermediate length moment of inertia is within 10 percent of the minor length moment of inertia. For instance, assuming a minor length moment of inertia of 4000 $g*cm^2$, the intermediate length moment of inertia may be within a range of 3600 $g*cm^2$ to 4400 $g*cm^2$. Moreover, in this particular embodiment, the X, Y, and Z coordinates of the intermediate length center of gravity (CGi) are all within 15 percent of the X, Y, and Z coordinates of the minor length center of gravity (CGm). Again, for the simplicity of the example, assuming the minor length center of gravity (CGm) has an X coordinate of 1.0, a Y coordinate of 1.0, and a Z coordinate of 1.0, the intermediate length center of gravity (CGi) may have an X coordinate within a range of 0.85 to 1.15, a Y coordinate within a range of 0.85 to 1.15, and a Z coordinate within a range of 0.85 to 1.15. Thus, when changing between the minor length configuration and the intermediate length configuration, the characteristics of the golf club do not substantially change, which results in the golf club having a consistent feel in each configuration.

As noted above, the X, Y, and Z coordinates of the intermediate length center of gravity (CGi) are all within 15 percent of the X, Y, and Z coordinates of the minor length center of gravity (CGm). Moreover, it has been observed that the length adjustment system results in additional unique relationships between the intermediate length center of gravity (CGi) and the minor length center of gravity (CGm). For example, in one embodiment, the X coordinate of the intermediate length center of gravity (CGi) is less than the X coordinate of the minor length center of gravity (CGm). As a result, in this embodiment, the center of gravity of the golf club head (100) is moved closer to the heel portion (110) when increasing the length from a minor length to an intermediate length, which gives the golf club head (100) a slight draw bias. This may be desirable for golfers who tend to slice golf shots when using a longer golf club. In another embodiment, the Y coordinate of the intermediate length center of gravity (CGi) is greater than the Y coordinate of the minor length center of gravity (CGm). In this embodiment, the center of gravity of the golf club head (100) would be positioned higher on the face (102) when increasing the length from a minor length to an intermediate length. Such an embodiment may be desirable for those golfers who seek more distance, as well as improved shot control.

Figure 44:
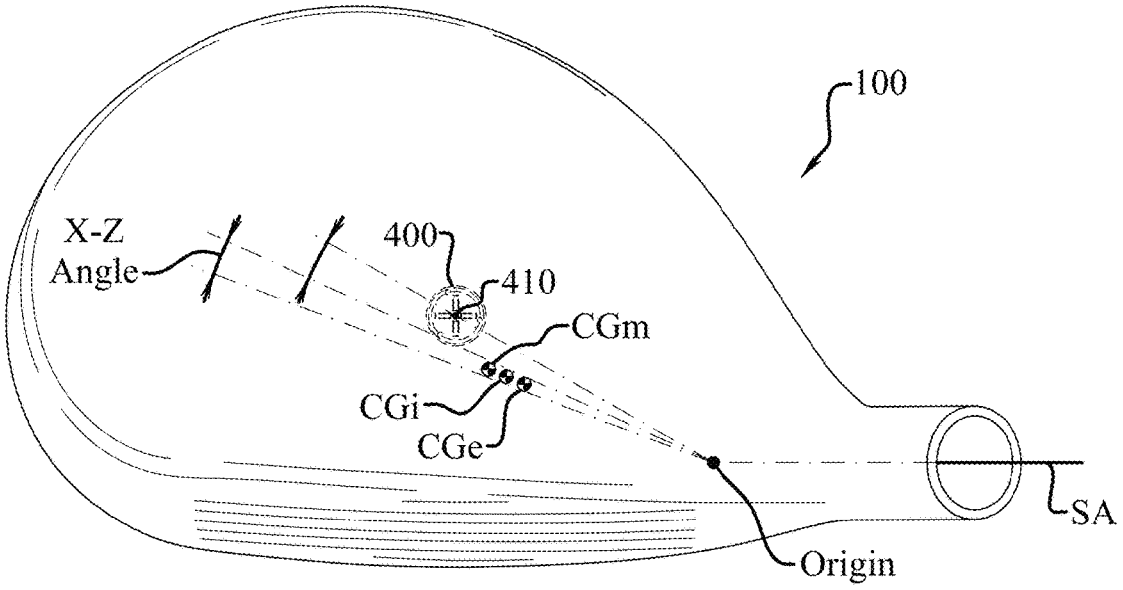
FIG. 44 is a top plan view of an embodiment of a curved face adjustable golf club head, not to scale.

In addition to the relationship between the X, Y, and Z coordinates of the intermediate length center of gravity (CGi) and the minor length center of gravity (CGm), the center of gravity location for each configuration may be confined to an angle range. The angle range may be measured in an X-Z plane from the origin, representing an X-Z angle, as well as in an X-Y plane from the origin, representing an X-Y angle. For example, in one embodiment, both the intermediate length center of gravity (CGi) and the minor length center of gravity (CGm) are located between an X-Z angle of 26 degrees to 30 degrees, as may be appreciated in FIGS. 26 and 44. In another embodiment, both the intermediate length center of gravity (CGi) and the minor length center of gravity (CGm) are located between an X-Y angle of 45 degrees to 60 degrees, as may be understood with reference to FIG. 27.

The insubstantial change of the golf club's characteristics between the minor length configuration and the intermediate length configuration is the result of carefully balancing the weight of each configuration and the location of the weight system (400, 700) of each configuration. For example, in one embodiment, the weight of the intermediate length weight system (700) is at least 60 percent less than the weight of the minor length weight system (400), and the combined weight of the first spacer (500) and the first hosel sleeve (600) is at least 50 percent less than the weight of the minor length weight system (400). Thus, as some weight is added toward the heel portion (110) to obtain the intermediate length configuration, less weight is added toward the toe portion (120) in the form of the intermediate length weight system (700). This careful balancing results in similar golf club characteristics when utilizing the length adjustment system to transition back and forth from a minor length configuration to an intermediate length configuration.

As previously mentioned, along with the weight of each configuration, the location of the weight system (400, 700) must be considered when moving between the minor length configuration and the intermediate length configuration so that the golf club's characteristics do not substantially change. For example, in one embodiment, a center (410) of the minor length weight system (400) in an X-Z plane and a center (710) of the intermediate length weight system (700) in the X-Z plane are both located within 20 degrees of the X-Z angle, i.e., the X-Z angle of 26 degrees to 30 degrees discussed above, as seen in FIG. 26. In another embodiment, the intermediate length weight system offset distance (720), previously described as the linear distance from the center (710) of the intermediate length weight system (700) to the origin measured in an X-Z plane, is four to six times the first spacer length (504). These particular embodiments ensure that the golf club's characteristics do not substantially change between the minor and intermediate length configurations by striking a delicate balance between the weight of each configuration and the particular location of the weight systems (400, 700). As a result, the golf club in each length configuration will have a consistent feel and level of playability.

Another unique relationship has been discovered between the location of the weight systems (400, 700) and the location of the intermediate length center of gravity (CGi). As previously described, a center (410) of the minor length weight system (400) in an X-Z plane is a distance Xml and a distance Zml from the origin. Similarly, a center (710) of the intermediate length weight system (700) the X-Z plane is a distance Xil and a distance Zil from the origin. In one embodiment, the distance Xml and the distance Xil are within a range of 1.2 to 3.5 times the X coordinate of the intermediate length center of gravity (CGi), and the distance Zml and the distance Zil are within a range of 1.7 to 7.5 times the Z coordinate of the intermediate length center of gravity (CGi). Still further, in another embodiment, the distance Xml and the distance Xil are within a range of 2.2 to 2.8 times the X coordinate of the intermediate length center of gravity (CGi), and the distance Zml and the distance Zil are within a range of 2.3 to 6.0 times the Z coordinate of the intermediate length center of gravity (CGi). Such relationships ensure that the length adjustment system may be used move between a minor length of a golf club and an intermediate length of a golf club without substantially changing the golf club's characteristics and providing a consistent feel.

Referring now to FIGS. 18-25, embodiments of various components of the length adjustment system for joining a golf club head (100) to a shaft (1100) to produce an extended length configuration are shown. Just as with the minor and intermediate length configurations, the extended length configuration features the shaft sleeve (200) attached to the end of the shaft (1100). However, to produce the extended length configuration additional, or alternative, components of the length adjustment system are required.

Figure 18:
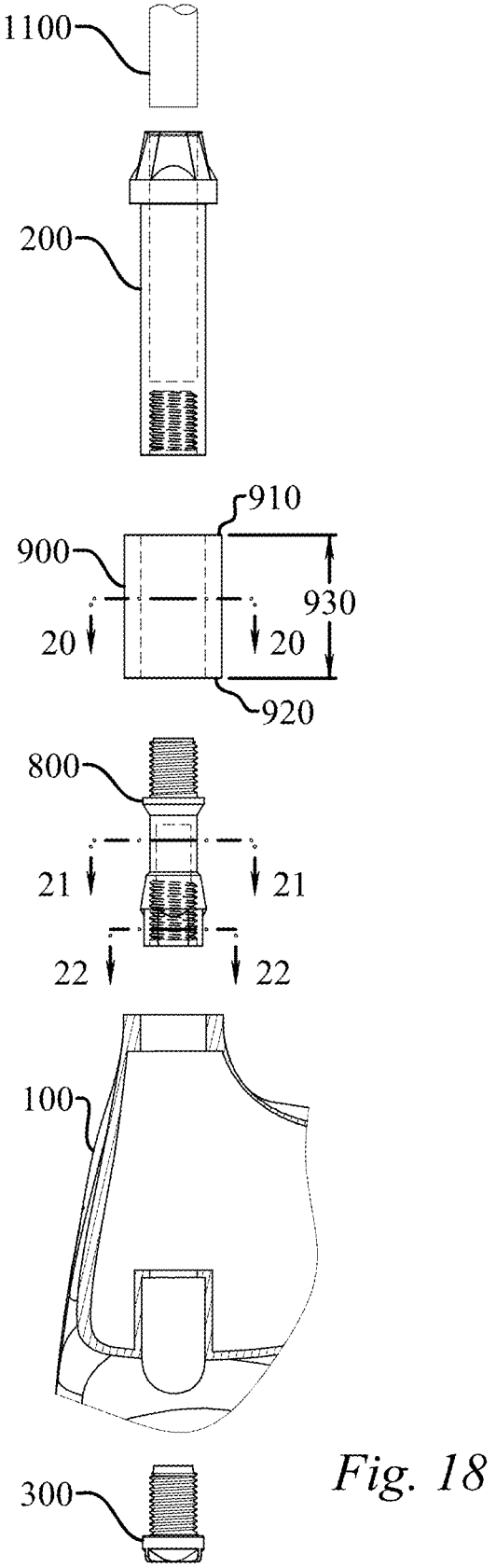
FIG. 18 is an exploded cross-sectional view of an embodiment of a length adjustment system for joining a golf club head to a shaft in an extended length configuration, not to scale.
Figure 19:
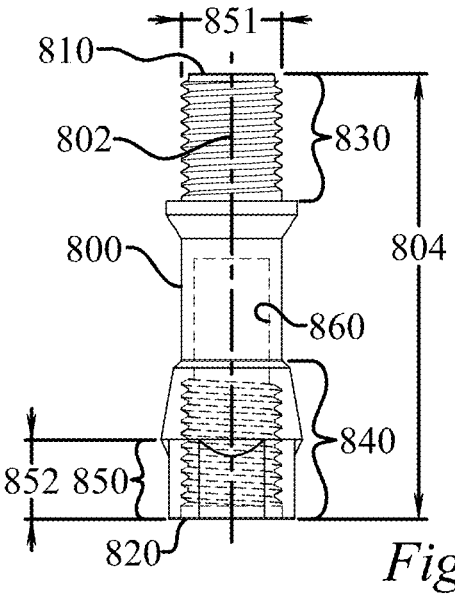
FIG. 19 is an elevation view of an embodiment of a second spacer, not to scale.

As seen in FIG. 18, the length adjustment system to produce an extended length configuration includes a second spacer (800), or an even further extended retainer (300), and a second hosel sleeve (900). In spacer based embodiments, the second spacer (800) includes a second spacer axis (802) and a second spacer length (804) that separates a second spacer distal end (810) from a second spacer proximal end (820), as seen in FIG. 19. Further, the second spacer (800) includes a second spacer-to-sleeve connection portion (830), which may have a second spacer-to-sleeve connector diameter (831), also seen in FIG. 19. The second spacer (800) further includes a second spacer retainer portion (840) and a second spacer gripping portion (850) having a second spacer gripping portion length (852) and a second spacer gripping portion perimeter (854), seen only in FIG. 22. Additionally, the second spacer (800) may include a second spacer weight control chamber (860), as seen in FIG. 19. The second spacer weight control chamber (860) may be left void, or additional weight may be added, so that desired golf club characteristics may be achieved. Generally, the second spacer (800) is configured to have a weight 2.5 grams and 5 grams. By way of example only and not limitation, the second spacer (800) may be formed of aluminum, steel, titanium, plastic, and combinations thereof, just to name a few materials. However, those with skill in the art will recognize that other materials may be used.

Figure 20:
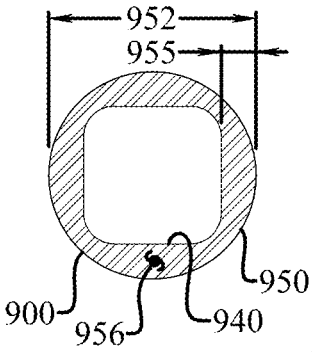
FIG. 20 is a cross-sectional view of an embodiment of a second hosel sleeve taken along section line 20-20 in FIG. 18, not to scale.
Figure 21:
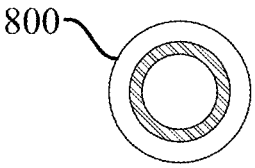
FIG. 21 is a cross-sectional view of an embodiment of a second spacer taken along section line 21-21 in FIG. 18, not to scale.
Figure 22:
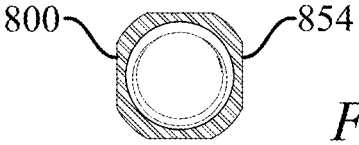
FIG. 22 is a cross-sectional view of an embodiment of a second spacer taken along section line 21-21 in FIG. 18, not to scale.

With reference now to FIGS. 18 and 20, an embodiment of the second hosel sleeve (900) is shown. The second hosel sleeve (900) includes a second hosel sleeve distal end (910) that is separated from a second hosel sleeve proximal end (920) by a second hosel sleeve length (930). As seen in FIG. 20, the second hosel sleeve (900) also includes a second hosel sleeve interior cross-sectional perimeter (940) and a second hosel sleeve exterior cross-sectional perimeter (950). Additionally, the second hosel sleeve (900) has a second hosel sleeve exterior diameter (952), a second hosel sleeve ledge width (955), and a second hosel sleeve ledge surface area (956). As with the first hosel sleeve (600), the second hosel sleeve (900) may be formed of aluminum, steel, titanium, plastic, and combinations thereof, just to name a few materials. However, those with skill in the art will recognize that other suitable materials may be utilized. The second hosel sleeve (900) preferably has a weight between 5.5 grams and 8.5 grams. In addition to contributing to the length of the golf club, the second hosel sleeve (900) beneficially stabilizes the shaft sleeve (200) between the shaft sleeve ledge (254) and the hosel ledge (140) and prevents the shaft sleeve (200) from rocking, while providing a look consistent with the minor length configuration and the intermediate length configuration.

Figure 23:
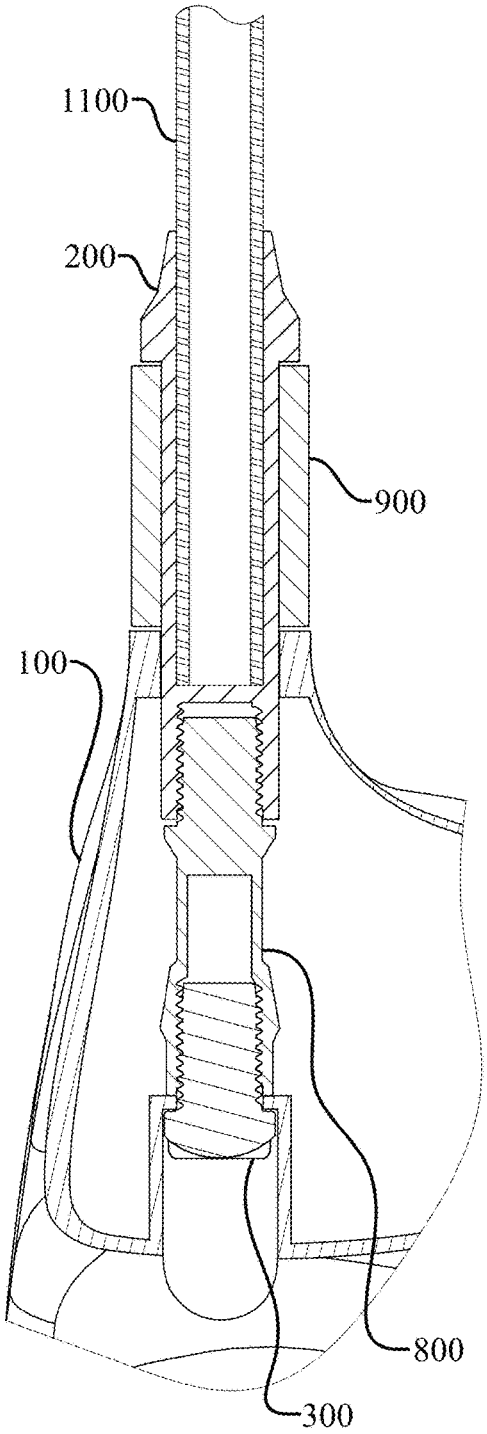
FIG. 23 is a cross-sectional view of an embodiment of a length adjustment system for joining a golf club head to a shaft in an extended length configuration, not to scale.

An assembled view of the components a spacer based embodiment of the length adjustment system to produce an extended length configuration is shown in FIG. 23. As previously mentioned, the length adjustment system for producing an extended length configuration includes the same shaft sleeve (200) and shaft (1100) combination described with respect to the minor length and intermediate length configurations. As a result, the shaft sleeve (200) will remain capable of cooperating with the hosel (120) of the golf club head (100). While the non-spacer embodiments of the extended length configuration are not independently illustrated, one skilled in the art will appreciate that second spacer (800) of FIG. 18 is eliminated, while an even longer retainer (300) is provided in the extended length configuration to account for the introduction of the second hosel sleeve (900) and the second hosel sleeve length (930), which keeps the shaft sleeve proximal end (220) separated from the hosel bore proximal end (134).

In assembling the components of the length adjustment system to produce an extended length configuration, the first step may include securing the second spacer (800) to the shaft sleeve (200). As seen in FIG. 18, the second spacer (800) includes a second spacer-to-sleeve connector portion (830) that may comprise an externally threaded male connector that is configured to cooperate with the internal threads of the shaft sleeve retainer (240), or vice versa, to provide a secure connection. Moreover, the second spacer (800) is configured for reception within the hosel (120) by having a second spacer gripping portion perimeter (854) that is capable passing through the hosel bore cross-sectional perimeter (138).

The next step in the assembly process may include inserting the combined second spacer (800) and shaft sleeve (200) through the second hosel sleeve (900), while in the non-spacer embodiment just the shaft sleeve (200) is inserted through the second hosel sleeve (900). As seen in FIG. 20, the second hosel sleeve (900) has a second hosel sleeve interior cross-sectional perimeter (940) that is configured to receive the shaft sleeve (200) and second spacer (800). In spacer embodiments, after the second spacer (800) and shaft sleeve (200) are inserted through the second hosel sleeve (900), the next step is to insert the second spacer (800) and shaft sleeve (200) into the hosel (120) so that the second hosel sleeve (900) is adjacent to the hosel (120), as seen in FIG. 23; while the non-spacer embodiments after the shaft sleeve (200) is inserted through the second hosel sleeve (900) it is inserted into the hosel so that the second hosel sleeve (900) is adjacent to the hosel (120) thereby keeping the shaft sleeve proximal end (220) separated from the hosel bore proximal end (134) by a distance equal to the second hosel sleeve length (930). The final step in the assembly process includes passing the retainer (300) through the auxiliary hosel access (150) to cooperate with the second spacer retainer portion (840) to releasably secure the shaft (1100) to the golf club head (100), in spacer embodiments, while non-spacer embodiments pass a further extended retainer (300) through the auxiliary hosel access (150) to cooperate with the shaft sleeve (200) to releasably secure the shaft (1100) to the golf club head (100). In one embodiment the retainer (300) is coaxial with the shaft sleeve (200) and the retainer (300) imparts a tensile load on the shaft sleeve (200), which imparts a compressive load on the second hosel sleeve (900) and forcing it to securely seat against the hosel ledge (140). As seen in FIGS. 19 and 23, the second spacer retainer portion (840) may include a bore having internal threads that are configured to cooperate with the external threads of the retainer (300) to provide a secure connection.

In the extended length configuration, as seen in FIG. 23, various components are releasably secured to the golf club head (100) by the retainer (300) to produce an extended length of a golf club. In one embodiment, the extended length of the golf club is at least ¼ inch greater than the intermediate length of the golf club. This embodiment enables a golf club to transition between a minor length, an intermediate length, and an extended length, resulting in a golf club that may be increased in length by a total of at least ½ inch. Some golfers may prefer this particular amount of increase in length because it would be less noticeable at address and when swinging the golf club. In another embodiment, the extended length of the golf club is at least ½ inch greater than the intermediate length of the golf club, and the intermediate length of the golf club is at least ½ inch greater than the minor length of the golf club. In this embodiment, the length adjustment system may be used to increase the length of the golf club by at least 1 inch. Such an embodiment would provide a more noticeable increase in golf club length, and may be preferred by golfers who are seeking to maximize their distance or fine tune their gapping within a set of golf clubs.

Figure 24:
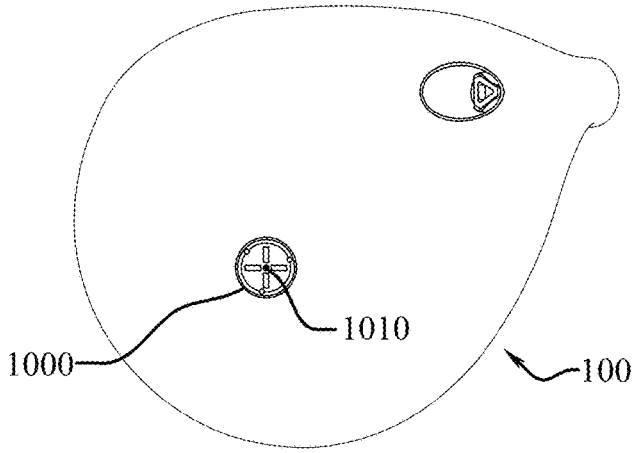
FIG. 24 is a bottom plan view of an embodiment of a golf club head, not to scale.
Figure 25:
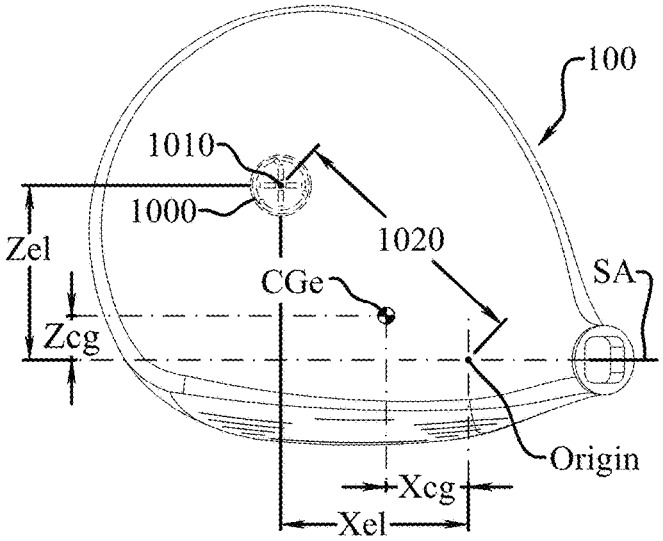
FIG. 25 is a top plan view of an embodiment of a golf club head, not to scale.

The length adjustment system in the extended length configuration also has an extended length weight. In the spacer embodiment the extended length weight comprises the combined weight of the golf club head (100), the shaft sleeve (200), the second spacer (800), the second hosel sleeve (900), the retainer (300), and an extended length weight system (1000), which is shown in FIGS. 24 and 25. Whereas in the extended retainer based embodiment, the extended length weight comprises the combined weight of the golf club head (100), the shaft sleeve (200), the second hosel sleeve (900), the further extended length retainer (300), and an extended length weight system (1000). As with the minor length and intermediate length weight systems (400, 700), the extended length weight system (1000) may comprise a weight nut that is configured to cooperate with a weight port on the sole (104) of the golf club head (100), as well as the other embodiments previously described with respect to the minor length weight system (400). The extended length weight system (1000) preferably weigh between 1 gram and 3.5 grams. As seen in FIGS. 24, 25, 42, and 43, the extended length weight system (1000) has an extended length weight system center (1010) and an extended length weight system offset distance (1020). The location of the extended length weight system center (1010) in an X-Z plane is a distance Xel and a distance Zel from the origin, as seen in FIG. 25. The extended length weight system offset distance (1020), seen in FIG. 25, is the linear distance from the origin to the extended length weight system center (1010) measured in the X-Z plane. When in the extended length configuration, the extended length weight produces an extended length center of gravity (CGe) and an extended length moment of inertia. As seen in FIG. 25, the extended length center of gravity (CGe) has an X coordinate, represented by the distance Xcg from the origin, and a Z coordinate, represented by the distance Zcg from the origin. Additionally, the extended length center of gravity (CGe) has a Y coordinate (not shown), which corresponds to the vertical distance above the origin that the extended length center of gravity (CGe) is located.

While this particular embodiment of the length adjustment system permits a golf club to be easily transitioned between a minor length configuration, an intermediate length configuration, and an extended length configuration, it does so in such a way that the characteristics of the golf club do not substantially change between each configuration. For example, in this embodiment, the extended length weight is within 5 percent of the minor length weight. Thus, assuming a minor length weight of 200 grams, the extended length weight may be within a range of 190 grams to 210 grams. Still further, the extended length moment of inertia is within 15 percent of the minor length moment of inertia. For instance, assuming a minor length moment of inertia of 4000 $g*cm^2$, the extended length moment of inertia may be within a range of 3400 $g*cm^2$ to 4600 $g*cm^2$. Moreover, in this embodiment, the X, Y, and Z coordinates of the extended length center of gravity (CGe) are all within 15 percent of the X, Y, and Z coordinates of the intermediate length center of gravity (CGi). Assuming, for the simplicity of an example, that the intermediate length center of gravity (CGi) has an X coordinate of 1.0, a Y coordinate of 1.0, and a Z coordinate of 1.0, the extended length center of gravity (CGe) may have an X coordinate within a range of 0.85 to 1.15, a Y coordinate within a range of 0.85 to 1.15, and a Z coordinate within a range of 0.85 to 1.15. Thus, when changing between the minor length configuration, the intermediate length configuration, and the extended length configuration, the characteristics of the golf club do not substantially change, which results in the golf club having a consistent feel in each configuration.

In a further embodiment, the length adjustment system exhibits even more consistent golf club characteristics between each of the minor length, intermediate length, and extended length configurations. For example, in one embodiment, the intermediate length weight and the extended length weight are each within 2.5 percent of the minor length weight. Thus, assuming a minor length weight of 200 grams, the intermediate length weight and the extended length weight may each be within a range of 195 grams to 205 grams. Moreover, this particular length adjustment system provides an intermediate length moment of inertia that is within 5 percent of the minor length moment of inertia, and an extended length moment of inertia that is within 10 percent of the minor length moment of inertia. For instance, assuming a minor length moment of inertia of 4000 g*cm, the intermediate length moment of inertia may be within a range of 3800 g*cm$^2$ to 4200 g*cm$^2$, and the extended length moment of inertia may be within a range of 3600 g*cm$^2$ to 4400 g*cm$^2$. Still further, in this embodiment of the length adjustment system, the X, Y, and Z coordinates of the extended length center of gravity (CGe) are all within 8 percent of the X, Y, and Z coordinates of the intermediate length center of gravity (CGi). Again for the simplicity of an example, assume the intermediate length center of gravity (CGi) has an X coordinate of 1.0, a Y coordinate of 1.0, and a Z coordinate of 1.0, the extended length center of gravity (CGe) may have an X coordinate within a range of 0.92 to 1.08, a Y coordinate within a range of 0.92 to 1.08, and a Z coordinate within a range of 0.92 to 1.08. As a result, in this particular embodiment, the characteristics of the golf club are changed even less when switching between the minor length configuration, the intermediate length configuration, and the extended length configuration, which results in the golf club having a more consistent feel in each configuration.

As previously mentioned, the X, Y, and Z coordinates of the extended length center of gravity (CGe) are all within at least 15 percent of the X, Y, and Z coordinates of the intermediate length center of gravity (CGi). Moreover, it has been observed that the length adjustment system results in additional unique relationships between the extended length center of gravity (CGe) and the intermediate length center of gravity (CGi). For example, in one particular embodiment, the X coordinate of the extended length center of gravity (CGe) is less than the X coordinate of the intermediate length center of gravity (CGi). Thus, in this embodiment, the center of gravity of the golf club head (100) is moved closer to the heel portion (110) when increasing the length from an intermediate length to an extended length, which provides the golf club head (100) with a slight draw bias compared to the shorter length configuration. This may be desirable for golfers who tend to slice golf shots when using a longer golf club. In another embodiment, the Y coordinate of the extended length center of gravity (CGe) is greater than the Y coordinate of the intermediate length center of gravity (CGi). In this embodiment, the center of gravity of the golf club head (100) would be positioned higher on the face (102) when increasing the length from an intermediate length to an extended length. Such an embodiment may be desirable for those golfers who seek maximum distance, as well as improved shot control.

Figure 26:
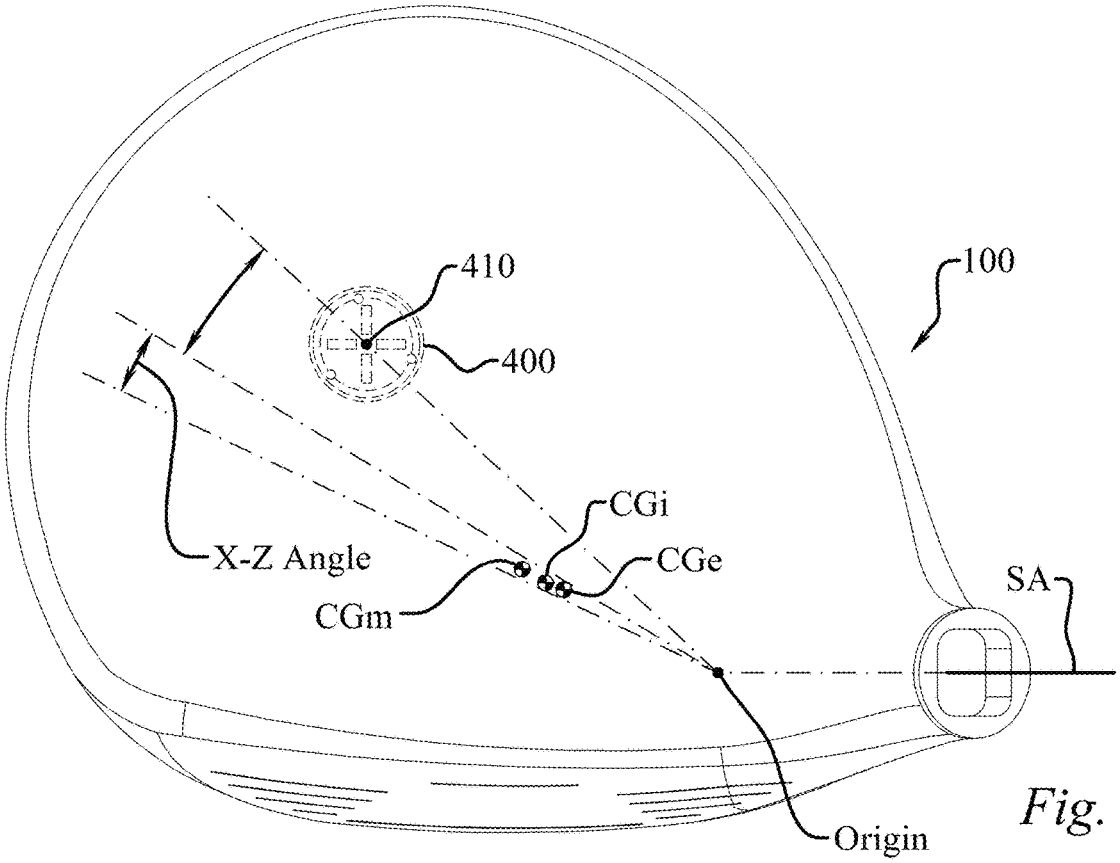
FIG. 26 is a top plan view of an embodiment of a golf club head, not to scale.
Figure 27:
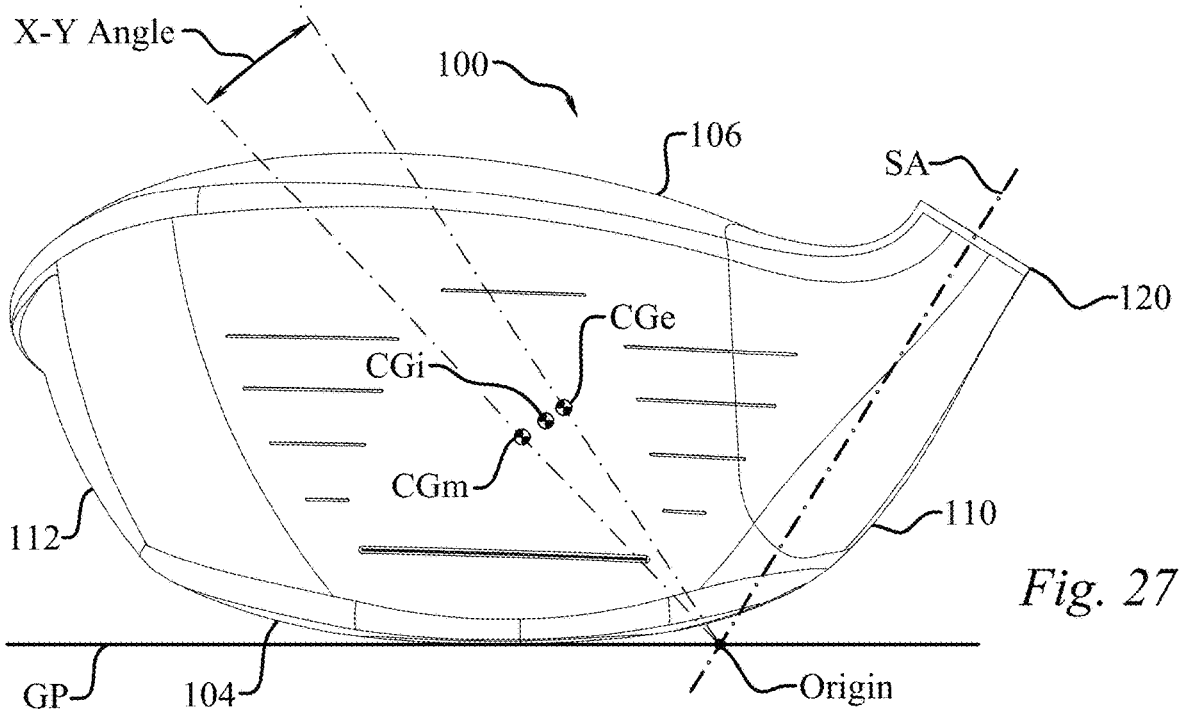
FIG. 27 is a front elevation view of an embodiment of a golf club head, not to scale.

In addition to the relationship between the X, Y, and Z coordinates of the extended length center of gravity (CGe) and the intermediate length center of gravity (CGi), and the relationship between the X, Y, and Z coordinates of the intermediate length center of gravity (CGi) and the minor length center of gravity (CGm), the center of gravity location for each configuration may be confined to an angle range. The angle range may be measured in an X-Z plane from the origin, representing an X-Z angle, as well as in an X-Y plane from the origin, representing an X-Y angle. For example, in one embodiment of the length adjustment system, the minor length center of gravity (CGm), the intermediate length center of gravity (CGi), and the extended length center of gravity (CGe) are all located between an X-Z angle of 26 degrees to 30 degrees, as seen in FIG. 26. In another embodiment of the length adjustment system, the minor length center of gravity (CGm), the intermediate length center of gravity (CGi), and the extended length center of gravity (CGe) are all located between an X-Y angle of 45 degrees to 60 degrees, as seen in FIG. 27.

As previously noted with respect to a previous embodiment of the length adjustment system, the insubstantial change of the golf club's characteristics between each configuration is the result of carefully balancing the weight of each configuration and the location of the weight system (400, 700, 1000) of each configuration, as well as the changing lengths and attributes of the first spacer (500) or extended retainer (300), first hosel sleeve (600), second spacer (800) or further extended retainer (300), and second hosel sleeve (900). For example, in one embodiment, the weight of the extended length weight system (1000) is at least 80 percent less than the weight of the minor length weight system (400), and the combined weight of the second spacer (800) and the second hosel sleeve (900) is at least 50 percent less than the weight of the minor length system (400). Thus, as some weight is added toward the heel portion (110) from the addition of the second spacer (800) and the second hosel sleeve (900) to obtain the extended length configuration, less weight is added toward the toe portion (120) in the form of the extended length weight system (1000). This careful balancing results in similar golf club characteristics when utilizing the length adjustment system to transition between each of the length configurations.

As noted with respect to a previously discussed embodiment of the length adjustment system, the location of the weight system (400, 700, 1000) must be considered when moving between the minor length configuration, the intermediate length configuration, and the extended length configuration so that the golf club's characteristics do not substantially change. For example, in one embodiment, a center (410) of the minor length weight system (400) in an X-Z plane, a center (710) of the intermediate length weight system (700) in the X-Z plane, and a center (1010) of the extended length weight system (1000) are all located within 20 degrees of the X-Z angle, i.e., an X-Z angle of 26 degrees to 30 degrees discussed above, as seen in FIG. 26. In another embodiment, the intermediate length weight system offset distance (720), previously described as the linear distance from the center (710) of the intermediate length weight system (700) to the origin measured in an X-Z plane, is at least 1.5 times the first hosel sleeve length (630), and in some embodiments at least 2 times the first hosel sleeve length (630), and preferably less than 4 times the first hosel sleeve length (630) in the case of club heads having a volume of less than 200 cc. In yet another embodiment, the extended length weight system offset distance (1020), previously described as the linear distance from the center (1010) of the extended length weight system (1000) to the origin measured in an X-Z plane, is at least 1.0 the second hosel sleeve length (930), and in some embodiments at least 1.5 times the second hosel sleeve length (930), and preferably less than 4 times the second hosel sleeve length (930) in the case of club heads having a volume of less than 200 cc. These particular embodiments ensure that the golf club's characteristics do not substantially change when switching between each configuration by striking a delicate balance between the weight of each configuration and the particular location of the weight systems (400, 700, 1000). As a result, the golf club in each length configuration will have a consistent feel and level of playability.

As noted above, a unique relationship has been discovered between the location of the weight systems (400, 700) and the location of the intermediate length center of gravity (CGi). This relationship is also applicable to the embodiment of the length adjustment system that is capable of producing a minor length, an intermediate length, and an extended length of a golf club. As previously described, a center (410) of the minor length weight system (400) in an X-Z plane is a distance Xml and a distance Zml from the origin, and a center (710) of the intermediate length weight system (700) the X-Z plane is a distance Xil and a distance Zil from the origin. Similarly, a center (1010) of the extended length weight system (1000) in the X-Z plane is a distance Xel and a distance Zel from the origin. In one embodiment of the length adjustment system, the distance Xml, the distance Xil, and the distance Xel are within a range of 1.2 to 3.5 times the X coordinate of the intermediate length center of gravity (CGi), and the distance Zml, the distance Zil, and the distance Zel are within a range of 1.7 to 7.5 times the Z coordinate of the intermediate length center of gravity (CGi). Still further, in another embodiment, the distance Xml, the distance Xil, and the distance Xel are within a range of 2.2 to 2.8 times the X coordinate of the intermediate length center of gravity (CGi), and the distance Zml, the distance Zil, and the distance Zel are within a range of 2.3 to 6.0 times the Z coordinate of the intermediate length center of gravity (CGi). Such relationships ensure that the length adjustment system may be used move between each length configuration without substantially changing the golf club's characteristics, which provides a consistent feel among each length configuration.

As can be appreciated from the foregoing, in one embodiment, the length adjustment system may be used to produce a golf club having a minor length and an intermediate length. In this particular embodiment, the length adjustment system includes a number of components, including: a shaft sleeve (200) attached to the end of a golf shaft (1100), a minor length weight system (400), a first spacer (500) or first extended length retainer, a first hosel sleeve (600), an intermediate length weight system (700), and a retainer (300) for securing the shaft (1100) to the golf club head (100). In another embodiment, the length adjustment system may be used to produce a golf club having a minor length, an intermediate length, and an extended length. In this embodiment, the length adjustment system includes the same components for producing the minor length and the intermediate length along with the following additional components: a second spacer (800) or second extended length retainer, a second hosel sleeve (900), and an extended length weight system (1000).

As previously mentioned, an important aspect contributing to the insubstantial change of the golf club's characteristics between each configuration is the careful balancing of the weight of each configuration. Consider the following example of the length adjustment system that may be used to produce a golf club having a minor length, an intermediate length, and an extended length. In this particular embodiment, the golf club head (100) has a weight of 175 grams, the shaft sleeve (200) weighs 12.7 grams, and the retainer (300) weighs 3.3 grams.

In another embodiment, namely the minor length configuration, the minor length weight system (400) weighs 16 grams, which when combined with the golf club head (100), the shaft sleeve (200), and the retainer (300) produces a minor length weight of 207 grams. The minor length golf club has a minor length center of gravity (CGm) with an X coordinate of 1.032", a Y coordinate of 1.137", and a Z coordinate of 0.548", and a minor length moment of inertia of 4129 g*cm$^2$.

In the intermediate length configuration, the length adjustment system further includes a first spacer (500), or first extended length retainer, having an additional weight of 2.7 grams and a first hosel sleeve (600) having a weight of 3.9 grams. For the intermediate length configuration, the minor length weight system (400) is removed and replaced with an intermediate length weight system (700), which has a weight of 6 grams. Thus, in the intermediate length configuration, the combination of the golf club head (100), the shaft sleeve (200), the retainer (300), the first spacer (500) or first extended length retainer, the first hosel sleeve (600), and the intermediate length weight system (700) produces an intermediate length weight of 203.6 grams. In the intermediate configuration, the intermediate length golf club has an intermediate length center of gravity (CGi) having an X coordinate of 0.908", a Y coordinate of 1.226", and a Z coordinate of 0.473", and an intermediate length moment of inertia of 4293 g*cm$^2$. In this example, the intermediate length is ½ inch greater than the minor length.

In the extended length configuration, the first spacer (500), or first extended length retainer, and the first hosel sleeve (600) are removed and replaced with a second spacer (800), or a second extended length retainer, having a weight of 3.9 grams, or an additional weight of 3.9 grams over the standard retainer in the case of a second extended length retainer, and a second hosel sleeve (900) having a weight of 7.7 grams. Moreover, in the extended length configuration, the intermediate length weight system (700) is removed and replaced with an extended length weight system (1000) having a weight of 2 grams. Thus, in the extended length configuration, the combination of the golf club head (100), the shaft sleeve (200), the retainer (300), the second spacer (800) or second extended length retainer, the second hosel sleeve (900), and the extended length weight system (1000) produces an extended length weight of 204.6 grams. The extended length golf club has an extended length center of gravity (CGe) having an X coordinate of 0.813", a Y coordinate of 1.303", and a Z coordinate of 0.437", and an intermediate length moment of inertia of 4537 g*cm$^2$. In this example, the extended length is ½ inch greater than the intermediate length, and 1 inch greater than the minor length.

As may be appreciated from this example, careful balancing of the weight of each configuration leads to a golf club having substantially similar characteristics in each configuration. Thus, the length adjustment system may be used to easily increase the length of the golf club without substantially changing the golf club characteristics, which results in a consistent feel among each golf club length configuration.

Figure 6:
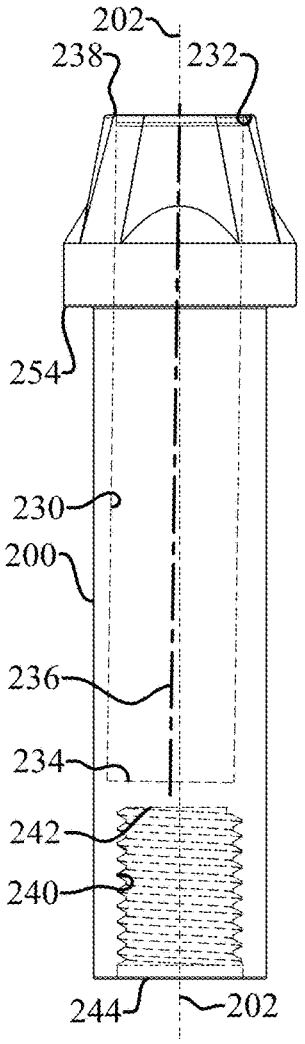
FIG. 6 is an elevation view of an embodiment of a shaft sleeve, not to scale.

In a particular embodiment, seen in FIG. 6, the length adjustment system may include a shaft sleeve (200) having a receiving bore axis (236) that is not aligned with the shaft sleeve axis (202). Preferably, the receiving bore axis (236) is offset from the shaft sleeve axis (202) by about 1 degree to about 5 degrees. As a result, when the shaft sleeve (200) and shaft (1100) combination are inserted into the hosel (120) at different orientations, the loft, lie, and face angle of the golf club may be adjusted. In one embodiment the shaft sleeve (200) may be that disclosed in commonly owned pending application Ser. No. 14/074,481, incorporated by reference in the entirety.

Figure 46:
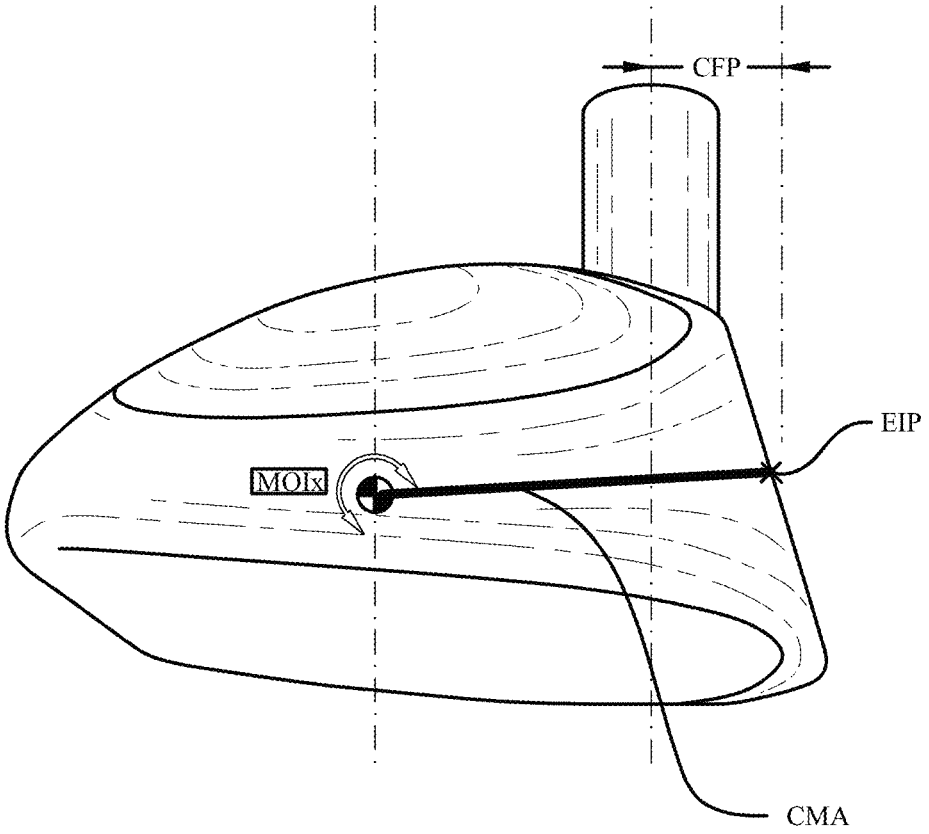
FIG. 46 is a side elevation view of an embodiment of a curved face adjustable golf club head, not to scale.
Figure 47:
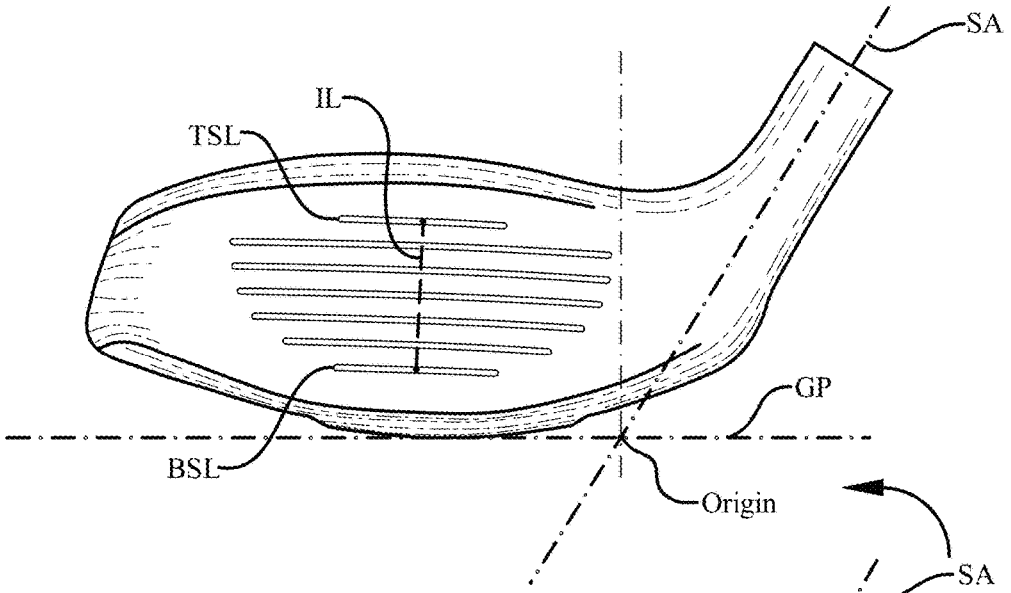
FIG. 47 is a front elevation view of an embodiment of a curved face adjustable golf club head, not to scale.
Figure 48:
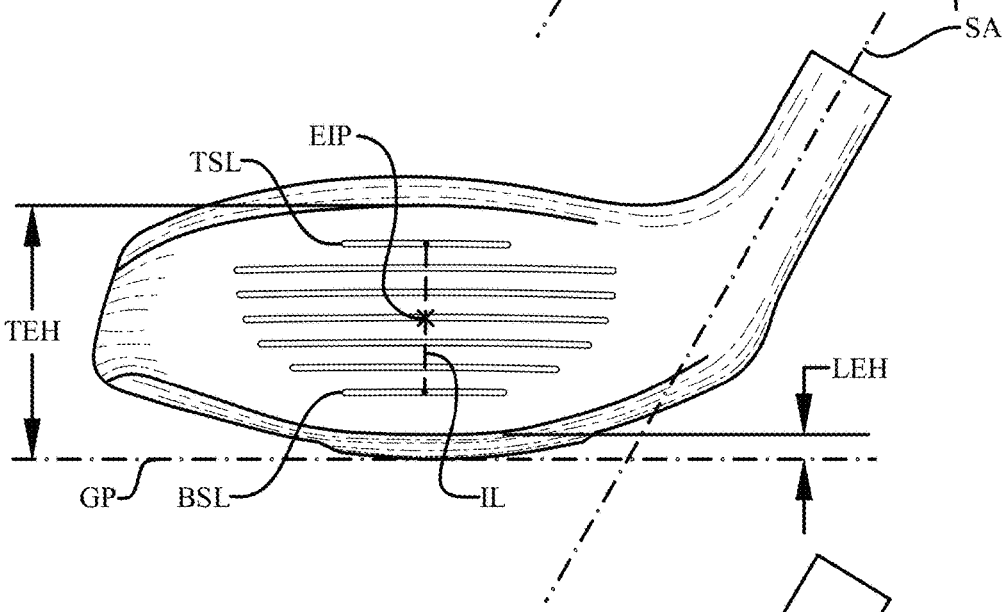
FIG. 48 is a front elevation view of an embodiment of a curved face adjustable golf club head, not to scale.
Figure 49:
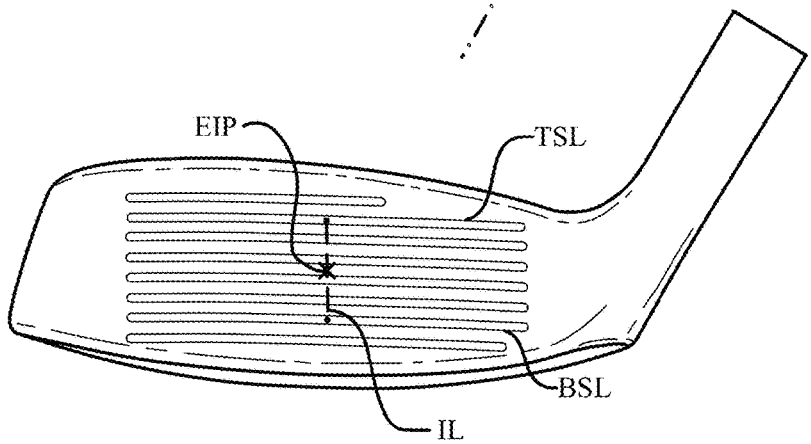
FIG. 49 is a front elevation view of an embodiment of a curved face adjustable golf club head, not to scale.
Figure 50:
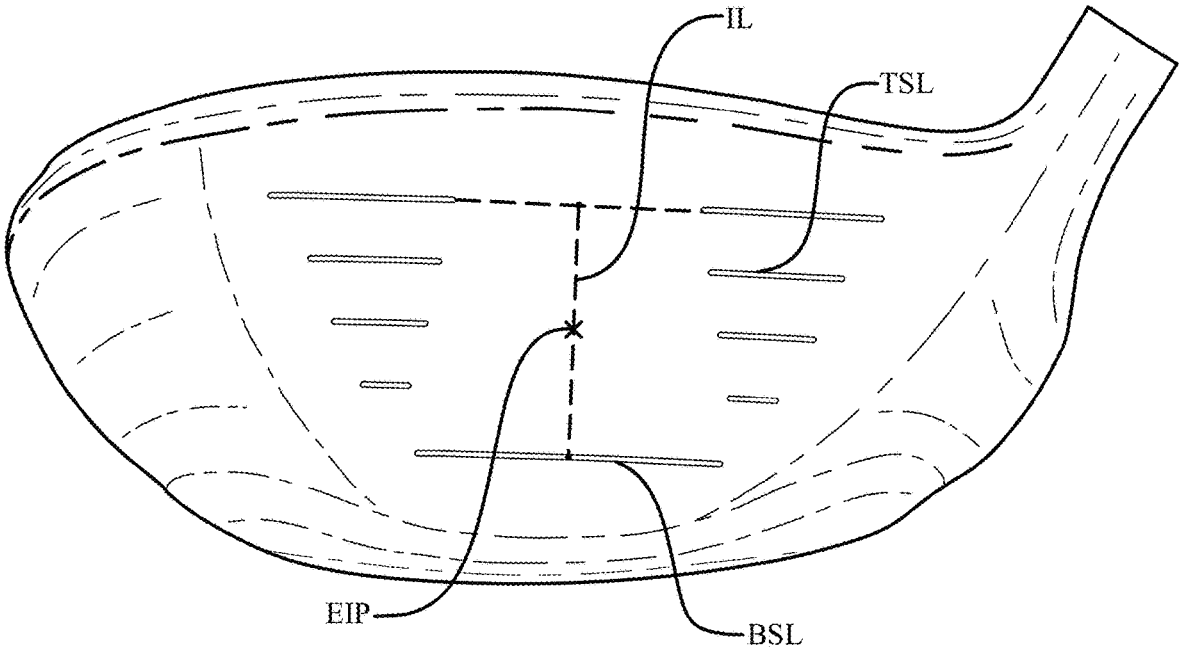
FIG. 50 is a front elevation view of an embodiment of a curved face adjustable golf club head, not to scale.
Figure 51:
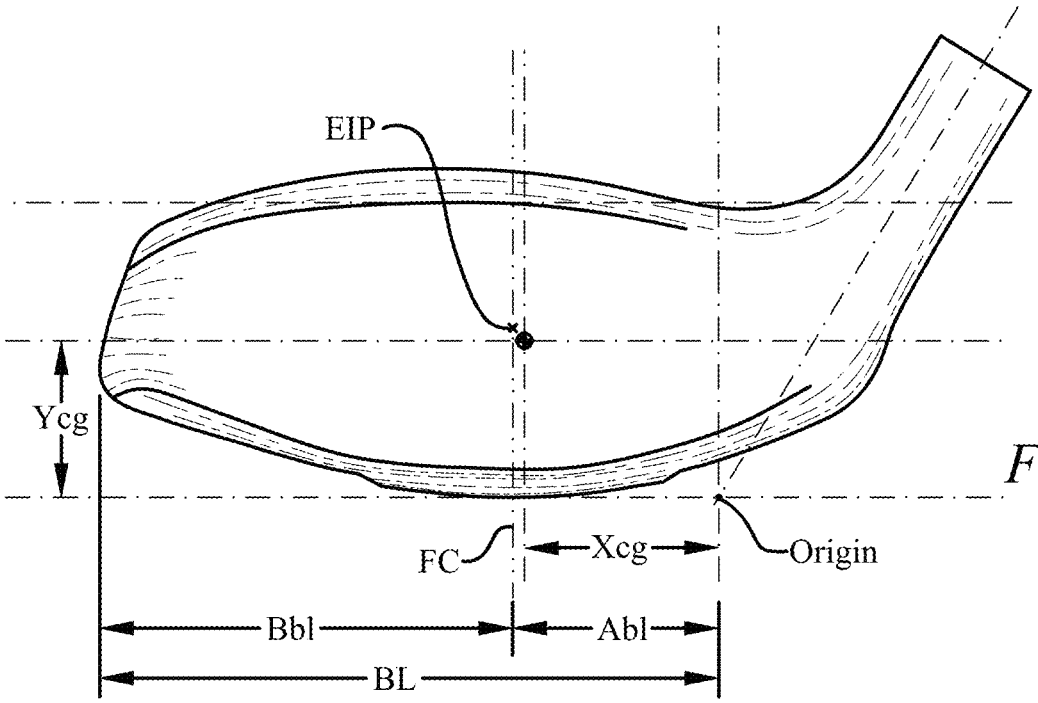
FIG. 51 is a front elevation view of an embodiment of a curved face adjustable golf club head, not to scale.
Figure 52:
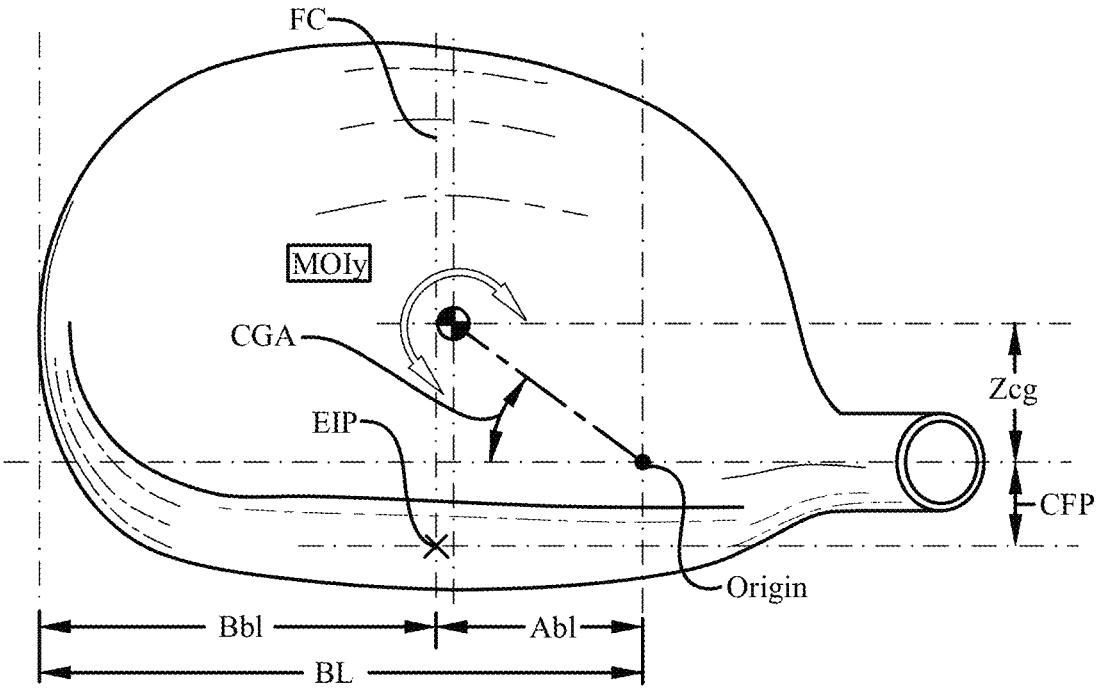
FIG. 52 is a top plan view of an embodiment of a curved face adjustable golf club head, not to scale.
Figure 53:
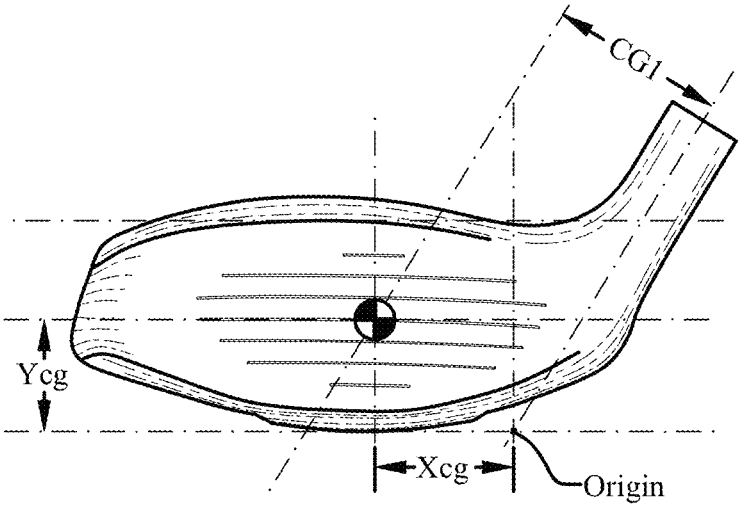
FIG. 53 is a front elevation view of an embodiment of a curved face adjustable golf club head, not to scale.
Figure 54:
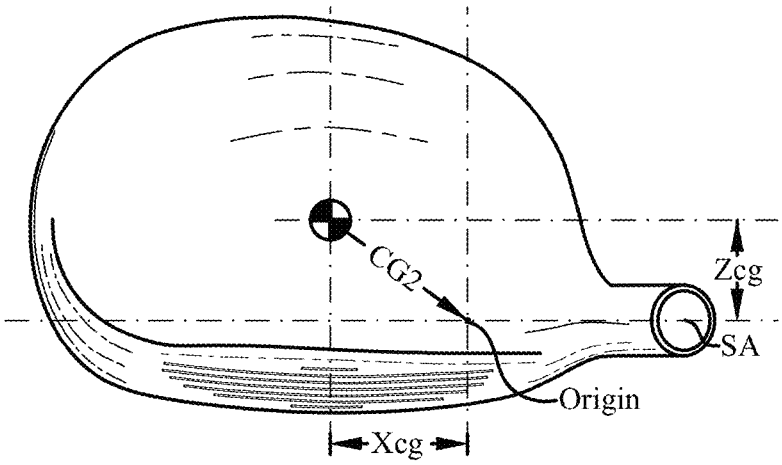
FIG. 54 is a top plan view of an embodiment of a curved face adjustable golf club head, not to scale.

A key location on a face of a golf club head is an engineered impact point (EIP), as seen in FIGS. 46-52. The engineered impact point (EIP) is important in that is helps define several other key attributes of the present invention. The engineered impact point (EIP) is generally thought of as the point on the face that is the ideal point at which to strike the golf ball. The score lines on golf club heads enable one to easily identify the engineered impact point (EIP) for any golf club. In the embodiment of FIG. 47, the first step in identifying the engineered impact point (EIP) is to identify the top score line (TSL) and the bottom score line (BSL). Next, draw an imaginary line (IL) from the midpoint of the top score line (TSL) to the midpoint of the bottom score line (BSL). This imaginary line (IL) will often not be vertical since many score line designs are angled upward toward the toe when the club is in the natural position. Next, as seen in FIG. 48, the club must be rotated so that the top score line (TSL) and the bottom score line (BSL) are parallel with the ground plane (GP), which also means that the imaginary line (IL) will now be vertical. In this position, the leading edge height (LEH) and the top edge height (TEH) are measured from the ground plane (GP). Next, the face height is determined by subtracting the leading edge height (LEH) from the top edge height (TEH). The face height is then divided in half and added to the leading edge height (LEH) to yield the height of the engineered impact point (EIP). Continuing with the club head in the position of FIG. 48, a spot is marked on the imaginary line (IL) at the height above the ground plane (GP) that was just calculated. This spot is the engineered impact point (EIP).

The engineered impact point (EIP) may also be easily determined for club heads having alternative score line configurations. For instance, the golf club head of FIG. 49 does not have a centered top score line. In such a situation, the two outermost score lines that have lengths within 5% of one another are then used as the top score line (TSL) and the bottom score line (BSL). The process for determining the location of the engineered impact point (EIP) on the face is then determined as outlined above. Further, some golf club heads have non-continuous score lines, such as that seen at the top of the club head face in FIG. 50. In this case, a line is extended across the break between the two top score line sections to create a continuous top score line (TSL). The newly created continuous top score line (TSL) is then bisected and used to locate the imaginary line (IL). Again, then the process for determining the location of the engineered impact point (EIP) on the face is then determined as outlined above.

The engineered impact point (EIP) may also be easily determined in the rare case of a golf club head having an asymmetric score line pattern, or no score lines at all. In such embodiments the engineered impact point (EIP) shall be determined in accordance with the USGA "Procedure for Measuring the Flexibility of a Golf Clubhead," Revision 2.0, Mar. 25, 2005, which is incorporated herein by reference. This USGA procedure identifies a process for determining the impact location on the face of a golf club that is to be tested, also referred therein as the face center. The USGA procedure utilizes a template that is placed on the face of the golf club to determine the face center. In these limited cases of asymmetric score line patterns, or no score lines at all, this USGA face center shall be the engineered impact point (EIP) that is referenced throughout this application.

The engineered impact point (EIP) on the face is an important reference to define other attributes of the present invention. The engineered impact point (EIP) is generally shown on the face with rotated crosshairs labeled EIP. One important dimension that utilizes the engineered impact point (EIP) is the center face progression (CFP), seen in FIGS. 46 and 52. The center face progression (CFP) is a single dimension measurement and is defined as the distance in the Z-direction from the shaft axis (SA) to the engineered impact point (EIP).

A second dimension that utilizes the engineered impact point (EIP) is referred to as a club moment arm (CMA). The CMA is the two dimensional distance from the CG of the club head to the engineered impact point (EIP) on the face, as seen in FIG. 46. Thus, with reference to the previously described coordinate system, the club moment arm (CMA) includes a component in the Z-direction and a component in the Y-direction, but ignores the any difference in the X-direction between the CG and the engineered impact point (EIP). Thus, the club moment arm (CMA) can be thought of in terms of an impact vertical plane passing through the engineered impact point (EIP) and extending in the Z-direction. First, one would translate the CG horizontally in the X-direction until it hits the impact vertical plane. Then, the club moment arm (CMA) would be the distance from the projection of the CG on the impact vertical plane to the engineered impact point (EIP).

The club moment arm (CMA) has a significant impact on the launch angle and the spin of the golf ball upon impact, as well as the ball flight of off-center hits. In fact, testing has shown that each hundredth of an inch reduction in club moment arm (CMA) results in a reduction in ball spin rate of up to 13.5 rpm. A shorter club moment arm (CMA) produces less variation between shots hit at the engineered impact point (EIP) and off-center hits. Thus, a golf ball struck near the heel or toe of a short club moment arm (CMA) club will have launch conditions more similar to a perfectly struck shot. Conversely, a golf ball struck near the heel or toe of a golf club head with a large club moment arm (CMA) would have significantly different launch conditions than a ball struck at the engineered impact point (EIP). Therefore, the change in club moment arm (CMA) across the transition from a curved face golf club to a flat face golf club is significant to obtaining preferred distance gapping.

Figure 55:
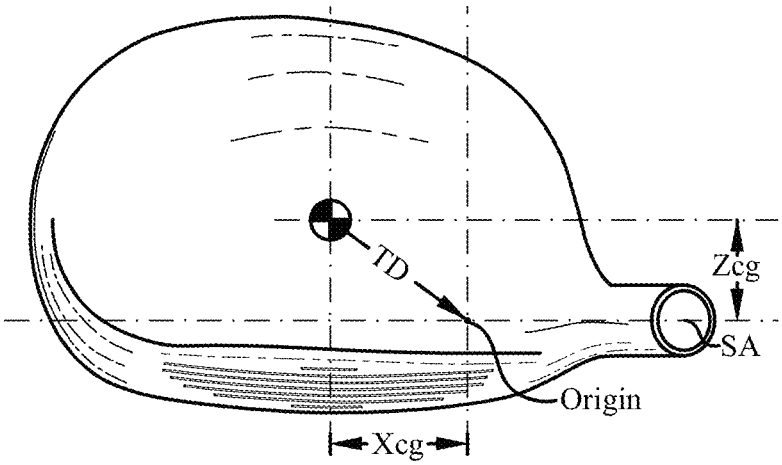
FIG. 55 is a top plan view of an embodiment of a curved face adjustable golf club head, not to scale.

Another important dimension only takes into consideration two dimensions and is referred to as the transfer distance (TD), seen in FIG. 55. The transfer distance (TD) is the horizontal distance from the CG to a vertical line extending from the origin; thus, the transfer distance (TD) ignores the height of the CG, or Ycg. Thus, using the Pythagorean Theorem from simple geometry, the transfer distance (TD) is the hypotenuse of a right triangle with a first leg being Xcg and the second leg being Zcg.

The transfer distance (TD) is significant in that is helps define another moment of inertia value that is significant to the present invention. This new moment of inertia value is defined as the face closing moment of inertia, referred to as MOIfc, which is the horizontally translated (no change in Y-direction elevation) version of MOIy around a vertical axis that passes through the origin. MOIfc is calculated by adding MOIy to the product of the club head mass and the transfer distance (TD) squared. Thus, $$MOIfc=MOIy+(mass*(TD)^2)$$

The face closing moment (MOIfc) is important because is represents the resistance that a golfer feels during a swing when trying to bring the club face back to a square position for impact with the golf ball. In other words, as the golf swing returns the golf club head to its original position to impact the golf ball the face begins closing with the goal of being square at impact with the golf ball.

In another embodiment preferred gapping between adjacent lofted clubs in a set of golf clubs is further achieved by incorporating loft adjustability of at least one of the clubs. In one embodiment the loft adjustability is provided at the transition from a golf club head having a curved face, in other words one with bulge and roll, and a golf club head with a flat face, which includes, but is not limited to, a trans-hybrid with a flat face, a hollow iron, a cavity back iron, a muscle back iron, and a blade iron, just to name a few. Likewise, as will be discussed in later embodiments, this transition point from curved face golf club to flat face golf club may also be the point at which other forms of adjustability are incorporated, including length adjustability, as previously described, and lie adjustability, as well as the point at which it is important to maintain certain relationships between the two types of golf club heads at this transition.

Figure 28:
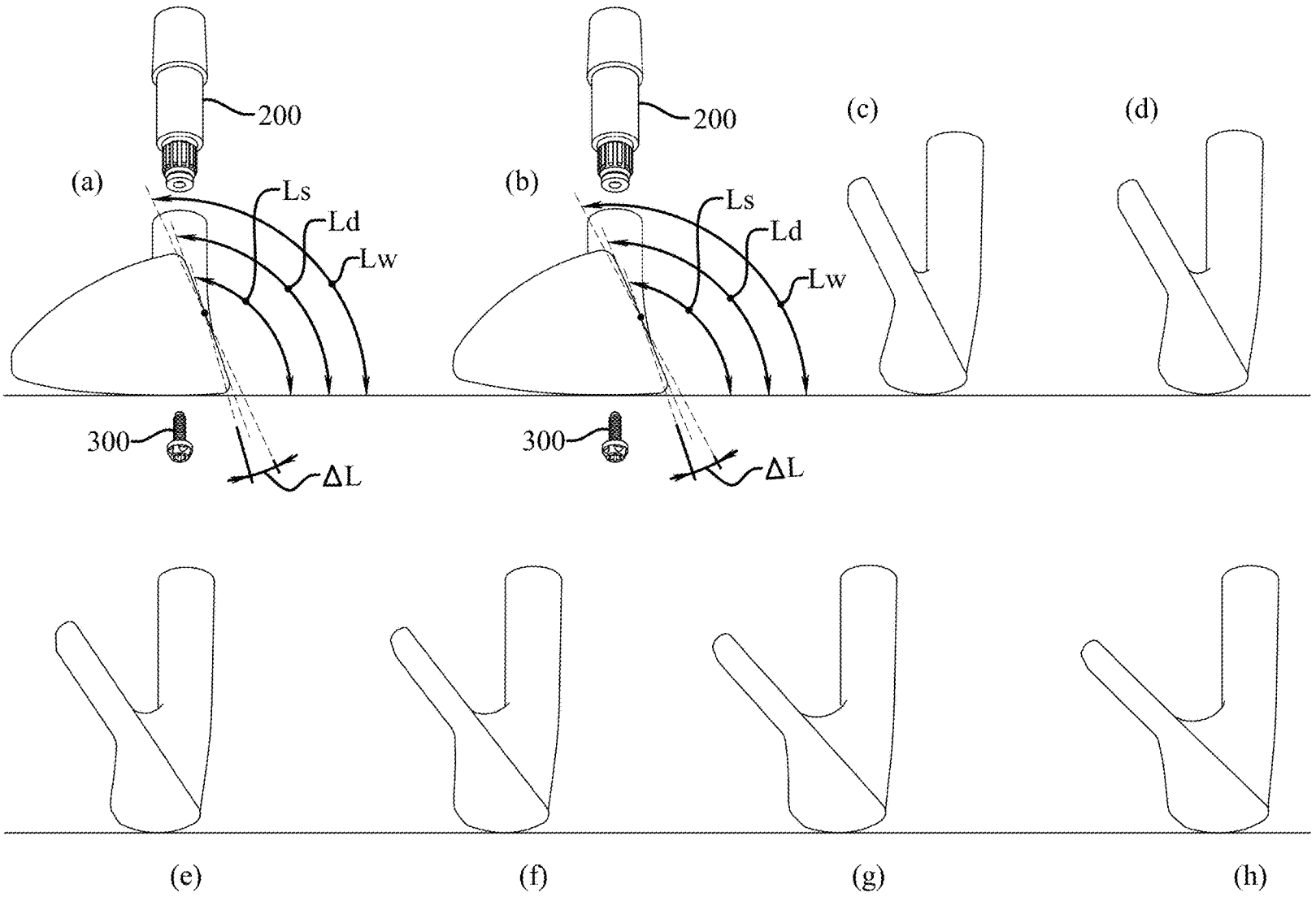
FIG. 28 is a side elevation view of an embodiment of a golf club set, not to scale.

Several golf club sets are illustrated in FIGS. 28-32. For simplicity of explanation, this description will refer to the club labeled in FIG. 28 (*a*) as a #3, (*b*) as a #4, (*c*) as a #5, (*d*) as a #6, (*e*) as a #7, (*f*) as a #8, (*g*) as a #9, and (*h*) as a wedge, however this invention is not limited to these clubs or club types. Thus, FIG. 28 illustrates an embodiment with two hybrid golf clubs characterized by having curved faces with bulge and roll, seen as (a) and (b), and several flat face golf clubs, seen as conventional irons in (c)-(h) of this figure.

One embodiment of the set of golf clubs includes a first curved face adjustable hybrid golf club, club (b) of FIG. 28, and a first flat face golf club, club (c) of FIG. 28. Focusing first on the first curved face adjustable hybrid golf club, it has a first curved face golf club head having a first curved face positioned at a first front portion of the first curved face golf club head where the first curved face golf club head impacts a golf ball, wherein the first curved face has a first design loft of at least 15 degrees and no more than 42.5 degrees, and wherein the first curved face includes a first engineered impact point (EIP) and first club moment arm (CMA), and a first rear portion opposite the first curved face. The curved face golf club head has a first sole positioned at a first bottom portion of the first curved face golf club head; a first crown positioned at a first top portion of the first curved face golf club head; a first skirt positioned around a portion of a periphery of the first curved face golf club head between the first sole and the first crown, wherein the first curved face, first sole, first crown, and first skirt define an first outer shell that further defines a first head volume that is at least 40 cubic centimeters and less than 130 cubic centimeters; and a first hosel with a first bore having a first center that defines a first shaft axis (SA) which intersects with a horizontal ground plane (GP) to define a first origin point, wherein the first bore is located at a first heel side of the first curved face golf club head, and wherein a first toe side of the first curved face golf club head is located opposite of the first heel side. The first curved face adjustable hybrid golf club includes a first shaft having a first proximal end and a first distal end, and a first adjustability system including a first shaft sleeve attached to an end of the first shaft that adjustably cooperates with the first hosel of the first curved face golf club head and capable of adjusting the first design loft, labeled Ld in FIG. 28, from a first weak loft, labeled Lw, to a first strong loft, labeled Lw, thereby defining a first loft adjustability range, labeled ΔL. The mass properties of the first curved face golf club head with the first adjustability system installed produce a first center of gravity (CG) located (a) vertically toward the first top portion of the first curved face golf club head from the first origin point a first distance Ycg; (b) horizontally from the first origin point toward the first toe side of the first curved face golf club head a first distance Xcg that is generally parallel to the first curved face and the ground plane (GP); (c) a first distance Zcg from the first origin toward the first rear portion in a direction generally orthogonal to the vertical direction used to measure the first Ycg and generally orthogonal to the horizontal direction used to measure the first Xcg; and (d) define the first club moment arm (CMA) measured from the first CG to the first engineered impact point (EIP). A first grip is attached to the first shaft proximal end, and in the case of an integrated set of curved face clubs and flat face clubs replacing traditional irons, the first curved face golf club has a first club length of at least 36 inches and no more than 42 inches. The first curved face is characterized by a bulge and a roll of 8 inches to 30 inches. In a further embodiment the first head volume that is at least 80 cubic centimeters and less than 120 cubic centimeters, while an even further embodiment has a first head volume that is at least 80 cubic centimeters and less than 100 cubic centimeters.

In this embodiment the first flat face golf club has a first flat face golf club head having a first flat face loft of at least 2 degrees greater than the first design loft. A first flat face is positioned at a first flat face front portion of the first flat face golf club head where the first flat face golf club head impacts a golf ball, wherein the first flat face has, and wherein the first flat face includes a first flat face engineered impact point (EIP) and a first flat face club moment arm (CMA), and a first flat face rear portion opposite the first flat face. The transition from the first curved face golf club head to the first flat face golf club head is also generally characterized by a significant drop in club head volume from the first curve face volume to a first flat face volume, and historically a large change in the club moment arm (CMA).

In one embodiment the first flat face volume is less than 90 cubic centimeters, whereas in another embodiment the first flat face volume is at least 15% less than the first curve face volume, while an even further embodiment has found preferred gapping with a first flat face volume is 45-75% of the first curve face volume. One particular embodiment having preferred gapping characteristics has a first flat face volume that is 50-70% of the first curve face volume. The first flat face golf club head has a first flat face hosel with a first flat face bore having a first flat face center that defines a first flat face shaft axis (SA) which intersects with a horizontal ground plane (GP) to define a first flat face origin point, wherein the first flat face bore is located at a first flat face heel side of the first flat face golf club head, and wherein a first flat face toe side of the first flat face golf club head is located opposite of the first flat face heel side. The first flat face golf club has a first flat face shaft having a first flat face proximal end and a first flat face distal end, and a first flat face grip attached to the first flat face shaft proximal end. In the case of an integrated set of at least one curved face club and flat face club replacing traditional irons, the first flat face golf club has a first flat face club length of at least 36 inches and no more than 42 inches.

Figure 29:
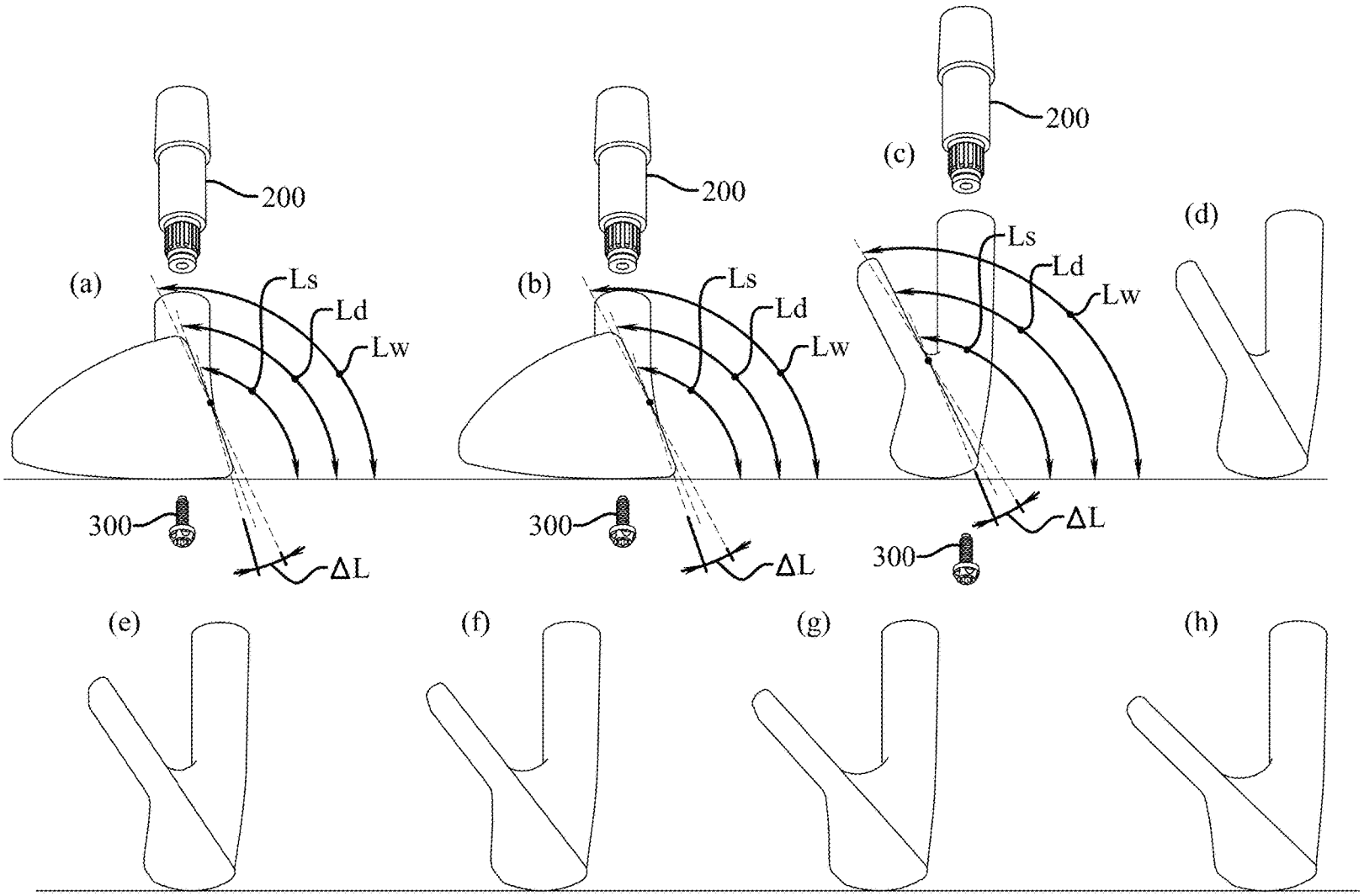
FIG. 29 is a side elevation view of an embodiment of a golf club set, not to scale.

One feature that aids a golfer in fine tuning the distance gap produced across the transition from the first curved face adjustable loft hybrid golf club to the first flat face golf club is the ability to have a first weak loft is no less than 1.5 degrees less than the first flat face loft. It is important to note that the first flat face loft is not necessarily a first design loft, although it is when the first flat face golf club is not loft adjustable. However, in the later described embodiments in which the first flat face golf club is loft adjustable, as seen in FIGS. 29(*c*), 31(*c*), and 39(*f*), the first weak loft is no less than 1.5 degrees less than a first flat face strong loft; although some adjustable embodiments have the first weak loft equal to, or greater than, a first flat face strong loft, while still other embodiments incorporate an overlap of the loft ranges across the transition from curved face to flat face by having the first weak loft is equal to, or greater than, a first flat face design loft. In one embodiment the first weak loft is equal to, or greater than, the first flat face loft.

Referring back to the embodiment in which the first flat face golf club is not loft adjustable, since the first flat face loft, or first flat face design loft in non loft adjustable embodiments, is at least 2 degrees greater than the first design loft, and the first weak loft is no less than 1.5 degrees less than the first flat face loft; the golfer is able to weaken the first design loft by at least 0.5 degrees; while in the embodiment in which the first weak loft is equal to, or greater than, the first flat face loft, the golfer is able to weaken the first design loft by at least 2.0 degrees. Therefore, in this embodiment the golf club set allows a golfer to adjust the loft of the first curved face adjustable loft hybrid golf club so that it is the same, or even less than, the first flat face golf club, which is significant to ensure proper distance gapping across these different club types. One skilled in the art will understand that adjusting the loft of the first curved face adjustable loft hybrid golf club to equal the loft of the first flat face golf club does not equate to a golf ball traveling the same distance when struck by the two clubs, as the locations of the centers of gravity, weight of the club head, club length, and the characteristic time (CT), or coefficient of restitution (COR), which are referred to as face performance indicators, of the face significantly influence the travel distance of the golf ball. In a further embodiment the first design loft may also be reduced to a first strong loft, which is at least 1 degree less than the first design loft. An even further embodiment the adjustability allows the first design loft to be weakened to a first weak loft that is more than 2 degrees, while in a another embodiment it is at least 2.5 degrees, and at least 3 degrees in a further embodiment.

FIGS. 56 and 57 illustrate two such embodiments. First, FIG. 56 illustrates a first curved face adjustable loft hybrid golf club having a first design loft of 22 degrees that may be adjusted to a first weak loft of 24 degrees, which is equal to the first flat face design loft. Further, FIG. 57 illustrates a first curved face adjustable loft hybrid golf club having a first design loft of 19 degrees that may be adjusted to a first weak loft of 22 degrees, which is equal to the first flat face design loft. It is worth noting that although FIGS. 56-70 generally refer to a #4 club and a #5 club, this is for illustration purposes only, and the pair can also be a #1 club and #2 club, a #2 club and #3 club, a #5 club and #6 club, a #6 club and #7 club, a #8 club and #9 club, or a #9 club and a wedge.

As previously noted, in one embodiment the first flat face golf club is adjustable and further includes a first flat face adjustability system including a first flat face shaft sleeve attached to an end of the first flat face shaft that adjustably cooperates with the first flat face hosel of the first flat face golf club head and capable of adjusting a first flat face design loft to a first flat face strong loft. In a further embodiment the first flat face strong loft is equal to, or less than, the first weak loft, as seen in FIG. 58 where a first curved face adjustable loft hybrid golf club having a first design loft of 22 degrees that may be adjusted to a first weak loft of 23.5 degrees, equal to the first flat face strong loft of 23.5 degrees, which is adjusted down from the first flat face design loft of 25 degrees. Even further embodiments allow for overlap wherein the first weak loft is greater than the first flat face strong loft, as seen in the example of FIG. 59. Such an adjustability loft overlap provides great flexibility to a golfer seeking to obtain consistent distance gaps between the clubs in their set, particularly at this important transition from a curved face club to a flat face club. In an even further embodiment the first flat face strong loft is equal to, or less than, the first design loft. In an even further embodiment the first flat face strong loft is at least 2 degrees less than the first flat face design loft, while in a further embodiment it is at least 2.5 degrees, and an even further embodiment had a first flat face strong loft that is at least 3 degrees less than the first flat face design loft. Similarly, in another embodiment the first flat face design loft may also be increased to a first flat face weak loft, which is at least 1 degree greater than the first flat face design loft, while it is at least 1.5 degrees greater than the first flat face design loft in another embodiment, and at least 2 degrees greater than the first flat face design loft in an even further embodiment.

The first curved face adjustable loft hybrid golf club has a first curved face performance indicator, which may be a first characteristic time and/or a first coefficient of restitution, and the first flat face golf club has a first flat face performance indicator, which may be a first flat face characteristic time and/or a first flat face coefficient of restitution. One skilled in the art will be familiar with these terms and the associated testing procedures, however the following disclosure may be helpful. In 1998 the United States Golf Association (USGA) limited the coefficient of restitution (COR) in drivers to 0.830, more specifically to 0.822 with a test tolerance of 0.008 effectively taking the limit up to 0.830. With the introduction of these limits, the USGA needed a test procedure to measure a driver's COR. Originally, a ball was fired by air cannon into a specimen and pre and post impact velocities were compared to find COR, as set forth in "Procedure for Measuring the Velocity Ratio of a Clubhead for Conformance to Appendix II, (5a.)," Revision 3 Jan. 1, 2002. This process took a significant amount of time to perform when considering the set up and the controls associated with the test. Those skilled in the art know that today the characteristic time, often referred to as the CT, value of a golf club head is more widely used in determining conformance with the USGA equipment rules. The rules currently state that the characteristic time, or CT, of a club head shall not be greater than 239 microseconds, with a maximum test tolerance of 18 microseconds. Thus, it is common for golf clubs to be designed with the goal of a 239 microsecond CT, knowing that due to manufacturing variability that some of the heads will have a CT value higher than 239 microseconds, and some will be lower. However, it is critical that the CT value does not exceed 257 microseconds or the club will not conform to the USGA rules. The USGA publication "Procedure for Measuring the Flexibility of a Golf Clubhead," Revision 2.0, Mar. 25, 2005, is the current standard that sets forth the procedure for measuring the characteristic time. However, some believe that this CT test is only applicable to drivers, in fact, the USGA still employs the air cannon COR test when testing fairway woods, hybrids and irons.

Thus, in one embodiment, the present golf club set reduces distance gapping issues by having the first flat face performance indicator within 20% of the first curved face performance indicator, while in another embodiment it is within 10%. In yet another embodiment the first curved face performance indicator is equal to, or less than, the first flat face performance indicator, thereby further controlling the distance gap between the flat face club and the curved face club, and is the opposite of general club set designs. Still further, in another embodiment the first curved face performance indicator is at least 5% less than the first flat face performance indicator.

Another embodiment of the present golf club set reduces distance gapping issues by controlling the change in club moment arm (CMA) from the first curved face golf club to the first flat face golf club. The significance of the club moment arm has been previously explained. In one such embodiment the change in club moment arm is less than 0.300 inches and the first flat face club moment arm is at least 60% of the first club moment arm, whereas a common change in club moment arm of a conventional hybrid to a traditional iron greater than 0.300 inches, generally greater than 0.400 inches, and often greater than 0.500 inches. In a further embodiment the difference between the first club moment arm and the first flat face club moment arm is less than 0.250 inches and the first flat face club moment arm is 75%-95% of the first club moment arm; while in an even further embodiment the difference between the first club moment arm and the first flat face club moment arm is less than 0.200 inches and the first flat face club moment arm is 80%-90% of the first club moment arm. One particular embodiment having preferred distance gapping attributes has a first club moment arm of 0.7-0.9 inches and a first flat face club moment arm of 0.5-0.6 inches. Further embodiments may include at least one additional curved face golf club and at least one flat face golf club. In this embodiment a second curved face golf club has a second club moment arm that is within 10% of the first club moment arm, and a second first flat face golf club has a second flat face club moment arm that is within 15% of the first flat face club moment arm.

Another embodiment of the set, seen in FIG. 33, incorporates length adjustability into a first curved face adjustable length hybrid golf club. Detailed disclosure of length adjustability embodiments have been previously described above and will not be reproduced here. In this embodiment first curved face adjustable loft hybrid golf club includes a first adjustability system including a first hosel sleeve configured to cooperate with the first hosel and receive the first shaft sleeve. In a first minor length configuration the first shaft sleeve is releasably secured to the first curved face golf club head producing a first curved face minor club length. Similarly, in a first intermediate length configuration the first shaft sleeve and the first hosel sleeve are releasably secured to the first curved face golf club head producing a first curved face intermediate length. The first intermediate length is at least 0.25 inch greater than the first minor length, and the first minor length is within 0.5 inch, or less, of the first flat face club length, as seen in FIG. 60. In a further embodiment the first intermediate length is at least 0.5 inch greater than the first minor length. While in an even further embodiment the first minor length is within 0.25 inch, or less, of the first flat face club length, as seen in FIG. 61. Still further, in one embodiment the first intermediate length is at least 0.5 inch greater than the first minor length and the first minor length is equal to the first flat face club length, as seen in FIG. 62. One skilled in the art will appreciate that a club's length plays a significant role in the club head speed and associated distance a golf ball will travel, therefore the ability to adjust the length of the first curved face adjustable length hybrid golf club from an initial length, or first minor length, that is close to, or even equal to, the first flat face club length to a longer length, or first intermediate length, provides great flexibility to a golfer that is fine tuning the distance gap between the first curved face adjustable length hybrid golf club and the first flat face golf club. All of the previous disclosed embodiments with respect to the moment of inertia, center of gravity, and weight systems, illustrated for non driver embodiments in FIGS. 38-43, associated with the minor length configuration and the intermediate length configuration may apply to these embodiments and will not be repeated here. However, one particular embodiment further smoothes the transition from the curved face club to the flat face club by incorporating designs so that the first intermediate length moment of inertia is within 15 percent of a first flat face club head moment of inertia.

Figure 34:
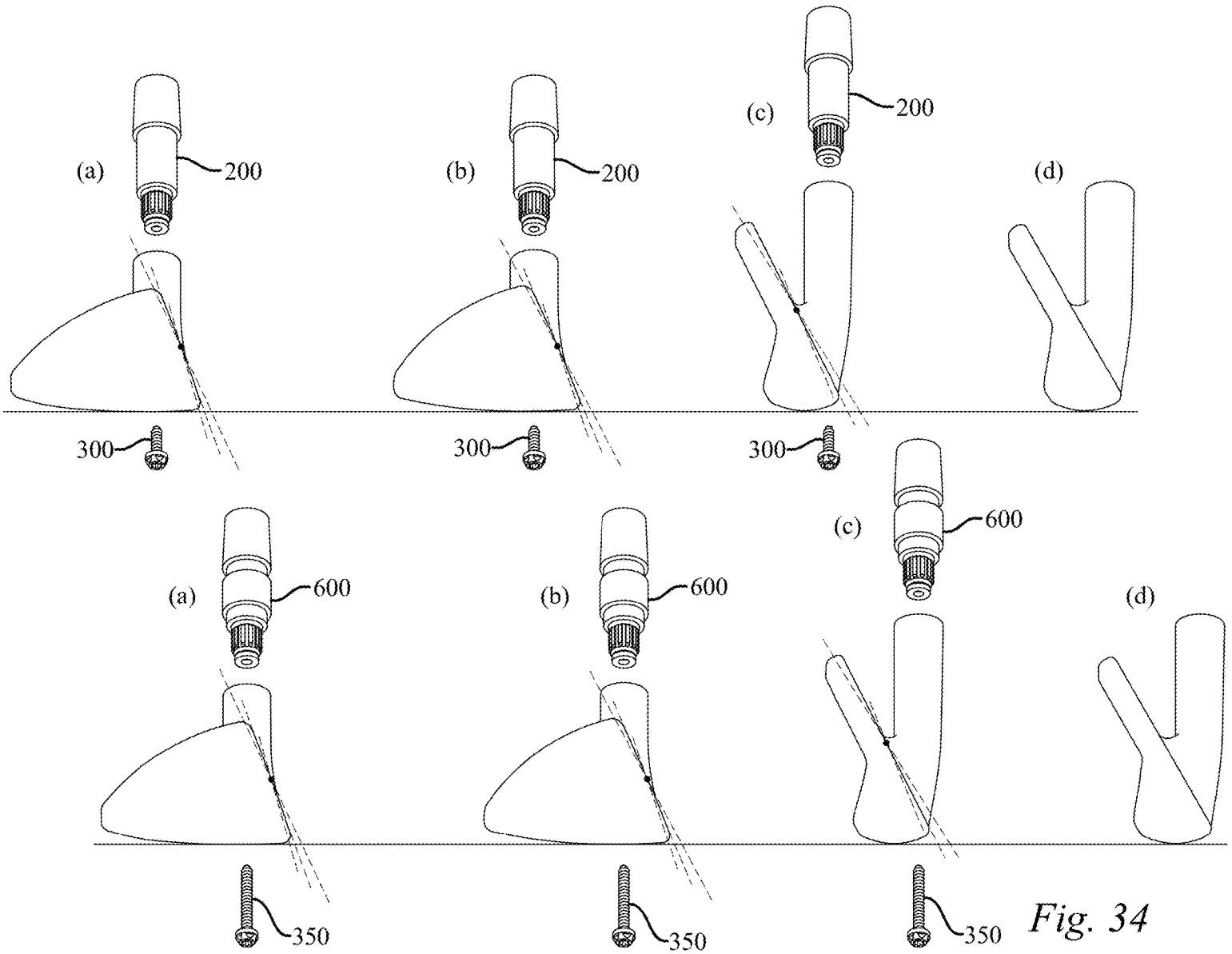
FIG. 34 is a side elevation view of an embodiment of a golf club set, not to scale.

Yet another embodiment of the set incorporates length adjustability into the first flat face golf club, as seen in FIGS. 34(*c*), 36(*c*), and 37(*c*). In this embodiment the first flat face adjustability system further includes a first flat face hosel sleeve configured to cooperate with the first flat face hosel and receive the first flat face shaft sleeve wherein in a first flat face minor length configuration the first flat face shaft sleeve is releasably secured to the first flat face golf club head producing a first flat face minor club length, and wherein in a first flat face intermediate length configuration the first flat face shaft sleeve and the first flat face hosel sleeve are releasably secured to the first flat face golf club head producing a first flat face intermediate length. The first flat face intermediate length is at least 0.25 inch greater than the first flat face minor length, and the first minor length is within 0.5 inch, or less, of the first flat face intermediate length, as seen in FIG. 63. In the embodiment of FIG. 64, the first minor length is within 0.25 inch, or less, of the first flat face intermediate length. While in an even further embodiment, seen in FIG. 65, the first minor length is equal to the first flat face intermediate length. All of the previous disclosed embodiments with respect to the moment of inertia, center of gravity, and weight systems associated with the minor length configuration and the intermediate length configuration may apply to these flat face golf club embodiments and will not be repeated here.

Figure 45:
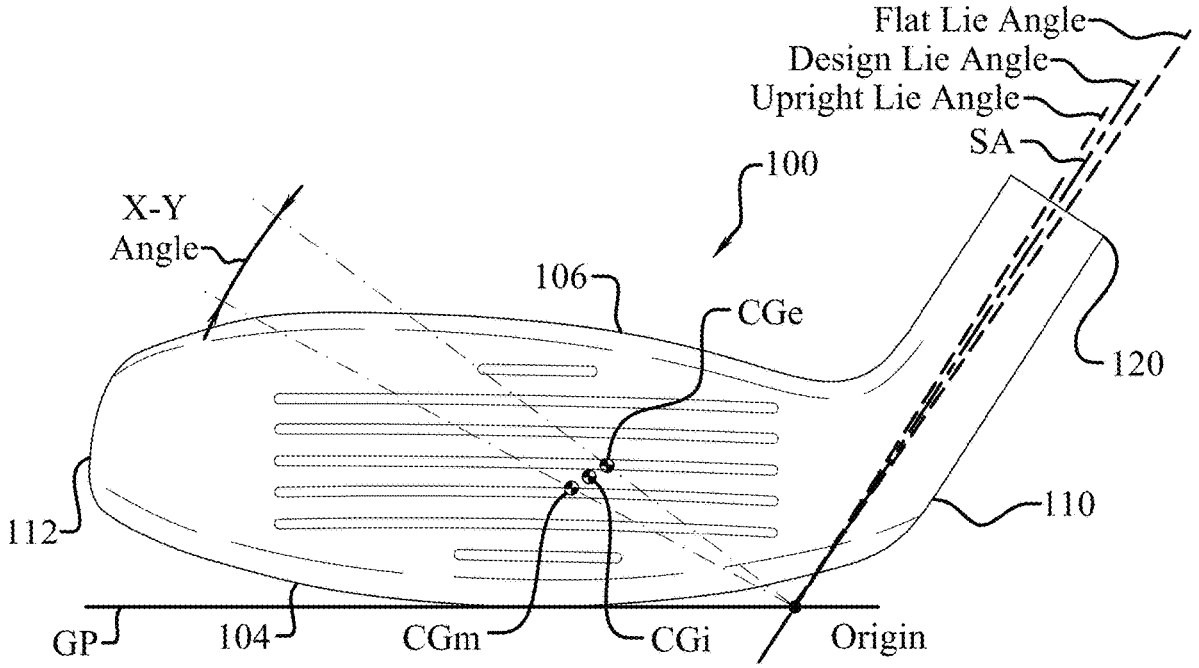
FIG. 45 is a front elevation view of an embodiment of a curved face adjustable golf club head, not to scale.

The first curved face adjustable hybrid golf club may also have an adjustable lie angle to further aid in controlling the distance gap at the transition from a curved face club to a flat face club. In this embodiment the first curved face adjustable hybrid golf club is adjustable in lie from a first curved face design lie angle to a first curved face upright lie angle, and the first curved face upright lie angle is at least as great as a first flat face lie angle. While lie angles are known to one skilled in the art, an upright, design, and flat lie angle, are illustrated in FIG. 45 and are the angle measured from the ground plant (GP) to the indicated shaft axis. When the flat face club is not adjustable in lie angle, the first flat face lie angle is a first flat face design lie angle, as seen in FIG. 66. However, in a further embodiment the first flat face golf club is adjustable in lie from a first flat face design lie angle to a first flat face flat lie angle, and the first curved face upright lie angle is at least as great as the first flat face flat lie angle, as seen in FIG. 67. Yet another embodiment provides a lie angle overlap in which the first curved face upright lie angle is greater than the first flat face flat lie angle, as seen in FIG. 68.

In one embodiment the first curved face adjustable hybrid golf club is adjustable in lie from a first curved face design lie angle to a first curved face upright lie angle that is at least 0.5 degrees greater than the first curved face design lie angle; while in an even further embodiment the first curved face adjustable hybrid golf club is adjustable in lie from a first curved face design lie angle to a first curved face upright lie angle that is at least 1.0 degrees greater than the first curved face design lie angle. Additionally, the first curved face adjustable hybrid golf club may also be adjustable in lie from a first curved face design lie angle to a first curved face flat lie angle that is at least 0.5 degrees less than the first curved face design lie angle; while in an even further embodiment the first curved face adjustable hybrid golf club is adjustable in lie from a first curved face design lie angle to a first curved face flat lie angle that is at least 1.0 degrees less than the first curved face design lie angle. In an even further embodiment the difference between the design lie angle and the adjusted lie angle, either upright or flat, is at least 1.5 degrees; while it is at least 2.0 degrees in a further embodiment.

Similarly, in one embodiment the first flat face adjustable golf club is adjustable in lie from a first flat face design lie angle to a first flat face flat lie angle that is at least 0.5 degrees less than the first flat face design lie angle; while in an even further embodiment the first flat face adjustable golf club is adjustable in lie from a first flat face design lie angle to a first flat face flat lie angle that is at least 1.0 degrees less than the first flat face design lie angle. Additionally, the first flat face adjustable golf club may also be adjustable in lie from a first flat face design lie angle to a first flat face upright lie angle that is at least 0.5 degrees greater than the first flat face design lie angle; while in an even further embodiment the first flat face adjustable golf club is adjustable in lie from a first flat face design lie angle to a first flat face upright lie angle that is at least 1.0 degrees greater than the first flat face design lie angle. In an even further embodiment the difference between the design lie angle and the adjusted lie angle, either upright or flat, is at least 1.5 degrees; while it is at least 2.0 degrees in a further embodiment.

So far the golf club set been disclosed as including a first curved face adjustable golf club, which may be adjustable in loft, length, and/or lie, and a non-adjustable first flat face golf club, along with unique relationships among the adjusted parameter(s) of the first curved face adjustable golf club and the fixed parameters of the non-adjustable first flat face golf club to obtain preferential distance gapping. Further embodiments disclose that the first flat face golf club may also be adjustable in loft, length, and/or lie, along with unique relationships among the adjusted parameter(s) of both clubs to obtain preferential distance gapping. Each of these adjustability methods and relationships may be used individually or in combination with the other adjustability methods. For example, FIG. 69 illustrates one embodiment of a first curved face adjustable golf and a non-adjustable first flat face golf club in which the variables of the golf club set are designed such that the set can be configured to have a curved face club and a flat face club in which both clubs have the same loft, length, and lie, yet afford a golfer to obtain a preferred distance gap between these clubs in the set; and this is just one of many potential combinations of the previously disclosed relationships. Similarly, FIG. 70 illustrates one embodiment of a first curved face adjustable golf and a first adjustable flat face golf club in which the variables of the golf club set are designed such that the set can be configured to have a curved face club and a flat face club in which both clubs have the same loft, length, and lie, yet afford a golfer to obtain a preferred distance gap between these clubs in the set; and this is just one of many potential combinations of the previously disclosed relationships. While the examples of FIGS. 69 and 70 illustrate adjustable ranges of loft, length, and lie that end up touching across this important transition point, in further embodiments one or more of the ranges may actually overlap, as previously discussed.

Any of the combinations may further include a first flat face performance indicator is within 20% of the first curved face performance indicator, or within 10% in some embodiments, as previously disclosed, or in even further embodiment the first curved face performance indicator is no greater than the first flat face performance indicator, further ensuring that desirable gapping may be obtained using any of the adjustability combinations. Further, the adjustability systems may include the previously disclosed weight system(s) to allow a golfer to maintain a desired common swing weight for each club. Additionally, in a further embodiment moment of inertia, specifically MOIy, of the curved face club is within 15 percent of the moment of inertia of the flat face club, regardless of the adjustability position, further ensuring a consistent feel across the club type transition and aiding in obtaining desired distance gapping. In even further embodiments the adjustability system is designed to allocate weight such that for an individual club the X, Y, and Z coordinates of a center of gravity each vary by less than 15 percent among the various adjustable settings, while in an even further embodiment they vary by less than 10 percent. Such consistency in center of gravity location further ensures a consistent feel across the club type transition and aids in obtaining desired distance gapping. Yet further embodiments the adjustability system are designed to allocate weight such that for an individual club the moment of inertia, specifically MOIy, varies by less than 15 percent among the various adjustable settings, while in an even further embodiment it varies by less than 10 percent. Such consistency in moment of inertia of a particular club, regardless of the adjustability setting, further ensures a consistent feel across the club type transition and aids in obtaining desired distance gapping.

In one embodiment of the set of golf clubs the transition from the first curved face adjustable hybrid golf club to the first flat face golf club does not occur until a first design loft of at least 25 degrees, which generally equates to a 6-iron being the first flat face golf club. While in an even further embodiment the transition from the first curved face adjustable hybrid golf club to the first flat face golf club does not occur until the first design loft is at least 28 degrees, which generally equates to a 7-iron being the first flat face golf club. Such embodiments further improve the distance gapping characteristics of the set by moving the transition point to higher lofted clubs.

Figure 30:
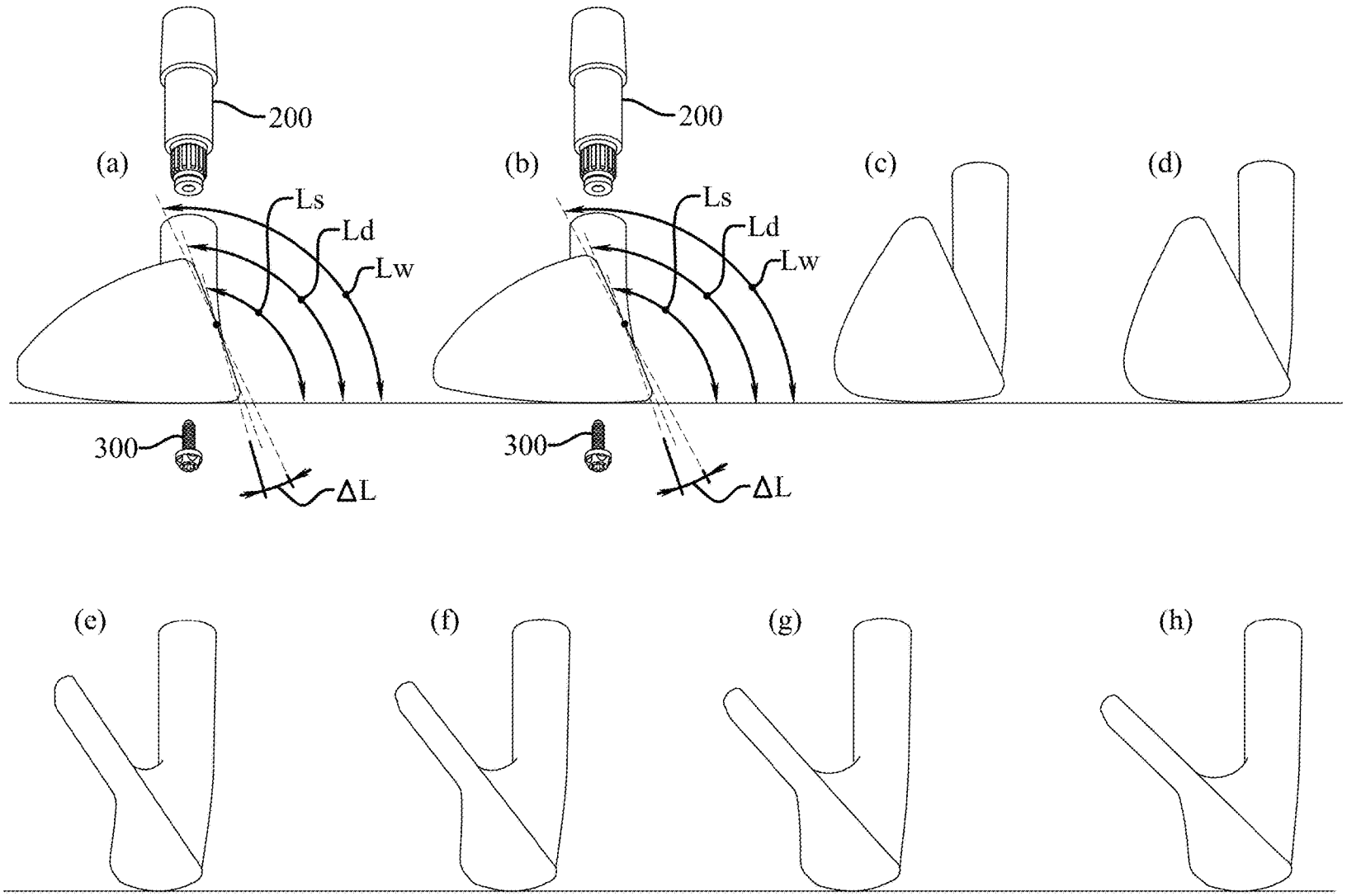
FIG. 30 is a side elevation view of an embodiment of a golf club set, not to scale.
Figure 31:
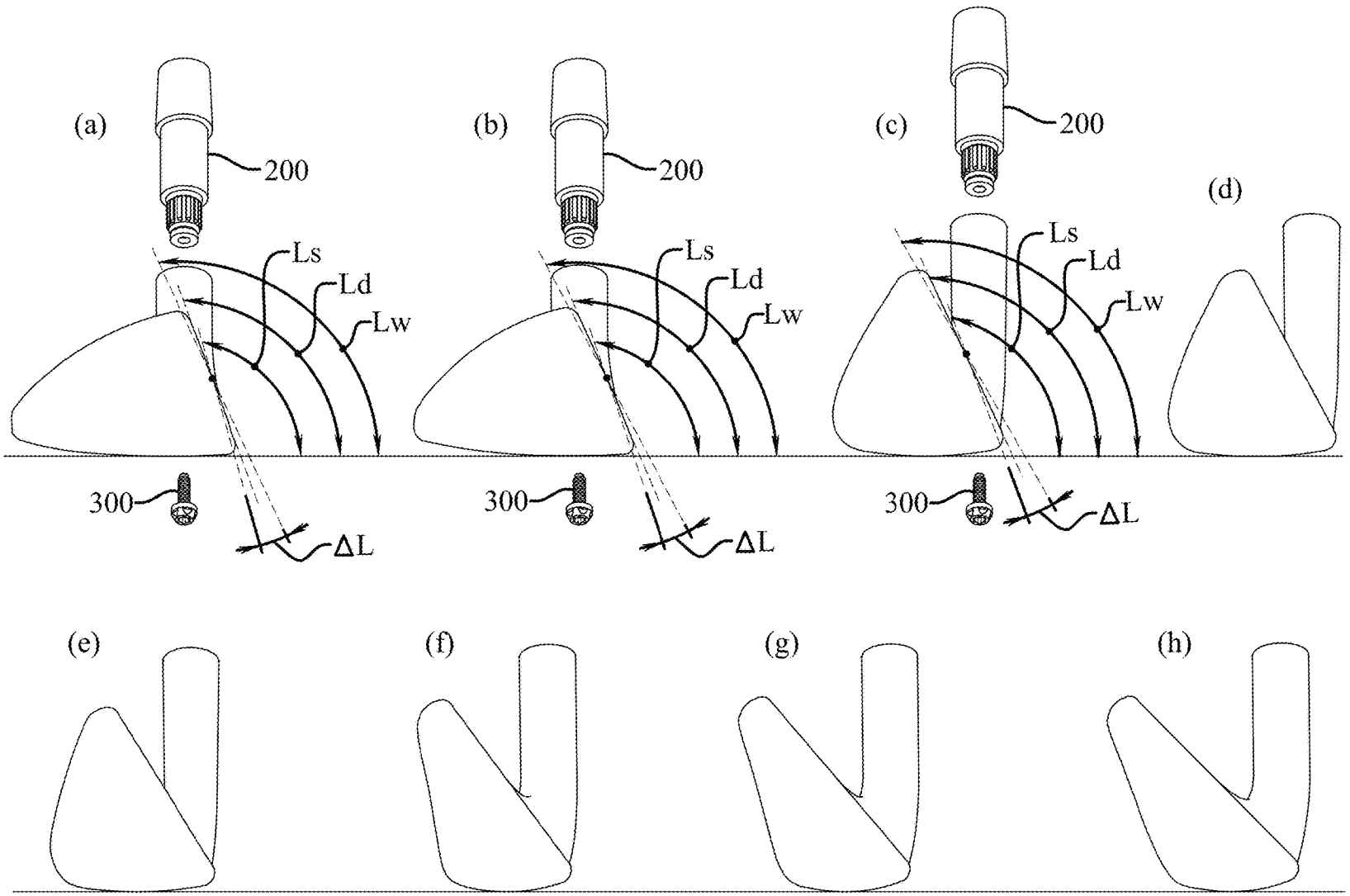
FIG. 31 is a side elevation view of an embodiment of a golf club set, not to scale.
Figure 32:
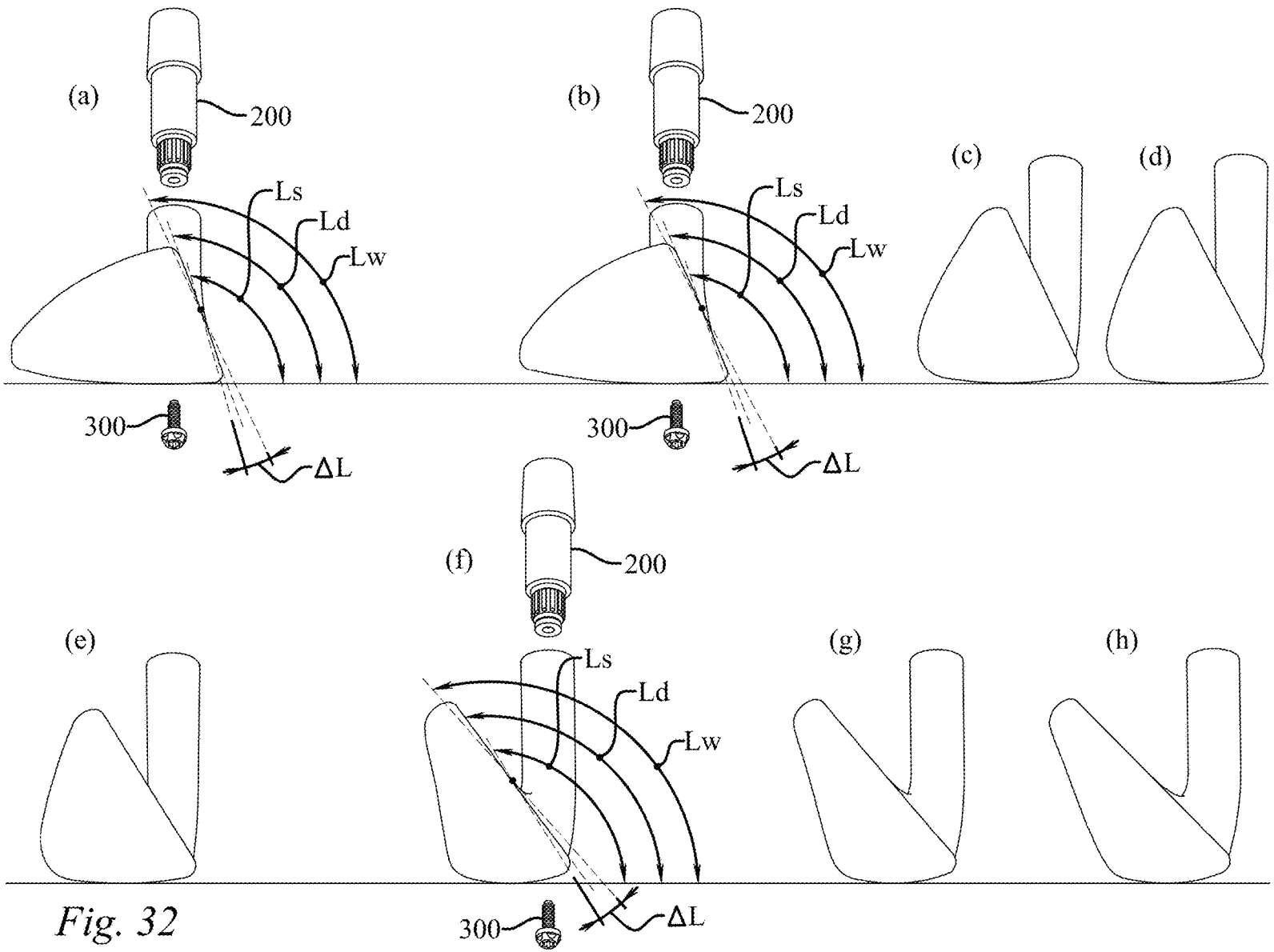
FIG. 32 is a side elevation view of an embodiment of a golf club set, not to scale.

While, FIG. 28 illustrates an embodiment with the transition from curved face club to flat face club occurring from the first curved face adjustable hybrid golf club of (b) to a non-adjustable first flat face golf club of (c) that is illustrated as a cavity back, or muscle back, iron; FIG. 29 illustrates an embodiment with the transition from curved face club to flat face club occurring from the first curved face adjustable hybrid golf club of (b) to an adjustable first flat face golf club of (c) that is illustrated as a cavity back, or muscle back, iron. Further, the embodiment illustrated in FIG. 30 shows the transition from curved face club to flat face club occurring from the first curved face adjustable hybrid golf club of (b) to a non-adjustable first flat face golf club of (c) that is illustrated as a trans-hybrid golf club, which is often referred to as a hollow-iron golf club; while FIG. 31 illustrates the same transition point with adjustable first flat face golf club of (c) that is illustrated as a trans-hybrid golf club. The embodiment illustrated in FIG. 32 shows the transition from curved face club to flat face club occurring from the first curved face adjustable hybrid golf club of (b) to a non-adjustable first flat face golf club of (c) that is illustrated as a trans-hybrid golf club, and additionally includes at least one additional adjustable flat face golf club, which is (f) in this illustration, but could be any, or all, of the golf clubs.

Figure 35:
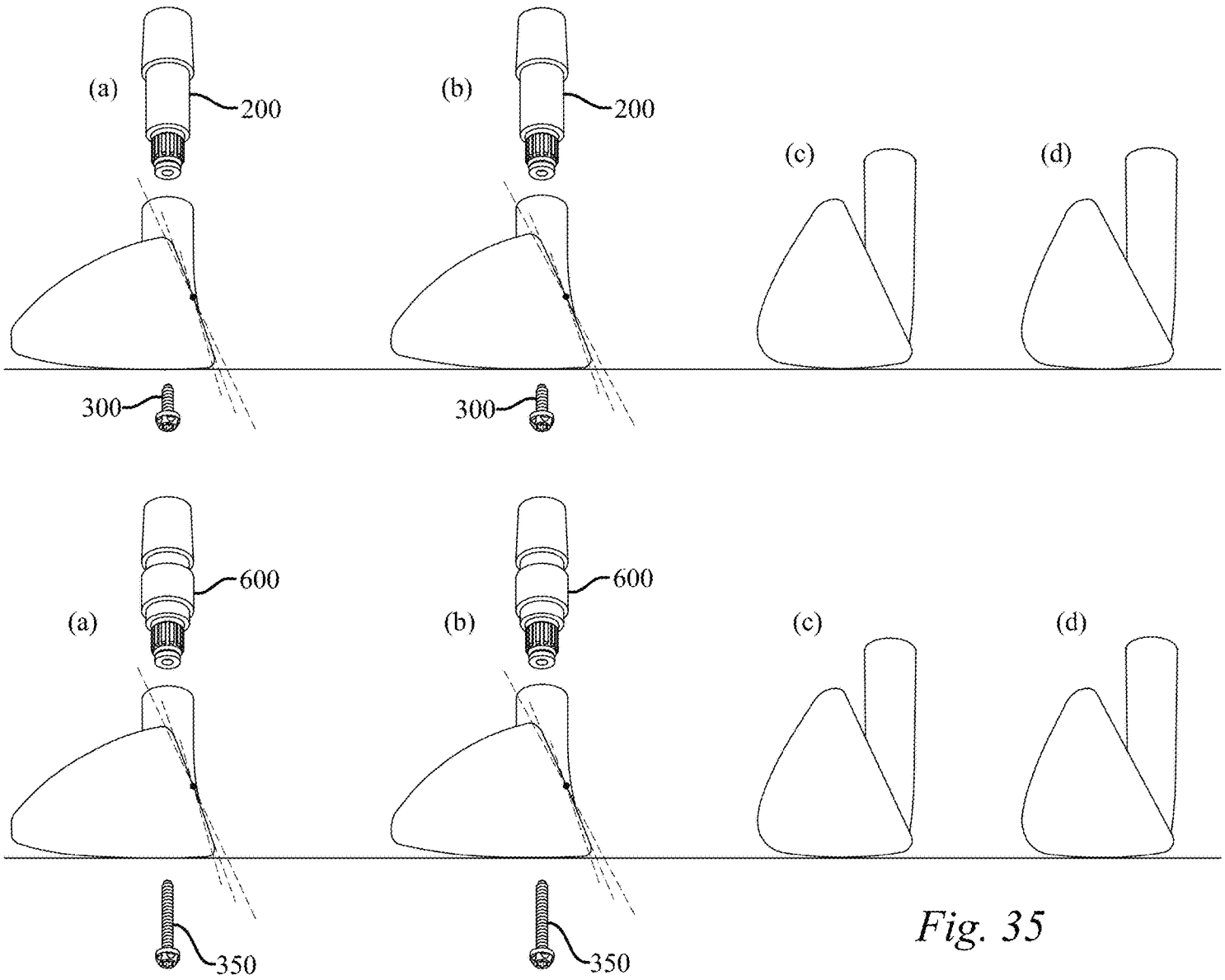
FIG. 35 is a side elevation view of an embodiment of a golf club set, not to scale.
Figure 36:
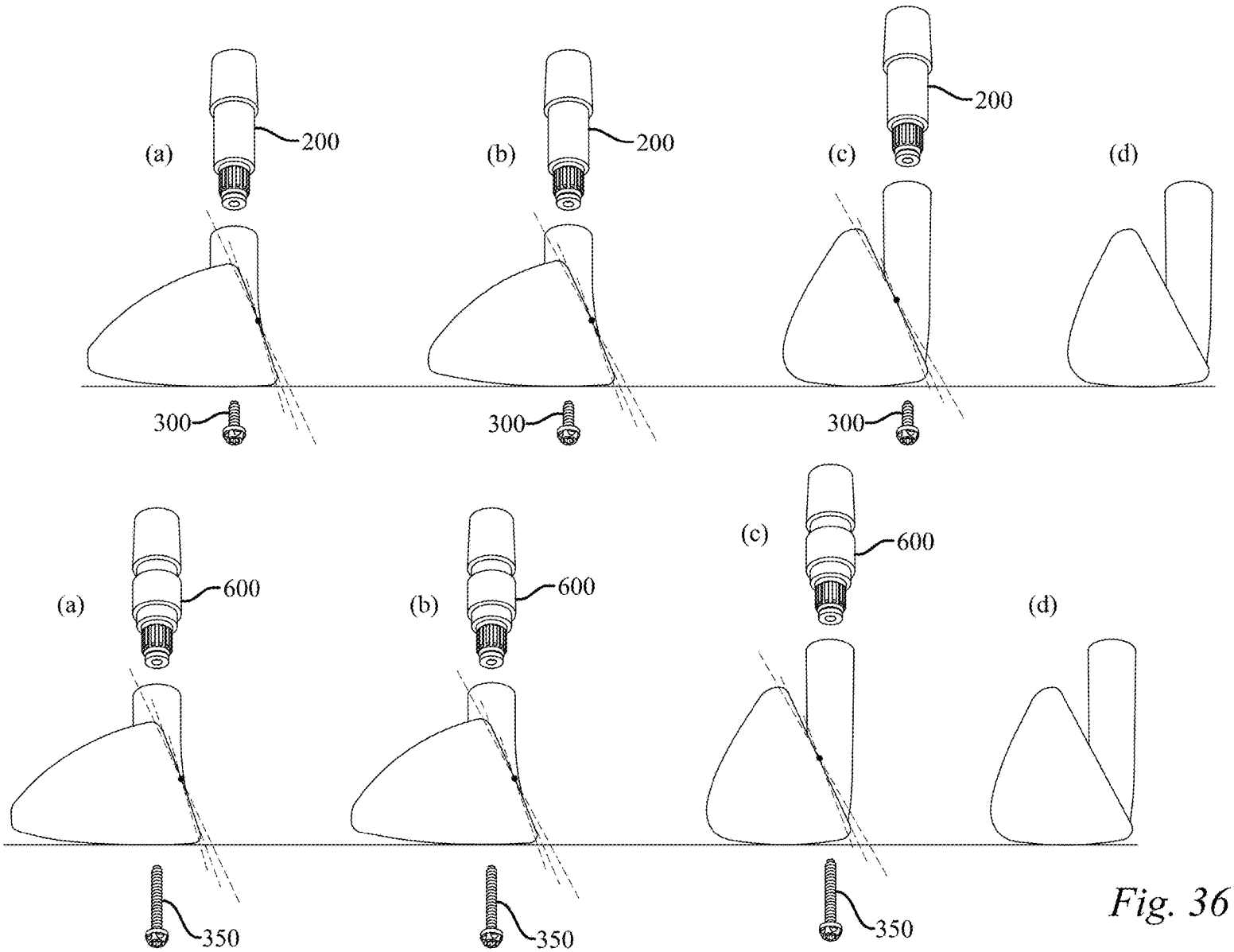
FIG. 36 is a side elevation view of an embodiment of a golf club set, not to scale.
Figure 37:
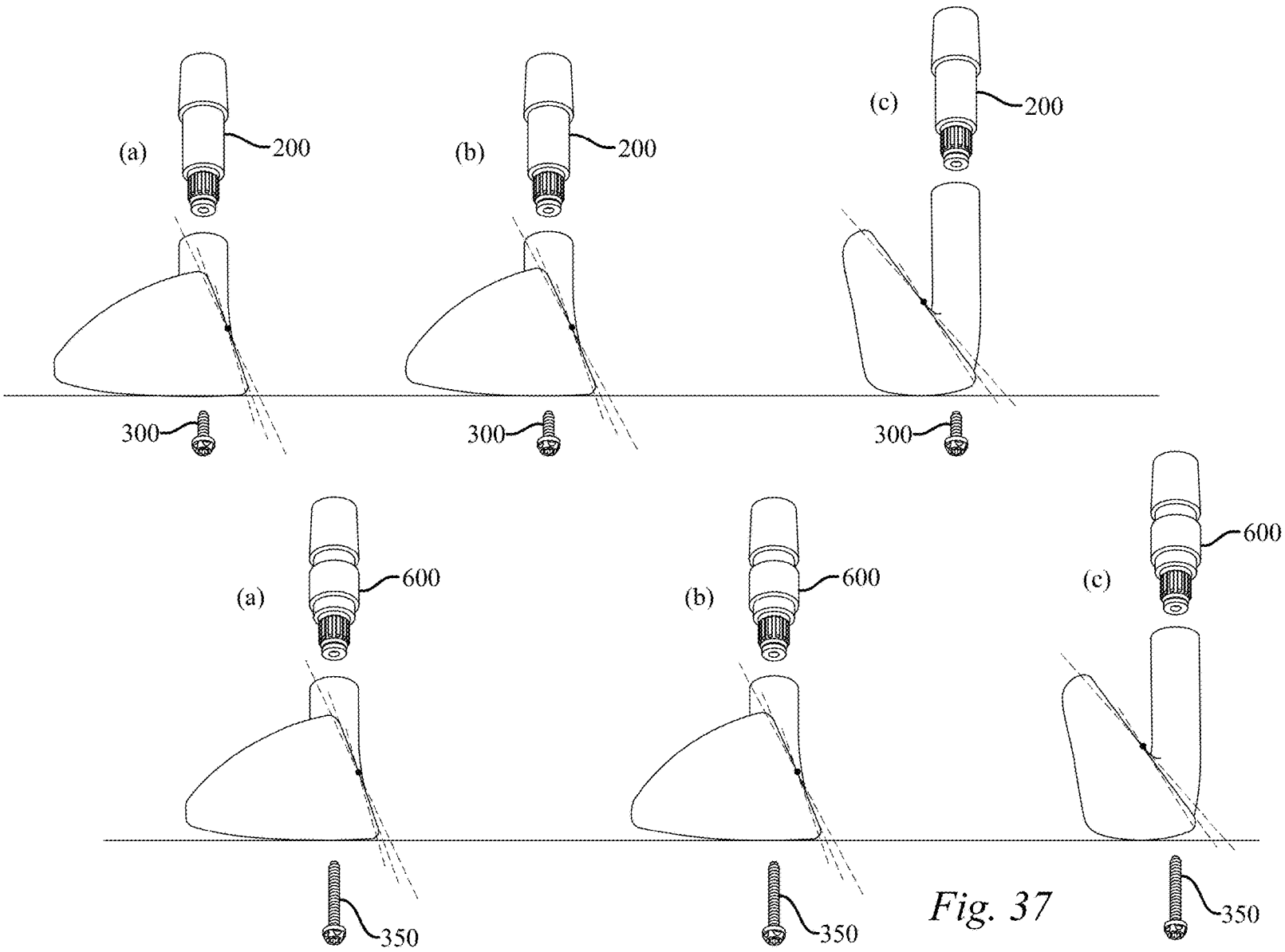
FIG. 37 is a side elevation view of an embodiment of a golf club set, not to scale.

FIG. 33 illustrates an embodiment with the transition from curved face club to flat face club occurring from the first curved face length adjustable hybrid golf club of (b) to a non-adjustable first flat face golf club of (c) that is illustrated as a cavity back, or muscle back, iron; FIG. 34 illustrates an embodiment with the transition from curved face club to flat face club occurring from the first curved face length adjustable hybrid golf club of (b) to a length adjustable first flat face golf club of (c) that is illustrated as a cavity back, or muscle back, iron. Further, the embodiment illustrated in FIG. 35 shows the transition from curved face club to flat face club occurring from the first curved face length adjustable hybrid golf club of (b) to a non-adjustable first flat face golf club of (c) that is illustrated as a trans-hybrid golf club, which is often referred to as a hollow-iron golf club; while FIG. 36 illustrates the same transition point with adjustable length first flat face golf club of (c) that is illustrated as a trans-hybrid golf club.

In one particular embodiment, the transition from curved face golf club to flat face golf club occurs in a loft range of 20-30 degrees and the golf club set includes at least three golf clubs having design lofts of 20-30 degrees, including a first curved face adjustable loft hybrid golf club, having a first loft adjustability range, and a first flat face adjustable loft golf club, having a first flat face loft adjustability range, wherein the first loft adjustability range and the first flat face loft adjustability range combine to provide at least six distinct loft settings, wherein at least one of the loft settings for the first flat face loft adjustable golf club is equal to, or less than, at least one of the loft settings for the first curved face adjustable loft hybrid golf club. In a further embodiment, the third golf club in this loft range is also adjustable and provides at least three additional distinct loft settings, wherein at least one of the loft settings is equal to a loft setting of one of the other two clubs, or overlaps into the first loft adjustability range or the first flat face loft adjustability range. In yet a further embodiment at least one of the golf clubs within this loft range is an adjustable length golf club and has at least one length that is equal to the length of at least one of the other two golf clubs within this loft range. Still further, another embodiment has at least two of the golf clubs within this loft range that are adjustable length golf clubs and have at least one length that is equal to the length of at least one of the other two golf clubs within this loft range. In yet a further embodiment at least one of the golf clubs within this loft range is an adjustable lie golf club and has at least one lie angle that is equal to the lie angle of at least one of the other two golf clubs within this loft range. Still further, another embodiment has at least two of the golf clubs within this loft range that are adjustable lie golf clubs and have at least one lie angle that is equal to the lie angle of at least one of the other two golf clubs within this loft range. In yet another embodiment all three of the golf clubs within this loft range have an MOIy, which is the moment of the inertia of the golf club head around an axis through the CG, parallel to the Y-axis, that is within the range of 2200-3000 g*cm$^2$. In a further embodiment all three of the clubs in this particular set have face performance indicators within 20% of the highest face performance indicator. While in another embodiment all three of the clubs in this particular set have face performance indicators within 10% of the highest face performance indicator; and in another embodiment the highest face performance indicator is associated with a flat face golf club head.

In another embodiment, the transition from curved face golf club to flat face golf club occurs in a loft range of 25-35 degrees and the golf club set includes at least three golf clubs having design lofts of 25-35 degrees, including a first curved face adjustable loft hybrid golf club, having a first loft adjustability range, and a first flat face adjustable loft golf club, having a first flat face loft adjustability range, wherein the first loft adjustability range and the first flat face loft adjustability range combine to provide at least six distinct loft settings, wherein at least one of the loft settings for the first flat face loft adjustable golf club is equal to, or less than, at least one of the loft settings for the first curved face adjustable loft hybrid golf club. In a further embodiment, the third golf club in this loft range is also adjustable and provides at least three additional distinct loft settings, wherein at least one of the loft settings is equal to a loft setting of one of the other two clubs, or overlaps into the first loft adjustability range or the first flat face loft adjustability range. In yet a further embodiment at least one of the golf clubs within this loft range is an adjustable length golf club and has at least one length that is equal to the length of at least one of the other two golf clubs within this loft range. Still further, another embodiment has at least two of the golf clubs within this loft range that are adjustable length golf clubs and have at least one length that is equal to the length of at least one of the other two golf clubs within this loft range. In yet a further embodiment at least one of the golf clubs within this loft range is an adjustable lie golf club and has at least one lie angle that is equal to the lie angle of at least one of the other two golf clubs within this loft range. Still further, another embodiment has at least two of the golf clubs within this loft range that are adjustable lie golf clubs and have at least one lie angle that is equal to the lie angle of at least one of the other two golf clubs within this loft range. In yet another embodiment all three of the golf clubs within this loft range have an MOIy, which is the moment of the inertia of the golf club head around an axis through the CG, parallel to the Y-axis, that is within the range of 2200-3000 g*cm$^2$. In a further embodiment all three of the clubs in this particular set have face performance indicators within 20% of the highest face performance indicator. While in another embodiment all three of the clubs in this particular set have face performance indicators within 10% of the highest face performance indicator; and in another embodiment the highest face performance indicator is associated with a flat face golf club head.

In still a further embodiment, the transition from curved face golf club to flat face golf club occurs in a loft range of 20-30 degrees and the golf club set includes at least five golf clubs having design lofts of 20-40 degrees, including at least two curved face adjustable loft hybrid golf clubs, having a first loft adjustability range and a second loft adjustability range, and at least two flat face adjustable loft golf clubs, having a first flat face loft adjustability range and a second flat face loft adjustability range. The four loft adjustability ranges combine to provide at least twelve distinct loft settings, wherein at least one of the flat face loft adjustable golf clubs has a loft setting that is equal to, or less than, at least one of loft setting of one of the curved face adjustable loft hybrid golf clubs. In yet a further embodiment at least one of the golf clubs within this loft range is an adjustable length golf club and has at least one length that is equal to the length of at least one of the other golf clubs within this loft range. Still further, another embodiment has at least two of the golf clubs within this loft range that are adjustable length golf clubs and have at least one length that is equal to the length of at least one of the other golf clubs within this loft range. In yet a further embodiment at least one of the golf clubs within this loft range is an adjustable lie golf club and has at least one lie angle that is equal to the lie angle of at least one of the other four golf clubs within this loft range. Still further, another embodiment has at least two of the golf clubs within this loft range that are adjustable lie golf clubs and have at least one lie angle that is equal to the lie angle of at least one of the other golf clubs within this loft range. In yet another embodiment all five of the golf clubs within this loft range have an MOIy, which is the moment of the inertia of the golf club head around an axis through the CG, parallel to the Y-axis, that is within the range of 2200-3000 g*cm$^2$. In a further embodiment all five of the clubs in this particular set have face performance indicators within 20% of the highest face performance indicator. While in another embodiment all five of the clubs in this particular set have face performance indicators within 10% of the highest face performance indicator; and in another embodiment the highest face performance indicator is associated with a flat face golf club head.

In yet another set composition embodiment, the transition from curved face golf club to flat face golf club occurs in a loft range of 20-30 degrees and the golf club set includes at least five golf clubs having design lofts of 20-40 degrees, including at least two curved face adjustable loft hybrid golf clubs, having a first loft adjustability range and a second loft adjustability range, and at least one flat face adjustable loft golf club, having a first flat face loft adjustability range; wherein every portion of a loft window from 25-30 degrees falls within the first loft adjustability range, the second loft adjustability range, the first flat face loft adjustability range, or a combination of these three adjustability ranges. A similar set composition embodiment includes the transition from curved face golf club to flat face golf club occurs in a loft range of 20-30 degrees and the golf club set includes at least five golf clubs having design lofts of 20-40 degrees, including at least two curved face adjustable loft hybrid golf clubs, having a first loft adjustability range and a second loft adjustability range, and at least two flat face adjustable loft golf clubs, having a first flat face loft adjustability range and a second flat face loft adjustability range; wherein every portion of a loft window from 25-35 degrees falls within the first loft adjustability range, the second loft adjustability range, the first flat face loft adjustability range, the second flat face loft adjustability range, or a combination of these four adjustability ranges. Either of these two embodiments may include at least one of the flat face loft adjustable golf clubs having a loft setting that is equal to, or less than, at least one of loft setting of one of the curved face adjustable loft hybrid golf clubs. Even further, at least one of the golf clubs within this loft range may be an adjustable length golf club and has at least one length that is equal to the length of at least one of the other golf clubs within this loft range. Still further, another embodiment has at least two of the golf clubs within this loft range that are adjustable length golf clubs and have at least one length that is equal to the length of at least one of the other golf clubs within this loft range. In yet a further embodiment at least one of the golf clubs within this loft range is an adjustable lie golf club and has at least one lie angle that is equal to the lie angle of at least one of the other four golf clubs within this loft range. Still further, another embodiment has at least two of the golf clubs within this loft range that are adjustable lie golf clubs and have at least one lie angle that is equal to the lie angle of at least one of the other golf clubs within this loft range. In an even further embodiment the two flat face lie adjustable golf clubs have a first flat face lie adjustability range and a second flat face lie adjustability range; wherein every portion of a lie window from 60-63 degrees falls within the first flat face lie adjustability range, the second flat face lie adjustability range, or a combination of these two adjustability ranges. This embodiment may include at least one of the flat face loft adjustable golf clubs having a lie setting that is equal to, or less than, at least one of lie settings of one of the flat face adjustable loft golf club that has a lesser design loft. In yet another embodiment all five of the golf clubs within this loft range have an MOIy, which is the moment of the inertia of the golf club head around an axis through the CG, parallel to the Y-axis, that is within the range of 2200-3000 g*cm$^2$. In a further embodiment all five of the clubs in this particular set have face performance indicators within 20% of the highest face performance indicator. While in another embodiment all five of the clubs in this particular set have face performance indicators within 10% of the highest face performance indicator; and in another embodiment the highest face performance indicator is associated with a flat face golf club head.

Still further, another set composition embodiment, the transition from curved face golf club to flat face golf club occurs in a loft range of 25-35 degrees and the golf club set includes at least six golf clubs having design lofts of 20-44 degrees, including at least two curved face adjustable loft hybrid golf clubs, having a first loft adjustability range and a second loft adjustability range, and at least two flat face adjustable loft golf club, having a first flat face loft adjustability range and a second flat face loft adjustability range; wherein every portion of a loft window from 25-35 degrees falls within the first loft adjustability range, the second loft adjustability range, the first flat face loft adjustability range, the second flat face loft adjustability range, or a combination of these four adjustability ranges. This embodiment may include at least one of the flat face loft adjustable golf clubs having a loft setting that is equal to, or less than, at least one of loft setting of one of the curved face adjustable loft hybrid golf clubs. Even further, at least two of the golf clubs within this loft range may be adjustable length golf clubs having at least one length that is equal to the length of at least one of the other golf clubs within this loft range. Still further, another embodiment has at least two of the golf clubs within this loft range that are adjustable length golf clubs and have at least one length that is equal to the length of at least one of the other golf clubs within this loft range. In yet a further embodiment at least one of the golf clubs within this loft range is an adjustable lie golf club and has at least one lie angle that is equal to the lie angle of at least one of the other five golf clubs within this loft range. Still further, another embodiment has at least two of the golf clubs within this loft range that are adjustable lie golf clubs and have at least one lie angle that is equal to the lie angle of at least one of the other golf clubs within this loft range. In an even further embodiment at least three flat face lie adjustable golf clubs have a first flat face lie adjustability range, a second flat face lie adjustability range, and a third flat face lie adjustability range; wherein every portion of a lie window from 60-63.5 degrees falls within the first flat face lie adjustability range, the second flat face lie adjustability range, the third flat face lie adjustability range, or a combination of these three adjustability ranges. This embodiment may include at least two of the flat face loft adjustable golf clubs having a lie setting that is equal to, or less than, at least one of lie settings of one of the flat face adjustable loft golf club that has a lesser design loft. In yet another embodiment all six of the golf clubs within this loft range have an MOIy, which is the moment of the inertia of the golf club head around an axis through the CG, parallel to the Y-axis, that is within the range of 2200-3000 g*cm$^2$. In a further embodiment all six of the clubs in this particular set have face performance indicators within 20% of the highest face performance indicator. While in another embodiment all six of the clubs in this particular set have face performance indicators within 10% of the highest face performance indicator; and in another embodiment the highest face performance indicator is associated with a flat face golf club head.

While the transition point within a set from a curved face club to a flat face club is important for distance gapping, so to is having a broad window of adjustable loft coverage within the higher lofted clubs of a set. Thus, another embodiment includes at least three golf clubs having design lofts of 30-50 degrees, including at least three flat face adjustable loft golf clubs with a design loft of at least 37 degrees. The three flat face adjustable loft golf clubs have a first flat face loft adjustability range, a second flat face loft adjustability range, and a third flat face loft adjustability range; wherein every portion of a loft window from 40-45 degrees falls within the first flat face loft adjustability range, the second flat face loft adjustability range, and the third flat face loft adjustability range, or a combination of these three adjustability ranges. This embodiment may include at least one of the flat face loft adjustable golf clubs having a loft setting that is equal to, or less than, at least one of loft setting of one of the flat face adjustable loft golf club that has a lesser design loft. Even further, at least one of the golf clubs within this loft range may be an adjustable length golf club and have at least one length that is equal to the length of at least one of the other golf clubs within this loft range. Still further, another embodiment has at least two of the golf clubs within this loft range that are adjustable length golf clubs and have at least one length that is equal to the length of at least one of the other golf clubs within this loft range. In another embodiment the three flat face adjustable loft golf clubs are also lie angle adjustable and have a first flat face lie adjustability range, a second flat face lie adjustability range, and a third flat face lie adjustability range; wherein every portion of a lie window from 62-65 degrees falls within the first flat face lie adjustability range, the second flat face lie adjustability range, and the third flat face lie adjustability range, or a combination of these three adjustability ranges. This embodiment may include at least one of the flat face loft adjustable golf clubs having a lie setting that is equal to, or less than, at least one of lie settings of one of the flat face adjustable loft golf club that has a lesser design loft.

Another high lofted embodiment includes at least five golf clubs having design lofts of 30-50 degrees, including at least four flat face adjustable loft golf clubs with a design loft of at least 30 degrees. The four flat face adjustable loft golf clubs have a first flat face loft adjustability range, a second flat face loft adjustability range, a third flat face loft adjustability range, and a fourth flat face loft adjustability range; wherein every portion of a loft window from 35-45 degrees falls within the first flat face loft adjustability range, the second flat face loft adjustability range, the third flat face loft adjustability range, and the fourth flat face loft adjustability range, or a combination of these four adjustability ranges. This embodiment may include at least one of the flat face loft adjustable golf clubs having a loft setting that is equal to, or less than, at least one of loft setting of one of the flat face adjustable loft golf club that has a lesser design loft. Even further, at least one of the golf clubs within this loft range may be an adjustable length golf club and have at least one length that is equal to the length of at least one of the other golf clubs within this loft range. Still further, another embodiment has at least two of the golf clubs within this loft range that are adjustable length golf clubs and have at least one length that is equal to the length of at least one of the other golf clubs within this loft range. In another embodiment the four flat face adjustable loft golf clubs are also lie angle adjustable and have a first flat face lie adjustability range, a second flat face lie adjustability range, a third flat face lie adjustability range, and a fourth flat face lie adjustability range; wherein every portion of a lie window from 62-65 degrees falls within the first flat face lie adjustability range, the second flat face lie adjustability range, the third flat face lie adjustability range, and the fourth flat face lie adjustability range, or a combination of these four adjustability ranges. This embodiment may include at least one of the flat face loft adjustable golf clubs having a lie setting that is equal to, or less than, at least one of lie settings of one of the flat face adjustable loft golf club that has a lesser design loft.

Further, any of the prior embodiments may also include adjustability of the face performance indicator thereby further controlling the distance gap between the flat face club and the curved face club. One skilled in the art will recognize that such face performance indicator adjustability may be accomplished in a number of ways, but is generally accomplished by adjusting a load on the face or limiting the deflection of the face. In one embodiment the first curved face performance indicator is adjustable from a first curved face PI design value to a first curved face PI weak value, wherein the first curved face PI weak value is equal to, or less than, a first flat face PI value. In another embodiment the first flat face golf club head also includes adjustability from a first flat face PI design value to a first flat face PI strong value, wherein the first flat face PI strong value is at least as great as the first curved face PI weak value. In an even further embodiment the first flat face PI strong value is greater than as the first curved face PI weak value.

Numerous alterations, modifications, and variations of the preferred embodiments disclosed herein will be apparent to those skilled in the art and they are all anticipated and contemplated to be within the spirit and scope of the disclosed length adjustment system. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the length adjustment system are described herein, it is to be understood that the practice of such additional modifications and variations and the equivalents thereof, are within the spirit and scope of the length adjustment system as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A set of golf clubs, comprising:

A) a first curved face adjustable loft hybrid golf club having:

(I) a first curved face golf club head having:

(a) a first curved face positioned at a first front portion of the first curved face golf club head where the first curved face golf club head impacts a golf ball, wherein the first curved face has a first design loft of at least 15 degrees and no more than 42.5 degrees, and wherein the first curved face includes a first engineered impact point, and a first rear portion opposite the first curved face;

(b) a first sole positioned at a first bottom portion of the first curved face golf club head;

(c) a first crown positioned at a first top portion of the first curved face golf club head;

(d) a first skirt positioned around a portion of a periphery of the first curved face golf club head between the first sole and the first crown, wherein the first curved face, first sole, first crown, and first skirt define a first outer shell that further defines a first head volume that is at least 40 cubic centimeters and less than 130 cubic centimeters;

(e) a first hosel with a first bore having a first center that defines a first bore axis which intersects with a horizontal ground plane (GP) to define a first origin point, wherein the first bore is located at a first heel side of the first curved face golf club head, and wherein a first toe side of the first curved face golf club head is located opposite of the first heel side;

(II) a first shaft having a first proximal end and a first distal end;

(III) a first adjustability system including a first shaft sleeve attached to an end of the first shaft that adjustably cooperates with the first hosel of the first curved face golf club head and capable of adjusting the first design loft to a first weak loft, thereby defining a first loft adjustability range, wherein the mass properties of the first curved face golf club head with the first adjustability system installed produce a first center of gravity (CG) located:

(a) vertically toward the first top portion of the first curved face golf club head from the first origin point a first distance Ycg;

(b) horizontally from the first origin point toward the first toe side of the first curved face golf club head a first distance Xcg that is generally parallel to the first curved face and the ground plane (GP);

(c) a first distance Zcg from the first origin toward the first rear portion in a direction generally orthogonal to the vertical direction used to measure the first Ycg and generally orthogonal to the horizontal direction used to measure the first Xcg; and (d) thereby defining a first club moment arm measured from the first CG to the first engineered impact point;

(IV) a first grip attached to the first shaft proximal end; and (V) wherein the first curved face golf club has a first club length of at least 36 inches and no more than 42 inches;

B) a first flat face adjustable golf club having:

(I) a first flat face golf club head having:

(a) a first flat face positioned at a first flat face front portion of the first flat face golf club head where the first flat face golf club head impacts a golf ball, wherein the first flat face has a first flat face design loft, and wherein the first flat face includes a first flat face engineered impact point, and a first flat face rear portion opposite the first flat face;

(b) a first flat face club head volume;

(c) a first flat face hosel with a first flat face bore having a first flat face center that defines a first flat face bore axis which intersects with a horizontal ground plane to define a first flat face origin point, wherein the first flat face bore is located at a first flat face heel side of the first flat face golf club head, and wherein a first flat face toe side of the first flat face golf club head is located opposite of the first flat face heel side;

(II) a first flat face shaft having a first flat face proximal end and a first flat face distal end;

(III) a first flat face adjustability system including a first flat face shaft sleeve attached to an end of the first flat face shaft that adjustably cooperates with the first flat face hosel and is capable of (a) adjusting the first flat face design loft from a first flat face weak loft to a first flat face strong loft, thereby defining a first flat face loft adjustability range of at least 3 degrees, and (b) adjusting the first flat face adjustable golf club in lie angle from a first flat face design lie angle to a first flat face upright lie angle, thereby defining a first flat face lie adjustability range of at least 0.5 degrees, wherein the mass properties of the first flat face golf club head with the first flat face adjustability system installed produce a first flat face center of gravity (CG) and define a first flat face club moment arm;

(IV) a first flat face grip attached to the first flat face shaft proximal end; and (V) wherein the first flat face golf club has a first flat face club length of at least 36 inches and no more than 42 inches;

C) a second flat face adjustable golf club having:

(I) a second flat face golf club head having:

(a) a second flat face positioned at a second flat face front portion of the second flat face golf club head where the second flat face golf club head impacts a golf ball, wherein the second flat face has a second flat face design loft of at least 2 degrees greater than the first flat face design loft, and wherein the second flat face includes a second flat face engineered impact point, and a second flat face rear portion opposite the second flat face;

(b) a second flat face club head volume;

(c) a second flat face hosel with a second flat face bore having a second flat face center that defines a second flat face bore axis which intersects with a horizontal ground plane to define a second flat face origin point, wherein the second flat face bore is located at a second flat face heel side of the second flat face golf club head, and wherein a second flat face toe side of the second flat face golf club head is located opposite of the second flat face heel side;

(II) a second flat face shaft having a second flat face proximal end and a second flat face distal end;

(III) a second flat face adjustability system including a second flat face shaft sleeve attached to an end of the second flat face shaft that adjustably cooperates with the second flat face hosel and is capable of (a) adjusting the second flat face design loft from a second flat face weak loft to a second flat face strong loft, thereby defining a second flat face loft adjustability range of at least 3 degrees, and (b) adjusting the second flat face adjustable golf club in lie angle from a second flat face design lie angle to a second flat face flat lie angle, thereby defining a second flat face lie adjustability range of at least 0.5 degrees, and wherein the mass properties of the second flat face golf club head with the second flat face adjustability system installed produce a second flat face center of gravity (CG) and define a second flat face club moment arm;

(IV) a second flat face grip attached to the second flat face shaft proximal end; and (V) wherein the second flat face golf club has a second flat face club length of at least 36 inches and no more than 42 inches;

D) wherein the first curved face weak loft is within 1.5 degrees of the first flat face design loft, the first flat face weak loft is within 1.5 degrees of the second flat face design loft, the first flat face strong loft is equal to, or less than, the first curved face weak loft, the second flat face strong loft is equal to, or less than, the first flat face weak loft, the first flat face flat lie angle is equal to, or less than, the first curved face upright lie angle, and the second flat face flat lie angle is equal to, or less than, the first flat face upright lie angle;

E) wherein a first flat face golf club head moment of inertia around a vertical axis through the CG, parallel to a vertical Y-axis, varies by less than 10 percent throughout the first flat face loft adjustability range and the first flat face lie adjustability range, a second flat face golf club head moment of inertia around a vertical axis through the CG, varies by less than 10 percent throughout the second flat face loft adjustability range and the second flat face lie adjustability range;

F) the second flat face club moment arm is within 15% of the first flat face club moment arm; and G) the first curved face adjustable golf club has a first performance indicator, the first flat face adjustable golf club has a second performance indicator, and the second flat face golf club has a third performance indicator, and wherein the first performance indicator is less than at least one of the second performance indicator and the third performance indicator.

2. The set of golf clubs of claim 1, wherein the first performance indicator is less than both the second performance indicator and the third performance indicator.

3. The set of golf clubs of claim 2, wherein the first performance indicator is 5-20% less than at least one of the second performance indicator and the third performance indicator.

4. The set of golf clubs of claim 3, wherein the first performance indicator is within 10% the second performance indicator, and the third performance indicator is within 10% the second performance indicator.

5. The set of golf clubs of claim 4, wherein the location of the first flat face center of gravity varies by less than 10 percent throughout the first flat face loft adjustability range and the first flat face lie adjustability range, and the location of the second flat face center of gravity varies by less than 10 percent throughout the second flat face loft adjustability range and the second flat face lie adjustability range.

6. The set of golf clubs of claim 5, wherein a difference between the first club moment arm and the first flat face club moment arm is less than 0.300 inches.

7. The set of golf clubs of claim 6, wherein the first flat face club moment arm is at least 60% of the first club moment arm.

8. The set of golf clubs of claim 7, wherein the difference between the first club moment arm and the first flat face club moment arm is less than 0.250 inches, and the first flat face club moment arm is 75%-95% of the first club moment arm.

9. The set of golf clubs of claim 6, wherein the first flat face design loft is 20-30 degrees.

10. The set of golf clubs of claim 9, wherein the second flat face design loft is greater than 30 degrees.

11. The set of golf clubs of claim 2, wherein the first club moment arm is 0.7-0.9 inches.

12. The set of golf clubs of claim 2, wherein a first curved face golf club head moment of inertia around a vertical axis through the CG is within 15 percent of a first flat face golf club head moment of inertia around a vertical axis through the CG.

13. A set of golf clubs, comprising:

A) a first curved face adjustable loft hybrid golf club having:

(I) a first curved face golf club head having:

(a) a first curved face positioned at a first front portion of the first curved face golf club head where the first curved face golf club head impacts a golf ball, wherein the first curved face has a first design loft of at least 15 degrees and no more than 42.5 degrees, and wherein the first curved face includes a first engineered impact point, and a first rear portion opposite the first curved face;

(b) a first sole positioned at a first bottom portion of the first curved face golf club head;

(c) a first crown positioned at a first top portion of the first curved face golf club head;

(d) a first skirt positioned around a portion of a periphery of the first curved face golf club head between the first sole and the first crown, wherein the first curved face, first sole, first crown, and first skirt define a first outer shell that further defines a first head volume that is at least 40 cubic centimeters and less than 130 cubic centimeters;

(e) a first hosel with a first bore having a first center that defines a first bore axis which intersects with a horizontal ground plane (GP) to define a first origin point, wherein the first bore is located at a first heel side of the first curved face golf club head, and wherein a first toe side of the first curved face golf club head is located opposite of the first heel side;

(II) a first shaft having a first proximal end and a first distal end;

(III) a first adjustability system including a first shaft sleeve attached to an end of the first shaft that adjustably cooperates with the first hosel of the first curved face golf club head and capable of adjusting the first design loft to a first weak loft, thereby defining a first loft adjustability range, wherein the mass properties of the first curved face golf club head with the first adjustability system installed produce a first center of gravity (CG) located:

(a) vertically toward the first top portion of the first curved face golf club head from the first origin point a first distance Ycg;

(b) horizontally from the first origin point toward the first toe side of the first curved face golf club head a first distance Xcg that is generally parallel to the first curved face and the ground plane (GP);

(c) a first distance Zcg from the first origin toward the first rear portion in a direction generally orthogonal to the vertical direction used to measure the first Ycg and generally orthogonal to the horizontal direction used to measure the first Xcg; and (d) thereby defining a first club moment arm measured from the first CG to the first engineered impact point;

(IV) a first grip attached to the first shaft proximal end; and (V) wherein the first curved face golf club has a first club length of at least 36 inches and no more than 42 inches;

B) a first flat face adjustable golf club having:

(I) a first flat face golf club head having:

(a) a first flat face positioned at a first flat face front portion of the first flat face golf club head where the first flat face golf club head impacts a golf ball, wherein the first flat face has a first flat face design loft, and wherein the first flat face includes a first flat face engineered impact point, and a first flat face rear portion opposite the first flat face;

(b) a first flat face club head volume;

(c) a first flat face hosel with a first flat face bore having a first flat face center that defines a first flat face bore axis which intersects with a horizontal ground plane to define a first flat face origin point, wherein the first flat face bore is located at a first flat face heel side of the first flat face golf club head, and wherein a first flat face toe side of the first flat face golf club head is located opposite of the first flat face heel side;

(II) a first flat face shaft having a first flat face proximal end and a first flat face distal end;

(III) a first flat face adjustability system including a first flat face shaft sleeve attached to an end of the first flat face shaft that adjustably cooperates with the first flat face hosel and is capable of (a) adjusting the first flat face design loft from a first flat face weak loft to a first flat face strong loft, thereby defining a first flat face loft adjustability range of at least 3 degrees, and (b) adjusting the first flat face adjustable golf club in lie angle from a first flat face design lie angle to a first flat face upright lie angle, thereby defining a first flat face lie adjustability range of at least 0.5 degrees, wherein the mass properties of the first flat face golf club head with the first flat face adjustability system installed produce a first flat face center of gravity (CG) and define a first flat face club moment arm;

(IV) a first flat face grip attached to the first flat face shaft proximal end; and (V) wherein the first flat face golf club has a first flat face club length of at least 36 inches and no more than 42 inches;

C) a second flat face adjustable golf club having:

(I) a second flat face golf club head having:

(a) a second flat face positioned at a second flat face front portion of the second flat face golf club head where the second flat face golf club head impacts a golf ball, wherein the second flat face has a second flat face design loft of at least 2 degrees greater than the first flat face design loft, and wherein the second flat face includes a second flat face engineered impact point, and a second flat face rear portion opposite the second flat face;

(b) a second flat face club head volume;

(c) a second flat face hosel with a second flat face bore having a second flat face center that defines a second flat face bore axis which intersects with a horizontal ground plane to define a second flat face origin point, wherein the second flat face bore is located at a second flat face heel side of the second flat face golf club head, and wherein a second flat face toe side of the second flat face golf club head is located opposite of the second flat face heel side;

(II) a second flat face shaft having a second flat face proximal end and a second flat face distal end;

(III) a second flat face adjustability system including a second flat face shaft sleeve attached to an end of the second flat face shaft that adjustably cooperates with the second flat face hosel and is capable of (a) adjusting the second flat face design loft from a second flat face weak loft to a second flat face strong loft, thereby defining a second flat face loft adjustability range of at least 3 degrees, and (b) adjusting the second flat face adjustable golf club in lie angle from a second flat face design lie angle to a second flat face flat lie angle, thereby defining a second flat face lie adjustability range of at least 0.5 degrees, and wherein the mass properties of the second flat face golf club head with the second flat face adjustability system installed produce a second flat face center of gravity (CG) and define a second flat face club moment arm;

(IV) a second flat face grip attached to the second flat face shaft proximal end; and (V) wherein the second flat face golf club has a second flat face club length of at least 36 inches and no more than 42 inches;

D) wherein the first curved face weak loft is within 1.5 degrees of the first flat face design loft, the first flat face weak loft is within 1.5 degrees of the second flat face design loft, the first flat face strong loft is equal to, or less than, the first curved face weak loft, the second flat face strong loft is equal to, or less than, the first flat face weak loft, the first flat face flat lie angle is equal to, or less than, the first curved face upright lie angle, and the second flat face flat lie angle is equal to, or less than, the first flat face upright lie angle;

E) wherein a first flat face golf club head moment of inertia around a vertical axis through the CG, parallel to a vertical Y-axis, varies by less than 10 percent throughout the first flat face loft adjustability range and the first flat face lie adjustability range, a second flat face golf club head moment of inertia around a vertical axis through the CG, varies by less than 10 percent throughout the second flat face loft adjustability range and the second flat face lie adjustability range;

F) the second flat face club moment arm is within 15% of the first flat face club moment arm;

G) the first curved face adjustable golf club has a first performance indicator, the first flat face adjustable golf club has a second performance indicator, and the second flat face golf club has a third performance indicator, and wherein the first performance indicator is less than the second performance indicator and the third performance indicator; and H) the location of the first flat face center of gravity varies by less than 10 percent throughout the first flat face loft adjustability range and the first flat face lie adjustability range, and the location of the second flat face center of gravity varies by less than 10 percent throughout the second flat face loft adjustability range and the second flat face lie adjustability range.

14. The set of golf clubs of claim 13, wherein the first performance indicator is within 10% the second performance indicator, and the third performance indicator is within 10% the second performance indicator.

15. The set of golf clubs of claim 14, wherein the first performance indicator at least 5% less than at least one of the second performance indicator and the third performance indicator.

16. The set of golf clubs of claim 13, wherein a difference between the first club moment arm and the first flat face club moment arm is less than 0.300 inches.

17. The set of golf clubs of claim 13, wherein the first flat face club moment arm is at least 60% of the first club moment arm.

18. The set of golf clubs of claim 13, wherein the first flat face design loft is 20-30 degrees.

19. The set of golf clubs of claim 18, wherein the second flat face design loft is greater than 30 degrees.

20. The set of golf clubs of claim 13, wherein the first club moment arm is 0.7-0.9 inches.

* * * * *